US006173145B1

(12) United States Patent
Chadani et al.

(10) Patent No.: US 6,173,145 B1
(45) Date of Patent: Jan. 9, 2001

(54) DEVELOPING APPARATUS WITH DRIVE MECHANISM FOR DEVELOPER BEARING BODY

(75) Inventors: Kazuo Chadani, Shizuoka-ken; Tadayuki Tsuda, Susono; Hiroomi Matsuzaki, Mishima; Akira Suzuki, Odawara, all of (JP)

(73) Assignee: Canon Kabushiki Kaisha, Tokyo (JP)

( * ) Notice: Under 35 U.S.C. 154(b), the term of this patent shall be extended for 0 days.

(21) Appl. No.: 09/422,354

(22) Filed: Oct. 21, 1999

(30) Foreign Application Priority Data

Oct. 26, 1998 (JP) ..... 10-321295

(51) Int. Cl.[7] ..... G03G 15/08
(52) U.S. Cl. ..... 399/265; 399/279
(58) Field of Search ..... 399/265, 267, 399/279, 167, 116, 117, 104, 111

(56) References Cited

U.S. PATENT DOCUMENTS

| | | | | |
|---|---|---|---|---|
| 4,046,432 | * | 9/1977 | Hofmann et al. | 384/510 |
| 4,951,599 | * | 8/1990 | Damji | 399/90 |
| 5,040,779 | * | 8/1991 | Ogiri et al. | 271/109 |
| 5,126,800 | | 6/1992 | Shishido et al. | 355/211 |
| 5,151,734 | | 9/1992 | Tsuda et al. | 355/200 |
| 5,208,634 | | 5/1993 | Ikemoto et al. | 355/215 |
| 5,223,893 | | 6/1993 | Ikemoto et al. | 355/200 |
| 5,283,616 | * | 2/1994 | Numagami et al. | 399/111 |
| 5,294,960 | | 3/1994 | Nomura et al. | 355/210 |
| 5,331,372 | | 7/1994 | Tsuda et al. | 355/200 |
| 5,345,294 | | 9/1994 | Nomura et al. | 355/200 |
| 5,404,198 | | 4/1995 | Noda et al. | 355/200 |
| 5,457,520 | * | 10/1995 | Schell et al. | 399/117 |
| 5,470,635 | | 11/1995 | Shirai et al. | 428/131 |
| 5,475,470 | | 12/1995 | Sasago et al. | 355/210 |
| 5,488,459 | | 1/1996 | Tsuda et al. | 355/211 |
| 5,510,878 | | 4/1996 | Noda et al. | 355/211 |
| 5,561,504 | | 10/1996 | Watanabe et al. | 355/215 |
| 5,581,325 | | 12/1996 | Tsuda et al. | 355/200 |
| 5,583,613 | | 12/1996 | Kobayashi et al. | 355/200 |
| 5,602,623 | | 2/1997 | Nishibata et al. | 399/111 |
| 5,608,509 | | 3/1997 | Shirai et al. | 399/351 |
| 5,623,328 | | 4/1997 | Tsuda et al. | 399/111 |
| 5,659,847 | | 8/1997 | Tsuda et al. | 399/113 |
| 5,669,042 | | 9/1997 | Kobayashi et al. | 399/111 |
| 5,809,374 | | 9/1998 | Tsuda et al. | 399/111 |
| 5,812,909 | | 9/1998 | Oguma et al. | 399/103 |
| 5,828,928 | | 10/1998 | Sasago et al. | 399/111 |
| 5,848,336 | * | 12/1998 | Hazama et al. | 399/222 |
| 5,878,304 | | 3/1999 | Watanabe et al. | 399/92 |
| 5,923,918 | | 7/1999 | Nakagawa et al. | 399/27 |
| 5,943,529 | | 8/1999 | Miyabe et al. | 399/111 |
| 5,966,567 | | 10/1999 | Matsuzaki et al. | 399/111 |
| 6,006,058 | | 12/1999 | Watanabe et al. | 399/167 |
| 6,011,941 | | 1/2000 | Takashima et al. | 399/111 |

FOREIGN PATENT DOCUMENTS

| | | | |
|---|---|---|---|
| 3-094283 | * | 4/1991 | (JP) . |
| 9-022189 | * | 1/1997 | (JP) . |

* cited by examiner

*Primary Examiner*—Robert Beatty
(74) *Attorney, Agent, or Firm*—Fitzpatrick, Cella, Harper & Scinto

(57) ABSTRACT

A developing apparatus includes a developer bearing body, a drive transmission gear, a support member, and a developing frame body, and the support member has an engaging portion for engaging with the developing frame body in a position opposite to a position where the drive force is transmitted to the drive transmission gear with respect to a rotating center of the developer bearing body.

18 Claims, 58 Drawing Sheets

DEVELOPING APPARATUS WITH DRIVE MECHANISM FOR DEVELOPER BEARING BODY

BACKGROUND OF THE INVENTION

1. Field of the Invention

The present invention relates to a developing apparatus and a process cartridge detachably attachable to an image forming apparatus.

Here, the image forming apparatus relates to an apparatus that uses an electrophotographic image forming process to form an image on a recording material, and examples of the apparatus include an electrophotographic copying machine, an electrophotographic printer (e.g., LED printer, laser beam printer, and the like), an electrophotographic facsimile device, and an electrophotographic word processor.

Moreover, for the process cartridge, charging means or cleaning means, developing means, and an electrophotographic body as an image bearing body, are integrally formed into a cartridge, and the cartridge is detachably attachable to the main body of the image forming apparatus. Alternatively, at least one of the charging means and the cleaning means, the developing means, and the electrophotographic body are integrally formed into a cartridge, which is detachably attachable to the main body of the image forming apparatus.

Furthermore, at least the developing means and the electrophotographic body are integrally formed into a cartridge which is detachably attachable to the main body of the image forming apparatus.

2. Related Background Art

In a conventional image forming apparatus using an electrophotographic image forming process, a process cartridge system is employed, which comprises integrally forming an electrophotographic body and process means acting on the electrophotographic body, into a cartridge, and detachably attaching the cartridge to the main body of the image forming apparatus. In the process cartridge system, the maintenance of the apparatus can be performed by a user himself, without depending on a service man, so that operation properties can remarkably be enhanced. Therefore, this process cartridge system is broadly used in the image forming apparatus.

In the developing apparatus incorporated in such process cartridge, there is proposed a method which comprises disposing magnetic seal members such as magnetic seals, to both end portions of a rotating developer bearing body with a constant interval from the developer bearing body to prevent toner from flowing outward.

Additionally, the developer bearing body is supported by a developing frame body by inserting pin portions of a developing holder into two holes made in the developing frame body and two holes made in a support member. Then, the developer bearing body is rotated by transmitting a drive force via a developing roller gear disposed coaxially with the developer bearing body.

When the drive force is applied to the developer bearing body, the support member for rotatably supporting the developer bearing body drops in a driving direction, a force is applied to the pins of the developing holder, creep occurs with the pins because of their durability, and a constant gap cannot be secured between the magnetic seal and the developer bearing body in some cases.

SUMMARY OF THE INVENTION

An object of the present invention is to provide a developing apparatus and a process cartridge in which when a drive force is applied to a developer bearing body, the developer bearing body and its support member are prevented from deviating in position.

Another object of the present invention is to provide a developing apparatus and a process cartridge in which an interval between a magnetic seal member and a developer bearing body can be kept to be constant.

DETAILED DESCRIPTION OF THE PREFERRED EMBODIMENTS

Preferred embodiments of the present invention will next be described. In the following description, the short direction (width-wise direction) of a process cartridge B indicates a direction in which the process cartridge B is attached to/detached from an apparatus main body 14, and coincides with the conveying direction of a recording material. Moreover, the longitudinal direction of the process cartridge B indicates a direction intersecting (substantially orthogonal to) the direction in which the process cartridge B is attached to/detached from the apparatus main body 14, and intersects (substantially orthogonal to) the conveying direction of the recording material.

Figure 1:
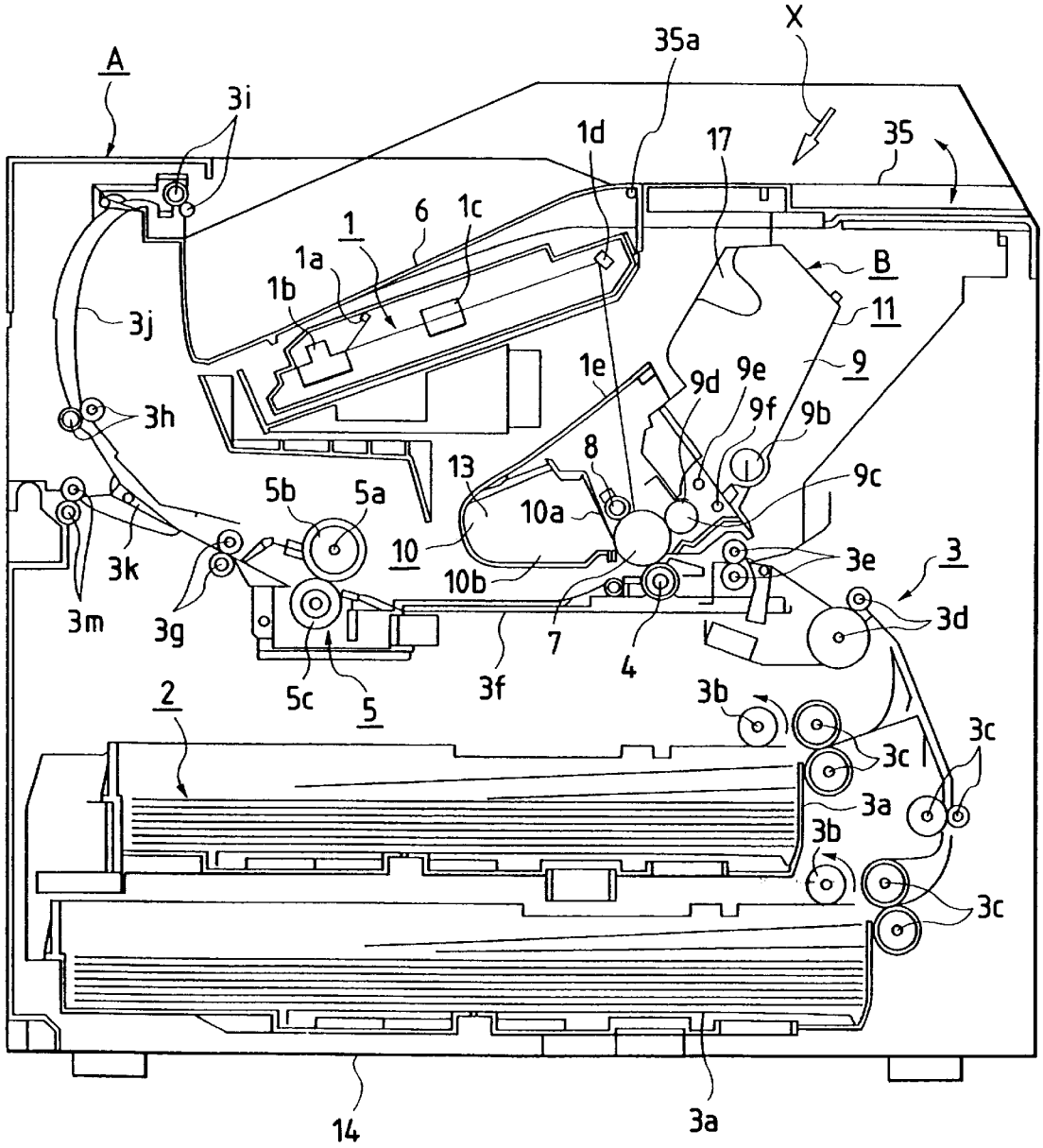
FIG. 1 is a side sectional view of an electrophotographic image forming apparatus to which one embodiment of the present invention is applied.
Figure 2:
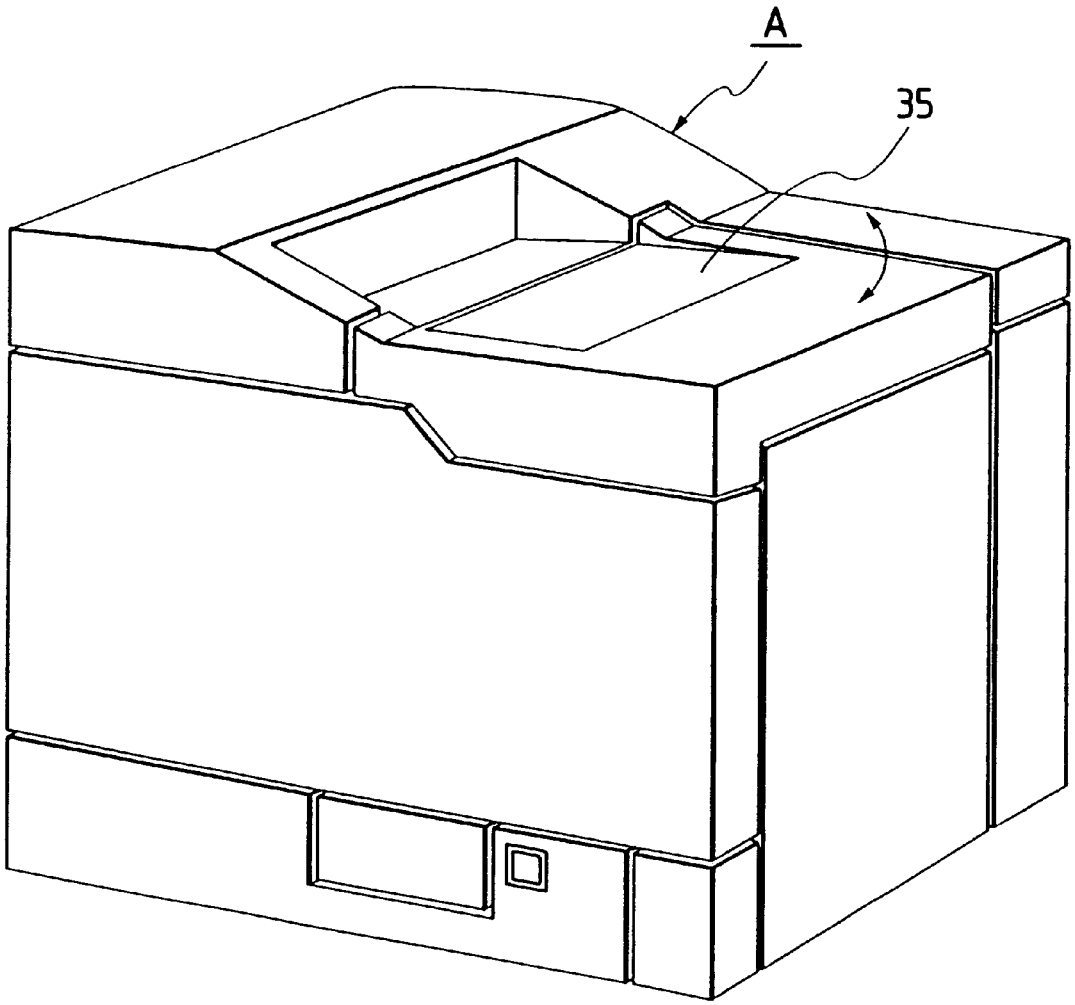
FIG. 2 is a perspective view showing the appearance of the apparatus shown in FIG. 1.
Figure 3:
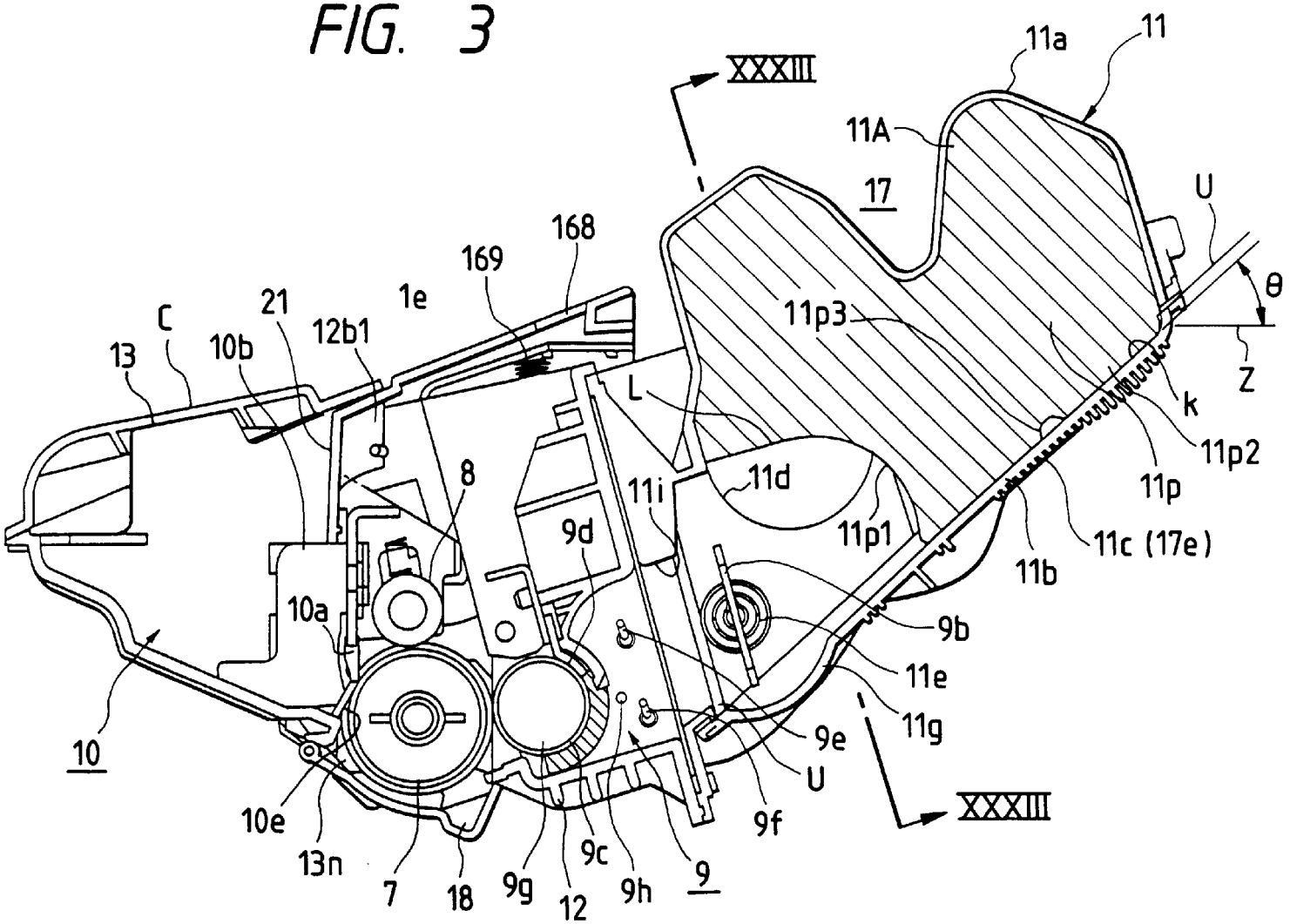
FIG. 3 is a side sectional view of a process cartridge to which one embodiment of the present invention is applied.
Figure 4:
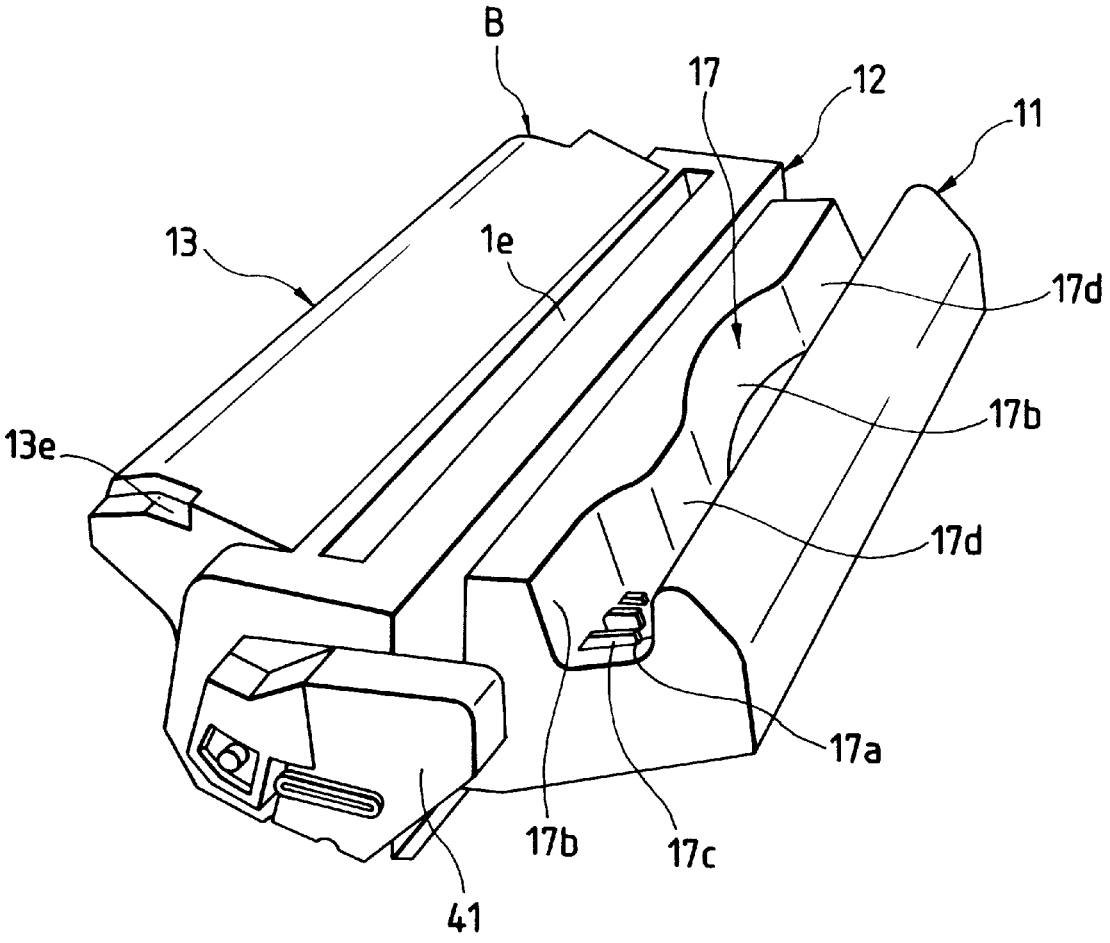
FIG. 4 is a schematic perspective view showing the appearance of the process cartridge shown in FIG. 3.
Figure 5:
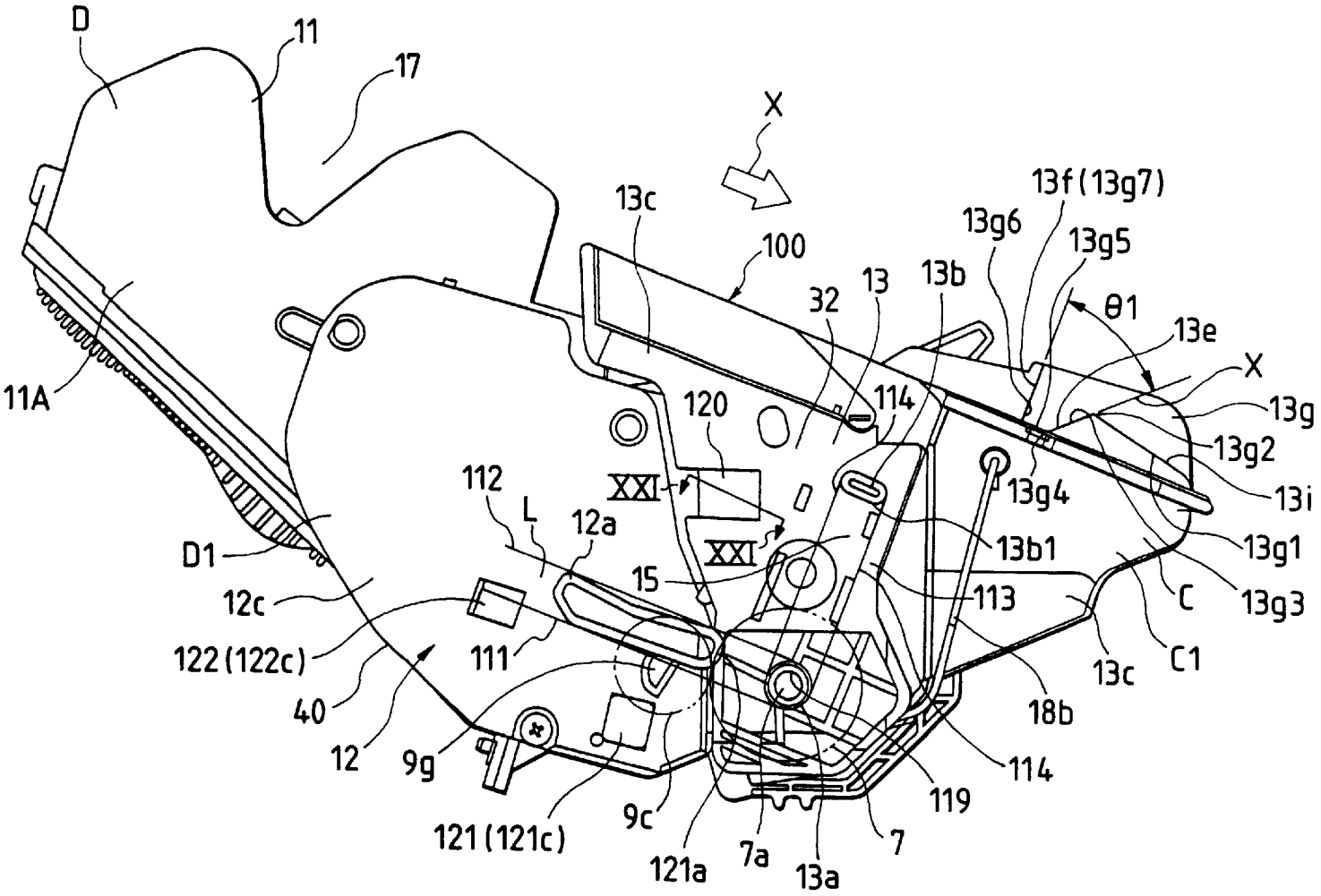
FIG. 5 is a right side view of the process cartridge shown in FIG. 3.
Figure 6:
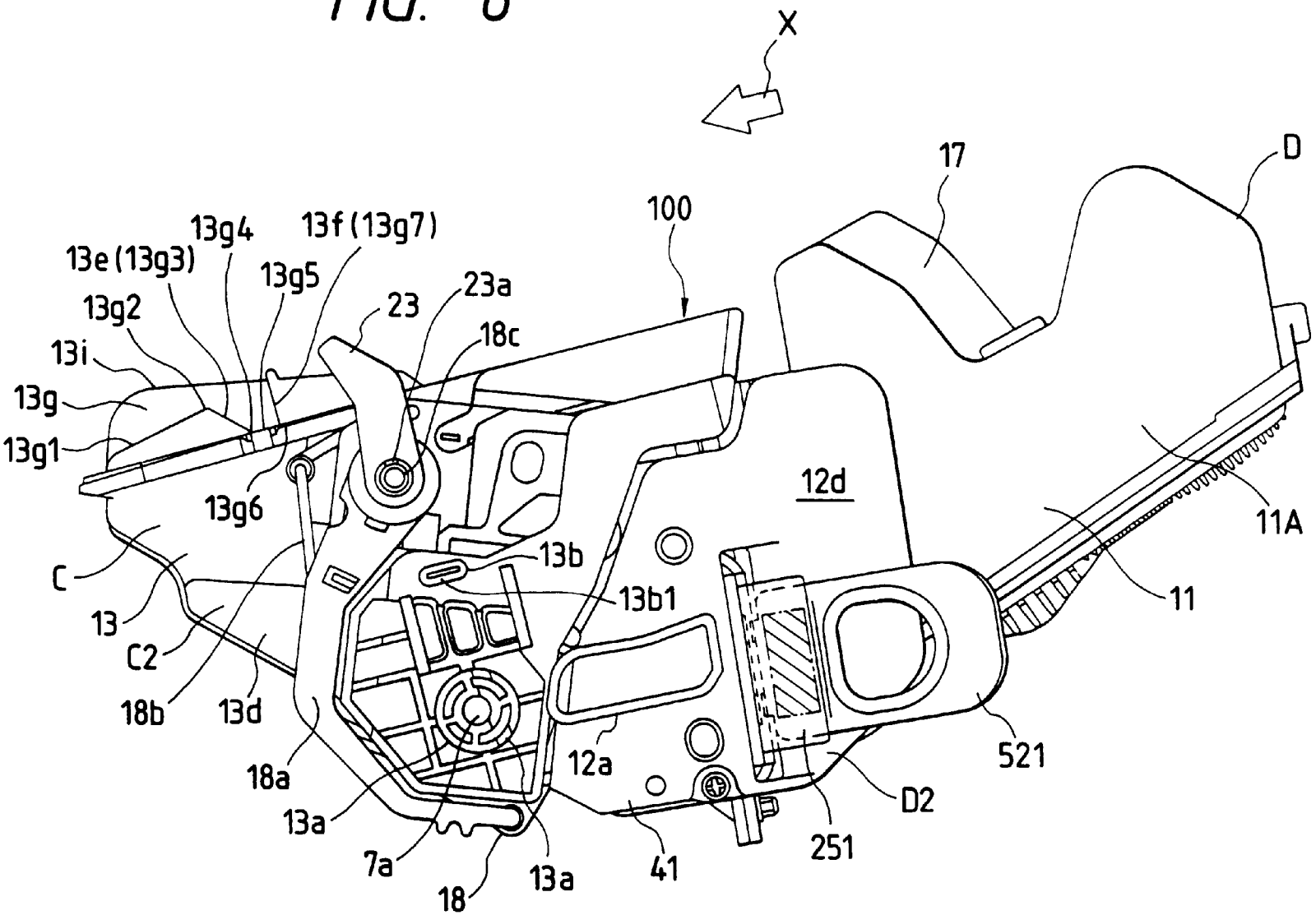
FIG. 6 is a left side view of the process cartridge shown in FIG. 3.
Figure 7:
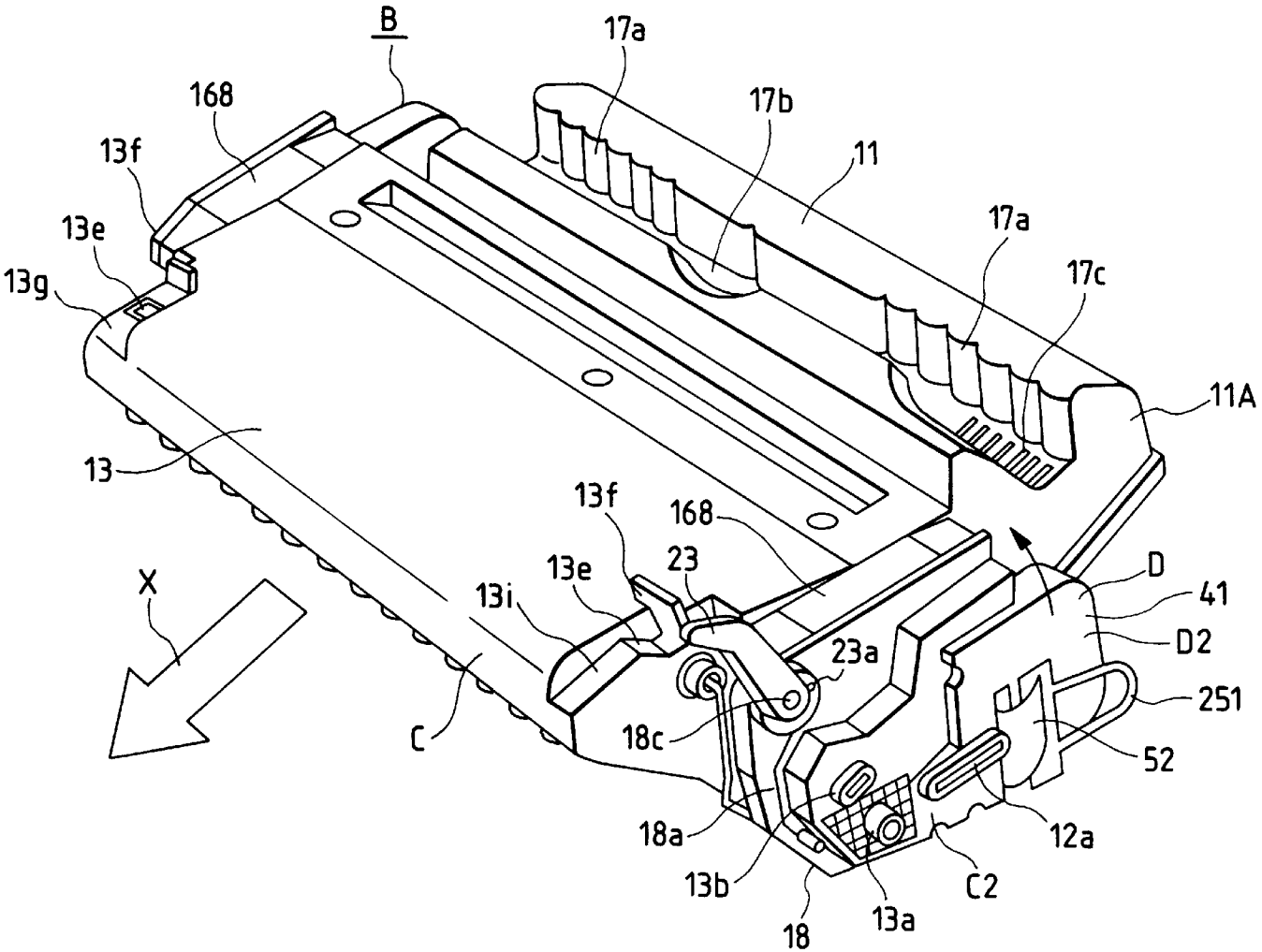
FIG. 7 is a perspective view showing the appearance of the process cartridge shown in FIG. 3.
Figure 8:
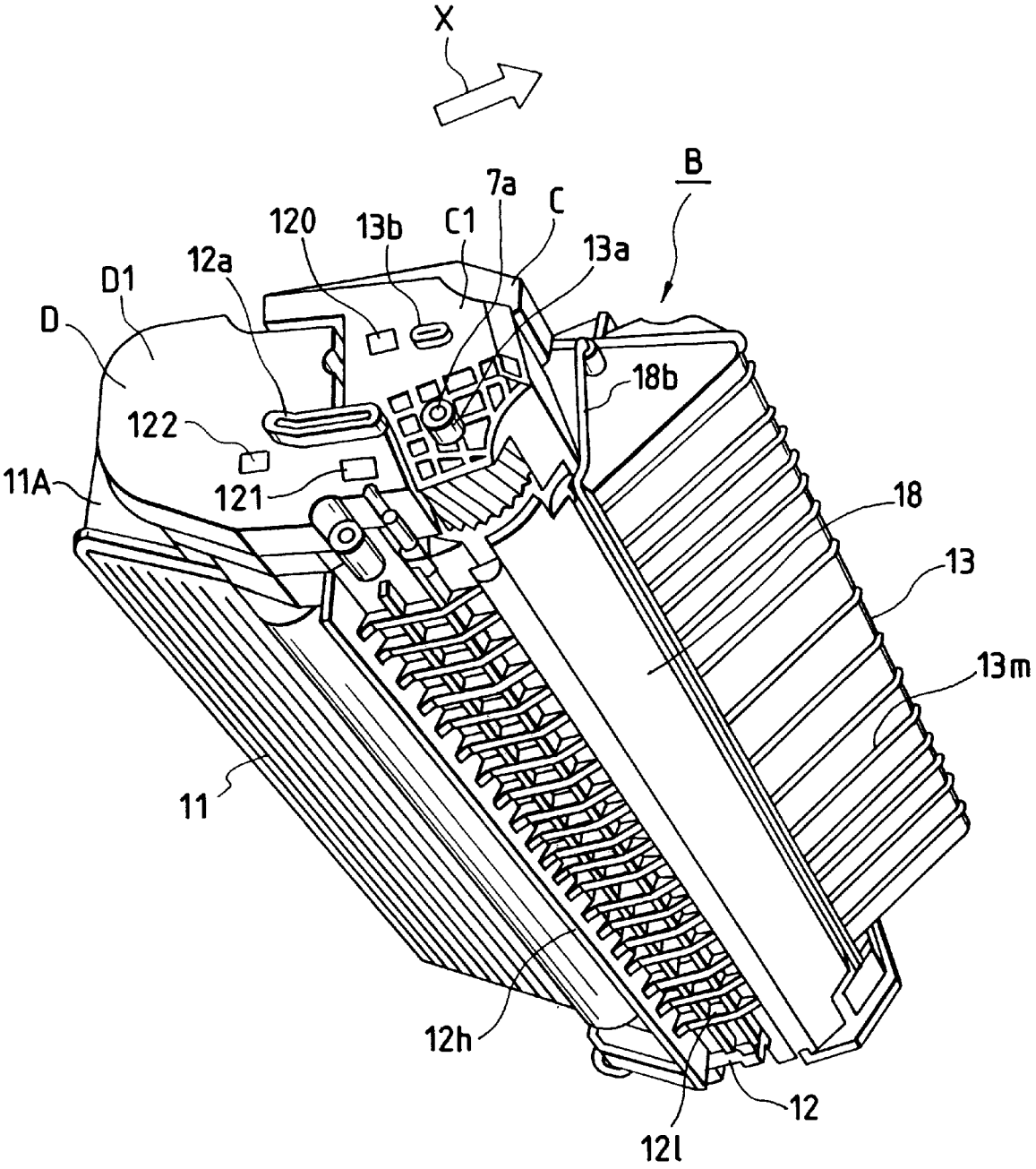
FIG. 8 is a perspective view showing the appearance of the process cartridge shown in FIG. 3 as seen from below.

FIG. 1 is an explanatory view of the constitution of an electrophotographic image forming apparatus (laser beam printer) to which an embodiment of the present invention is applied, and FIG. 2 is a perspective view showing the appearance of the device. Moreover, FIGS. 3 to 8 show a process cartridge to which the embodiment of the present invention is applied. FIG. 3 is a side sectional view of the process cartridge, FIG. 4 is a schematic perspective view showing the appearance of the process cartridge, FIG. 5 is a right side view of the process cartridge, FIG. 6 is a left side view of the process cartridge shown, FIG. 7 is a perspective view of the process cartridge as seen from above (upper surface), and FIG. 8 is a perspective view of the process cartridge as seen from below (lower surface). Furthermore, in the following description, the upper surface of the process cartridge B is positioned upward while the process cartridge B is attached to the apparatus main body 14, and the lower surface is positioned downward.

(Electrophotographic Image Forming Device A and Process Cartridge B)

First, a laser beam printer A as an electrophotographic image forming apparatus to which the embodiment of the present invention is applied will be described with reference to FIGS. 1 and 2. Moreover, FIG. 3 is a side sectional view of the process cartridge B.

As shown in FIG. 1, in the laser beam printer A, an image is formed on a recording material (e.g., a recording sheet, OHP sheet, cloth, and the like) by an electrophotographic image forming process. Furthermore, a toner image is formed on an electrophotographic photosensitive body having a drum shape (hereinafter referred to as the photosensitive drum). Specifically, after the photosensitive drum is charged by charging means, a laser beam is projected to the photosensitive drum from optical means in accordance with image information to form a latent image on the photosensitive drum in accordance with the image information. Then, the latent image is developed by developing means to form a toner image. In synchronism with the formation of the toner image, a recording material 2 set on a cassette 3*a* is reversed (a front surface and a rear surface of a recording material is reversed) and conveyed via pickup rollers 3*b*, conveying roller pairs 3*c*, 3*d* and a registration roller pair 3*e*. Subsequently, the toner image formed on the photosensitive drum of the process cartridge B is transferred to the recording material 2 by applying a voltage to a transfer roller 4 as transfer means. Subsequently, the recording material 2 with the toner image transferred thereto is conveyed to fixing means 5 via a conveying guide 3*f*. The fixing means 5 has a fixing roller 5*b* incorporating a drive roller 5*c* and a heater 5*a*. The transferred toner image is fixed by applying heat and pressure to the passing recording material 2. The recording material 2 is then conveyed by discharge roller pairs 3*g*, 3*h*, 3*i*, and discharged to a discharge tray 6 through a reversing path 3*j*. The discharge tray 6 is disposed on the upper surface of the apparatus main body 14 of the image forming apparatus A. Additionally, by operating a swingable flapper 3*k*, the recording material 2 can be discharged by a discharge roller pair 3*m*, not via the reversing path 3*j*. In the embodiment, the pickup rollers 3*b*, the conveying roller pairs 3*c*, 3*d*, the registration roller pair 3*e*, the conveying guide 3*f*, the discharge roller pairs 3*g*, 3*h*, 3*i* and the discharge roller pair 3*m* constitute conveying means 3.

On the other hand, as shown in FIGS. 3 to 8, in the process cartridge B, the photosensitive drum 7 having a photographic layer 7*e* (FIG. 20) rotates, and the surface of the drum is uniformly charged by applying a voltage to a charging roller 8. Subsequently, a laser beam is projected to the photosensitive drum 7 via an exposure opening 1*e* in accordance with the image information from an optical system 1 to form a latent image. The latent image is then developed by developing means 9 using toner. Specifically, the charging roller 8 is disposed in contact with the photosensitive drum 7 to charge the photosensitive drum 7. Additionally, the charging roller 8 rotates following the photosensitive drum 7. Moreover, the developing means 9 supplies toner to the developing area of the photosensitive drum 7 to develop the latent image formed on the photosensitive drum 7. Additionally, the optical system 1 has a laser diode 1*a*, a polygon mirror 1*b*, a lens 1*c*, and a reflective mirror 1*d*.

Here, the developing means 9 sends toner in a toner container 11A to a developing roller 9*c* by the rotation of a toner-feeding member 9*b*. Subsequently, the developing roller 9*c* incorporating a fixed magnet is rotated, a toner layer with triboelectricity applied thereto is formed on the surface of the developing roller 9*c* by a developing blade 9*d*, and the toner is supplied to the developing area of the photosensitive drum 7. Subsequently, by transferring the toner to the photosensitive drum 7 in accordance with the latent image, the toner image is formed and visualized. Here, the developing blade 9*d* defines the toner amount on the peripheral face of the developing roller 9*c*. Moreover, toner-agitating members 9*e*, 9*f* for circulating the toner in a developing chamber are rotatably attached in the vicinity of the developing roller 9*c*.

Subsequently, after the voltage having a polarity reverse to that of the toner image is applied to the transfer roller 4 to transfer the toner image formed on the photosensitive drum 7 to the recording material 2, residual toner on the photosensitive drum 7 is removed by cleaning means 10. Here, in the cleaning means 10, the residual toner on the photosensitive drum 7 is scraped off by an elastic cleaning blade 10*a* which is disposed to abut on the photosensitive drum 7, and collected to a waste-toner reservoir 10*b*.

Additionally, the process cartridge B is formed by combining a toner-frame body 11 having a toner container (toner storage section) 11A for containing the toner and a developing-frame body 12 for holding the developing means 9, such as the developing roller 9*c*. Additionally, the photosensitive drum 7, the cleaning means 10 such as the cleaning blade 10*a*, and a cleaning-frame body 13 provided with the charging roller 8 are combined to constitute to the cartridge. The process cartridge B can be attached to/detached from the apparatus main body 14 by an operator.

The process cartridge B is provided with the exposure opening 1*e* for permitting light to travel to the photosensitive drum 7 in accordance with the image information and a transfer opening 13*n* for disposing the photosensitive drum 7 opposite to the recording material 2. Specifically, the exposure opening 1*e* is disposed in the cleaning-frame body 13, and the transfer opening 13*n* is formed between the developing-frame body 12 and the cleaning-frame body 13.

The housing constitution of the process cartridge B according to the embodiment will next be described.

For the process cartridge B shown in the embodiment, the toner-frame body 11 and the developing-frame body 12 are combined, and the cleaning-frame body 13 is rotatably combined to constitute a housing. The housing contains the photosensitive drum 7, the charging roller 8, the developing means 9 and the cleaning means 10 to form a cartridge. Then, the process cartridge B is detachably attached to cartridge attaching means disposed in the apparatus main body 14. (Housing Constitution of Process Cartridge B)

In the process cartridge B according to the embodiment, as described above, the toner-frame body 11, the developing frame body 12 and the cleaning frame body 13 are combined to constitute the housing, and the constitution will next be described.

As shown in FIG. 3, the toner-feeding member 9*b* is rotatably attached to the toner-frame body 11. Moreover, the developing roller 9*c* and the developing blade 9*d* are attached to the developing-frame body 12, and the toner-agitating members 9*e*, 9*f* for circulating the toner in the developing chamber are rotatably attached in the vicinity of the developing roller 9*c*. Furthermore, an antenna rod 9*h* is attached opposite to the developing roller 9*c* in longitudinal direction, and substantially parallel with the developing roller 9*c*. Subsequently, the toner frame body 11 and the developing frame body 12 are welded (ultrasonic welding in the embodiment) to integrally constitute a developing unit D (see FIG. 9B) as a second frame body.

Moreover, the cleaning frame body 13 is provided with the photosensitive drum 7, the charging roller 8 and the members of the cleaning means 10. Furthermore, a drum-shutter member 18 is attached for covering the photosensitive drum 7 when the process cartridge B is detached from the apparatus main body 14 and for protecting the drum from exposure to light for a long time or from contact with foreign matter to constitute a cleaning unit C (see FIG. 9A) as a first frame body.

(Cleaning Unit Constitution)

Figure 38:
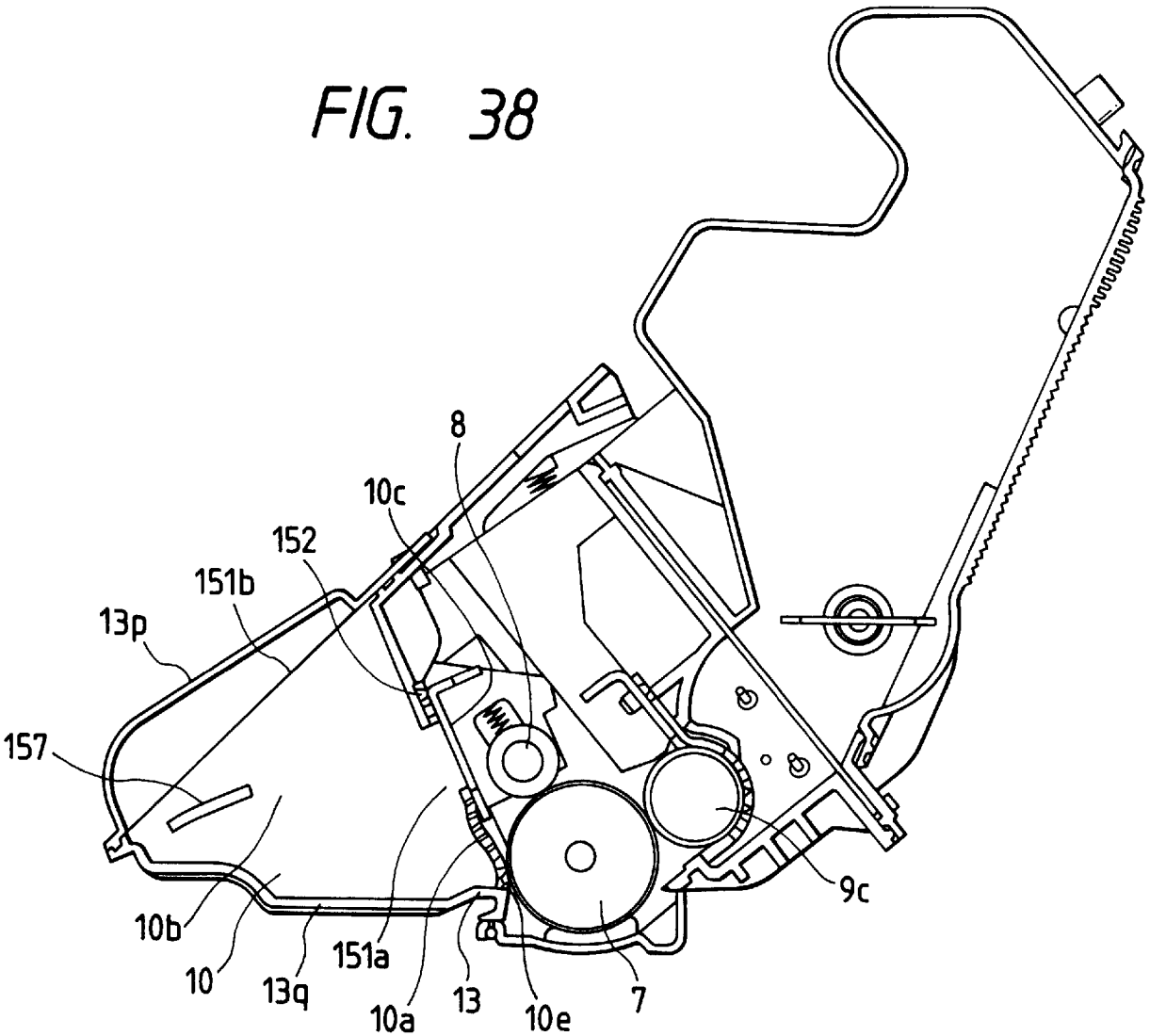
FIG. 38 is a side sectional view of the process cartridge of the embodiment to which the present invention is applied.

The cleaning means 10 will be described with reference to FIG. 38. The frame body 13 of the cleaning means 10 is constituted of a cleaning-frame main body 13*q* and a lid 13*p*, and one cleaning-frame main body 13*q* is constituted by integrally incorporating the photosensitive drum 7, a cleaning blade 10*a*, a float sheet 10*e*, and the charging roller 8 as charging means. Moreover, the waste-toner reservoir 10*b* is disposed inside the cleaning-frame main body 13*q*, and covered with a cleaning blade sheet metal 10*c*. Here, an opening 151*a* to be covered with the cleaning-blade sheet metal 10*c* of the cleaning-frame main body 13*q* is set to be small so that it can be covered with such short and narrow cleaning-blade sheet metal 10*c*.

Figure 39:
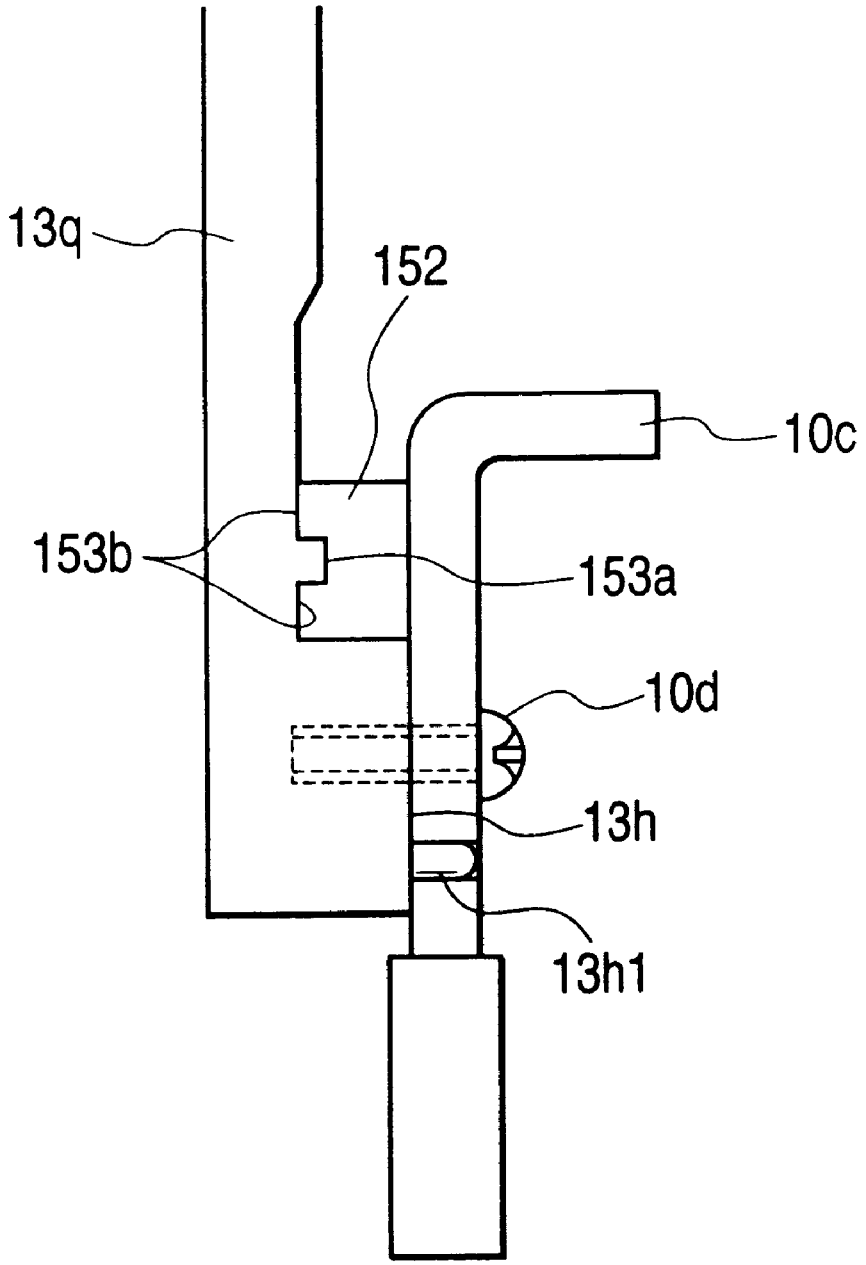
FIG. 39 is a longitudinal sectional view of the seal structure of a cleaning blade and a cleaning frame body.

Moreover, as shown in FIG. 39, a strip-like seal member 152 is disposed in a toner seal between the cleaning-blade sheet metal 10*c* and the cleaning-frame main body 13*q*. The seal member 152 is placed on a seal placing rib 153*a* of the cleaning-frame main body 13*q*. Here, since the seal member 152 is also placed on faces 153*b* lower than and on the opposite sides of the seal-placing rib 153*a*, sealing properties are secured. The seal member 152 is placed over substantially the entire length of the cleaning-blade sheet metal 10*c* in the longitudinal direction. Moreover, on both end sides of the cleaning-blade sheet metal 10*c* in the longitudinal direction, in the float sheet 1*e* (dipping sheet), the gap between the photosensitive drum 7 and the cleaning-frame main body 13*q* is closed by a sealing material (not shown) in the short direction, and the waste-toner reservoir 10*b* is closed.

The cleaning-blade sheet metal 10*c* abuts against a seat portion 13*h* of the cleaning-frame main body 13*q* disposed on each end in the longitudinal direction. By passing the sheet metal 10*c* and inserting a screw 10*d* into the seat portion 13*h*, each end of the sheet metal is fixed to the cleaning-frame main body 13*q*. Thereby, a distance between the sheet metal 10*c* and the longitudinally protruded rib 153*a* is determined, and the compression allowance of the seal member 152 having a larger thickness than the distance and having a rectangular strip-like sectional shape is determined. The seal member 152 is formed, for example, of foamed urethane rubber. Additionally, the seat portion 13*h* is provided with a positioning joggle 13*h*1, and the cleaning-blade sheet metal 10*c* is positioned by this joggle 13*h*1.

(Cleaning Frame Body Constitution)

Figure 40:
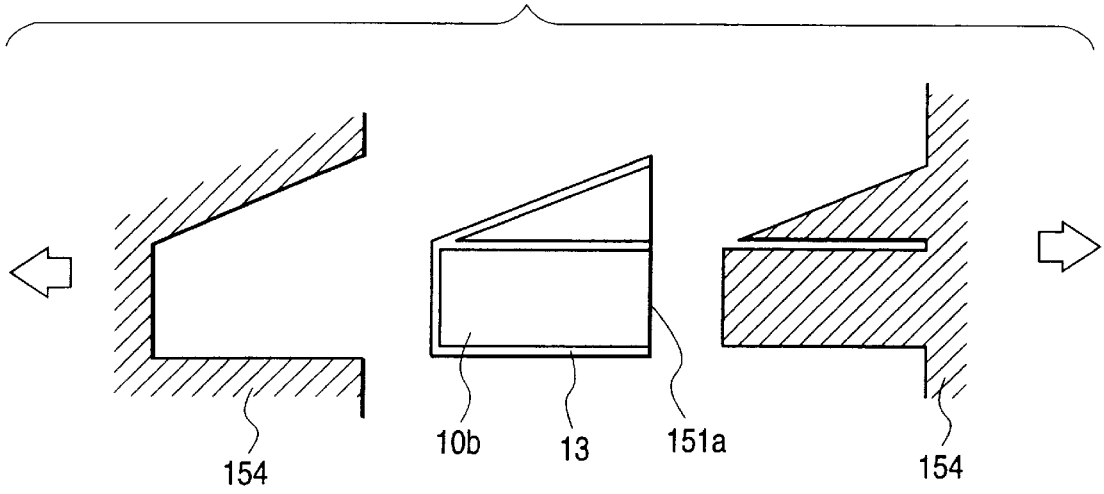
FIG. 40 is an explanatory view of a mold configuration during the molding of a conventional cleaning frame body.
Figure 41:
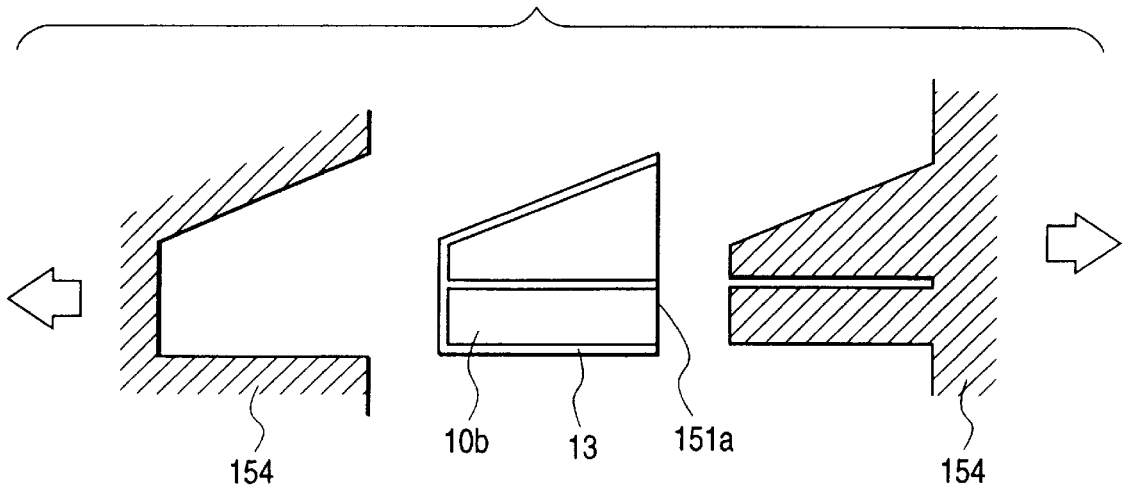
FIG. 41 is an explanatory view of a mold configuration during the molding of the conventional cleaning frame body.
Figure 42:
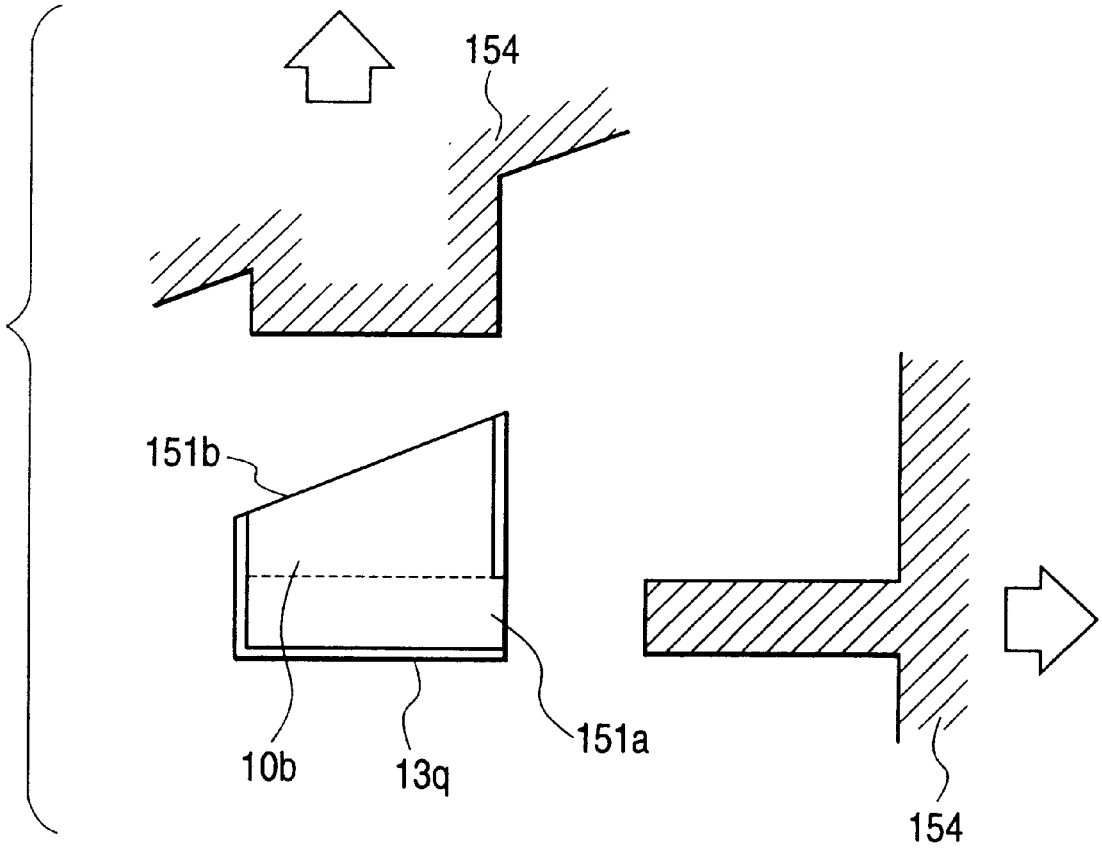
FIG. 42 is an explanatory view of the mold configuration of the embodiment during the molding of the cleaning frame body to which the present invention is applied.

Here, since the cleaning-frame body 13 is molded of resin, as shown in FIG. 40, a mold 154 for one conventional frame body is generally constituted of a pair of male and female molds. Here, by setting the opening 151*a* to be small, as shown in FIG. 41, the waste-toner reservoir 10*b* is reduced because of the constitution of the mold 154. Therefore, as shown in FIG. 42, to secure a large waste-toner reservoir 10*b* in the mold structure, an opening 151*b* is necessary for the opening 151*a* in intersecting direction. The opening 151*b* is covered with the cleaning-frame body lid 13*p*. The cleaning-frame main body 13*q* and the cleaning-frame body lid 13*p* are combined by means such as vibration welding, ultrasonic welding, adhesive, and screwing so that no toner leaks. Moreover, while the cleaning frame main body 13*q* and the cleaning-frame body lid 13*p* are combined, the cleaning-frame body 13 entirely forms a box shape. Therefore, the rigidity of the cleaning-frame body 13 is enhanced, the vibration, and the like adversely influencing the image are suppressed, and image quality can be enhanced.

Figure 43:
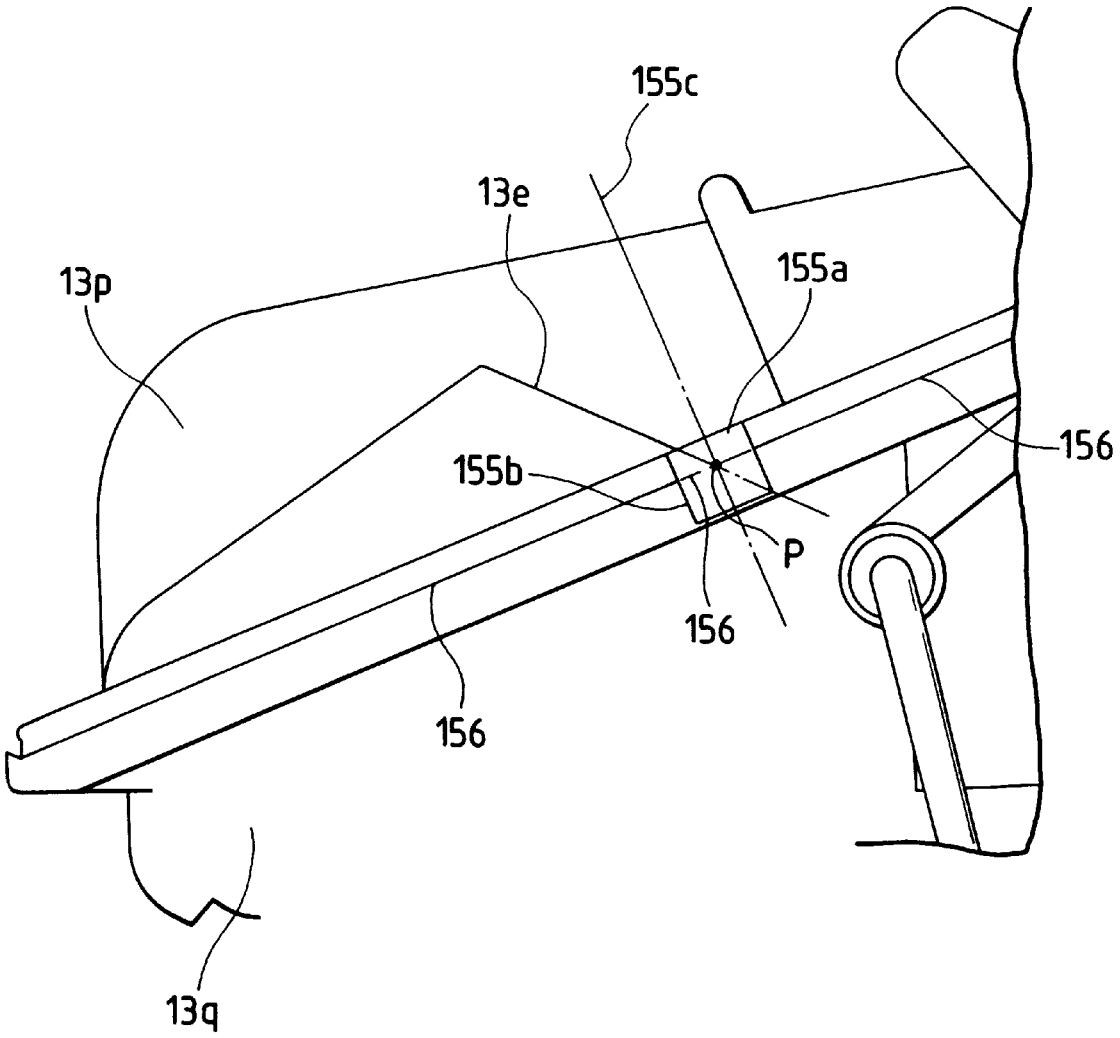
FIG. 43 is a side view showing a welding positioning section and a positioning section to the apparatus main body of the cleaning frame body according to the embodiment of the present invention.

Moreover, as shown in FIG. 43, the cleaning-frame body lid 13*p* has a regulating-abutment portion 13*e* for positioning the process cartridge B to the apparatus main body 14. In order to position/align the cleaning-frame body lid 13*p* and the cleaning-frame main body 13*q*, each of edges in the short direction on both sides in the longitudinal direction of the cleaning-frame body lid 13*p* is provided with a positioning portion 155*a* as a downward protrusion, and the positioning portion 155*a* is engaged in a notch 155*b* disposed in each of the edges on both ends of the cleaning-frame main body 13*q* in the longitudinal direction. Therefore, by a linear center 155*c* passing through a position of the positioning portion 155*a* equally divided in the short direction and being at right angles to a welding face 156 as a bonding face of the cleaning-frame body lid 13*p* and the cleaning-frame main body 13*q*, the cleaning-frame body lid 13*p* is positioned to the cleaning-frame main body 13*q*. Here, the center 155*c* of the positioning portion 155*a* of the regulating abutment portion 13*e* of the cleaning-frame body lid 13*p* to the cleaning-frame main body 13*q*, the welding face 156, and the face of the regulating-abutment portion 13*e* disposed in the cleaning-frame body lid 13*p* are disposed so as to pass through the same point P as shown in FIG. 43. Since the positioning members pass through the same point P, the positioning precision of the process cartridge B to the image-forming-apparatus main body 14 after welding the cleaning-frame-body lid 13*p* and the main body 13*q* is enhanced.

Figure 44:
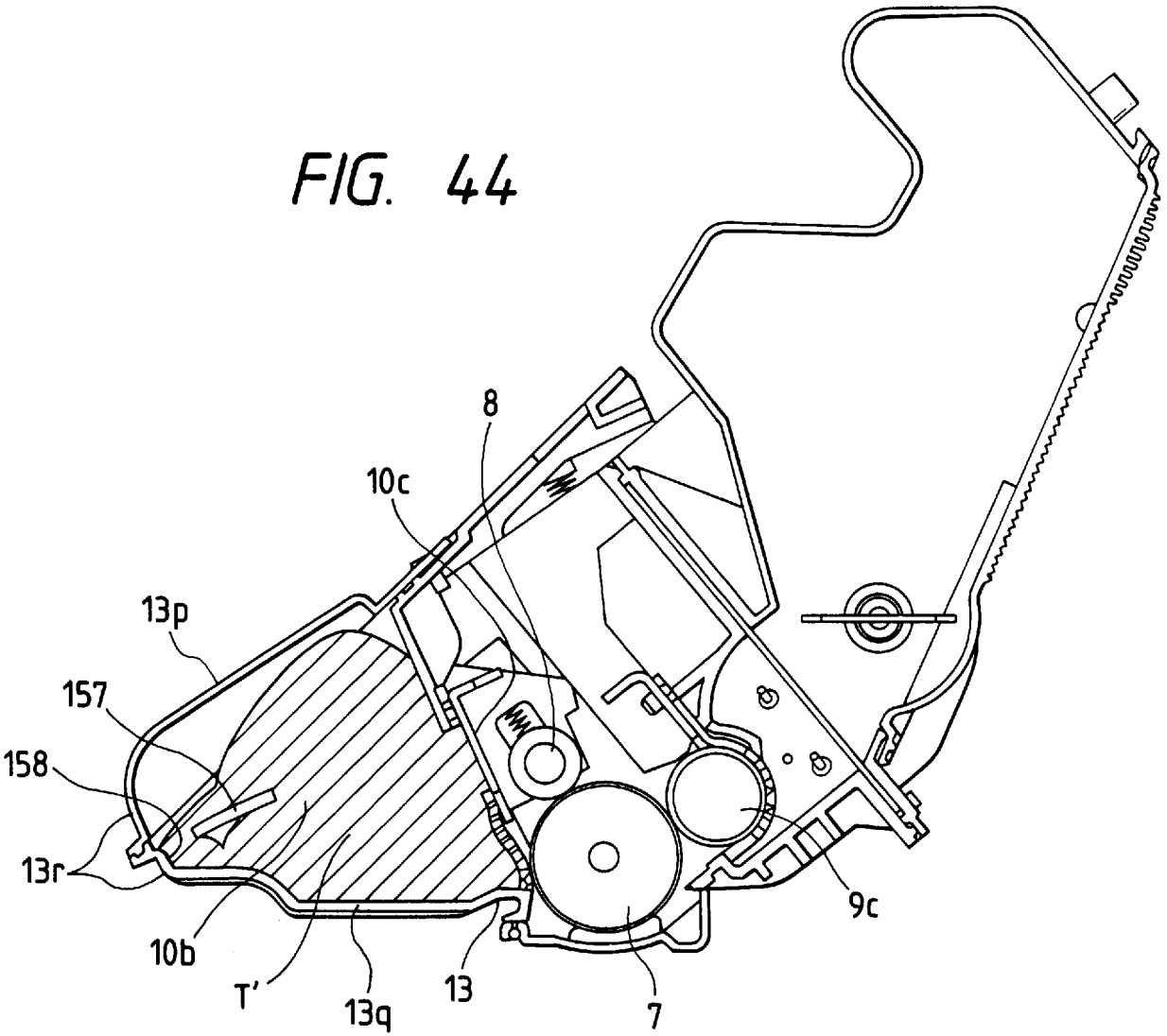
FIG. 44 is a longitudinal sectional view when waste toner is accumulated in the cleaning frame body according to the embodiment of the present invention.
Figure 45:
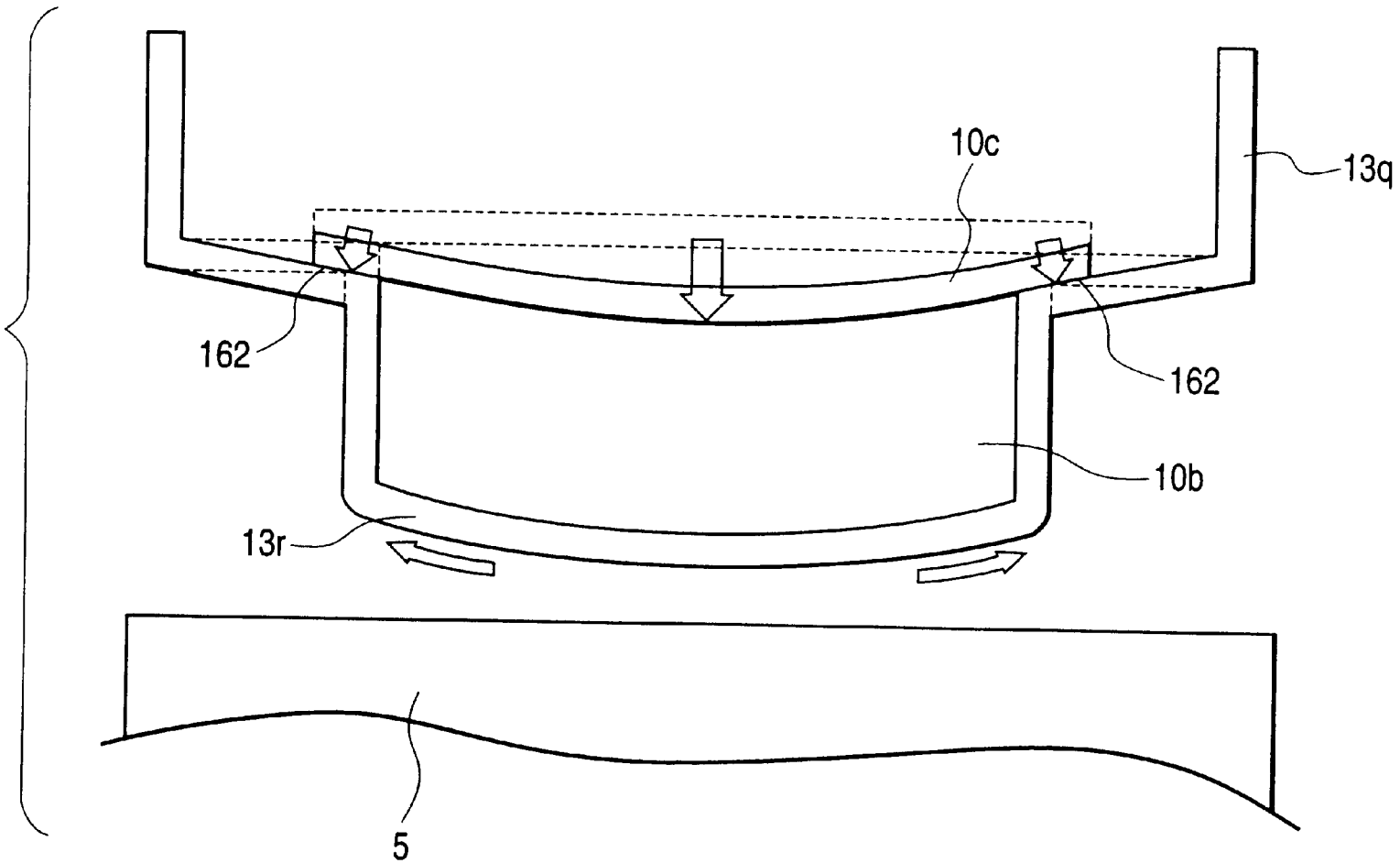
FIG. 45 is a schematic, horizontal sectional view showing that the conventional cleaning frame body and cleaning blade are subjected to heat from a fixing unit to be expanded/deformed.
Figure 46:
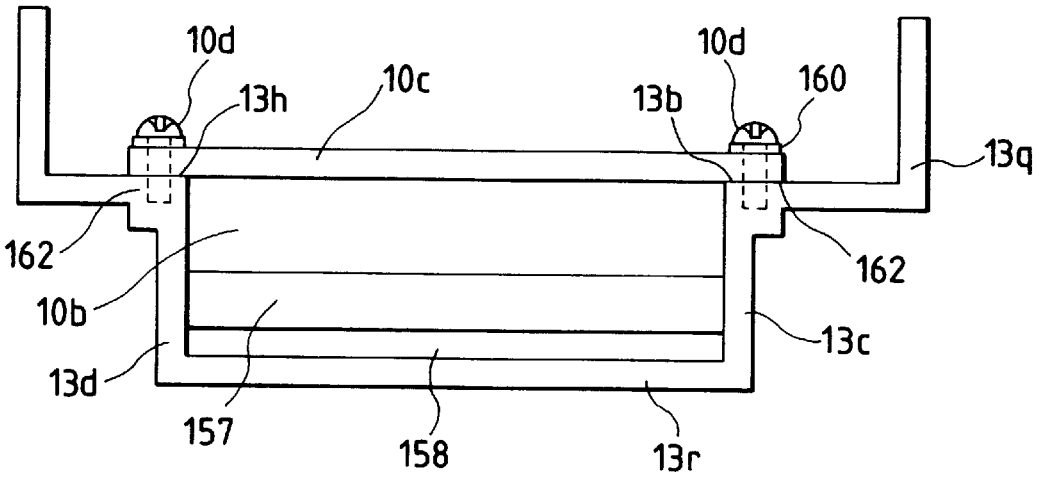
FIG. 46 is a horizontal sectional view of the cleaning frame body according to the embodiment of the present invention.

Moreover, as shown in FIG. 46, inside the cleaning-frame main body 13*q* a rib 157 is disposed as a reinforcing member of the cleaning-frame body over the entire area in the longitudinal direction. The rib 157 is disposed over the entire longitudinal area with a distance of 0.5 to 15 mm from a wall 13*r* on the tip-end side (inner side) of the cleaning-frame main body 13*q*. The distance between the wall 13*r* and the rib 157 is preferably in the range of 0.5 to 3.0 mm. By providing this gap 158, heat from a wall face is prevented from being transmitted. Furthermore, as shown in FIG. 44, even when waste toner T' is accumulated, the waste toner T' can drop to the inside via the gap 158 to be stored. The thickness of the rib 157 is in the range of 1 to 4 mm, and the width thereof is 5 to 40 mm. This minimizes deformation of the cleaning-frame body 13, particularly the deformation of attachment portions 162 of the cleaning blade 10*a* important for cleaning caused by a difference of rapidly heated and non-heated portions when there is no rib 157 and the wall 13*r* close to the fixing means 5 as a heat source of the cleaning-frame body 13 is heated to rapidly expand as shown in FIG. 45. Namely, the cleaning-frame body has a constitution durable to the deformation caused by heat.

Figure 47:
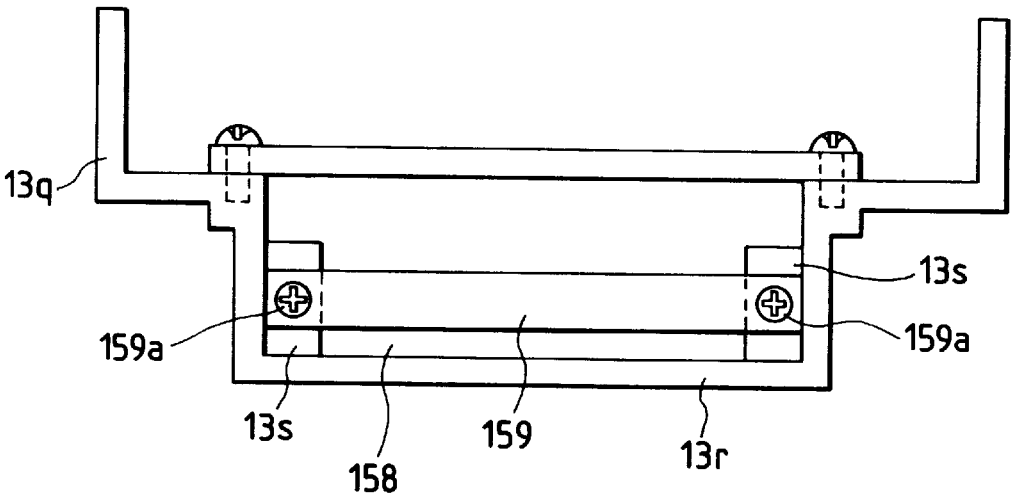
FIG. 47 is a horizontal sectional view of the cleaning frame body to which another embodiment of the present invention is applied.

As another embodiment obtained by developing the above constitution, as shown in FIG. 47, instead of the rib, a sheet metal 159 may be used so that the sheet metal is fixed to both ends 13*s* inside the cleaning-frame main body 13*q* via screws 159*a*, and the like.

Moreover, since the above-described cleaning-frame body 13 of resin and the cleaning-blade sheet metal 10*c* of metal are different in thermal expansion coefficient, as shown in FIG. 46, the cleaning blade 10*a* is engaged via resin washers 160 by screws 10*d* so that when the temperature of the cleaning unit is raised, the cleaning frame body 13 and the cleaning-blade sheet metal 10*c* can slide slightly. Additionally, the material of the washer 160 is preferably nylon, and the like.

(Ozone Exhausting Air Flow)

Figure 48:
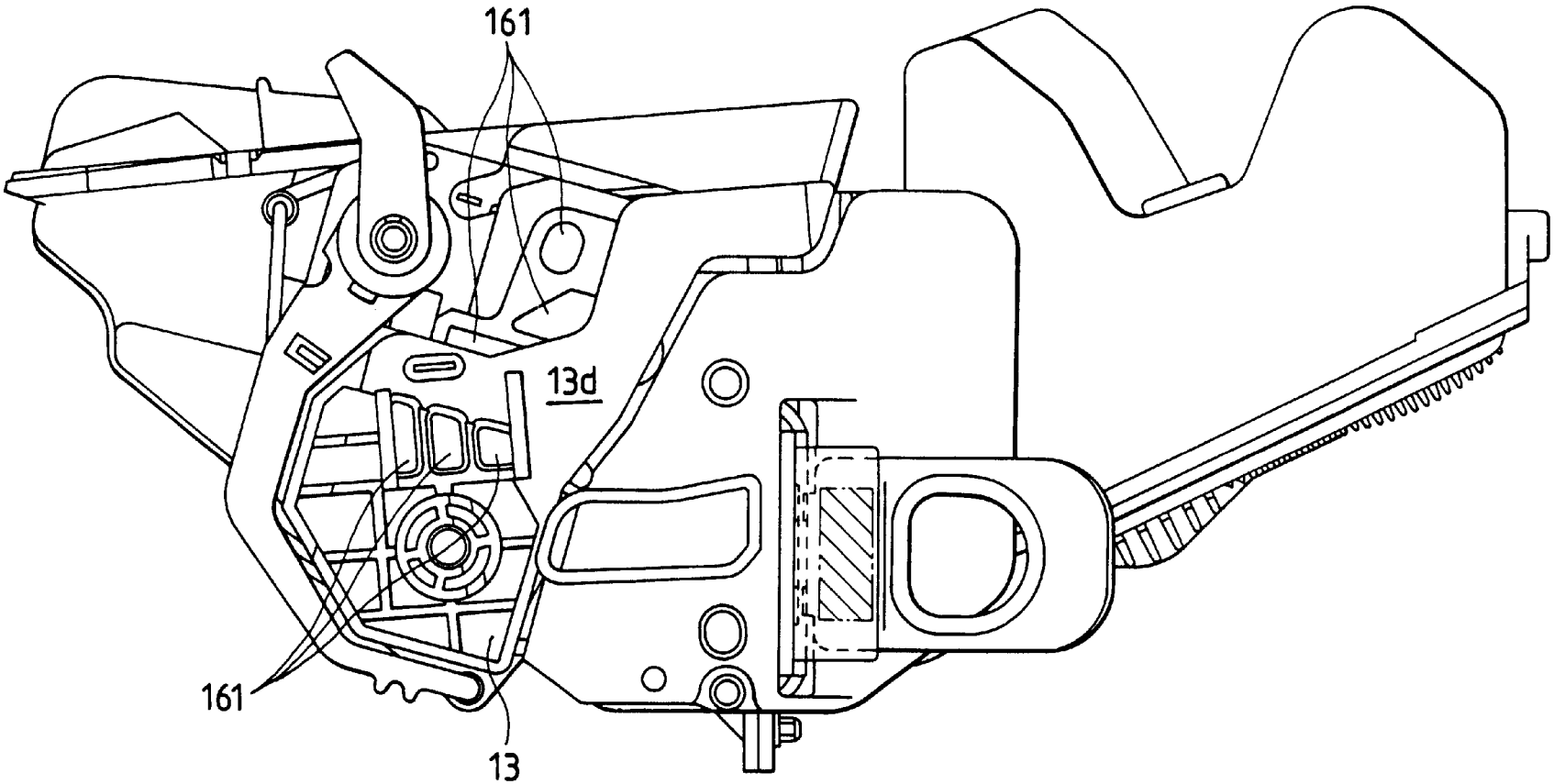
FIG. 48 is a side view of the process cartridge according to the embodiment of the present invention.
Figure 49:
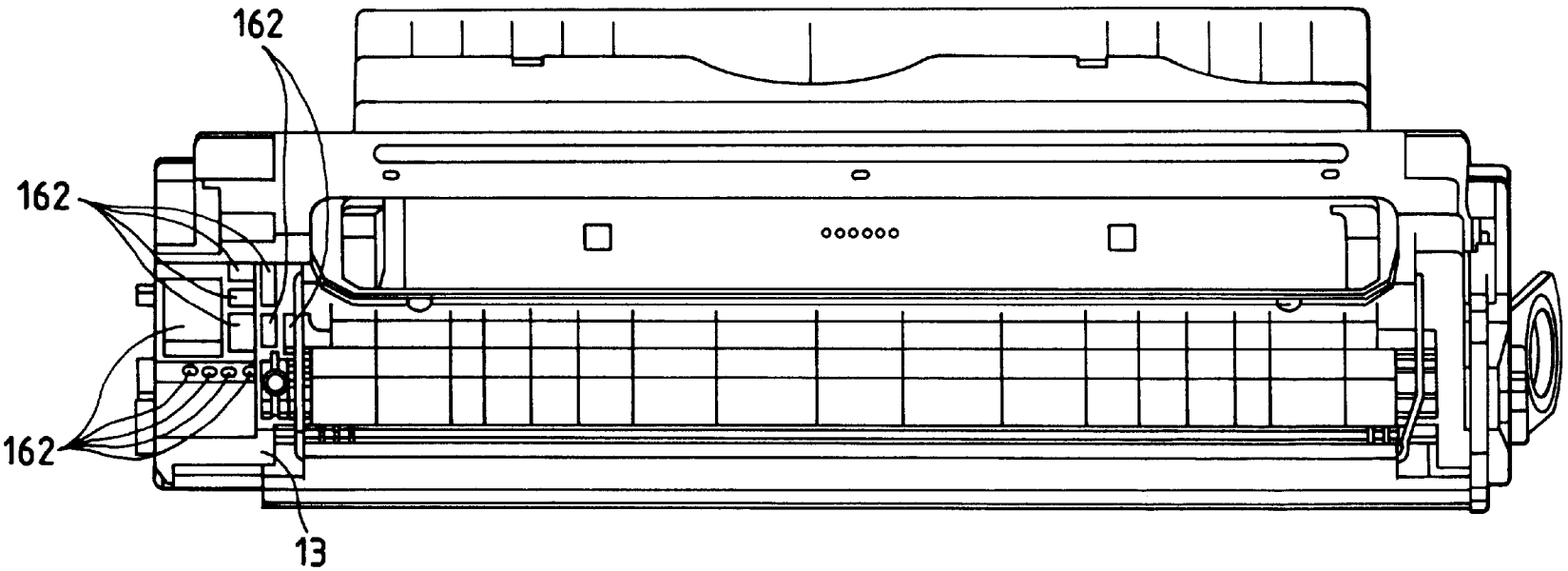
FIG. 49 is a front view of the process cartridge according to the embodiment of the present invention.

Here, air flow for exhausting ozone generated during charging as one cause of image running will be described with reference to FIGS. 48, 49. In a left-side end 13*d* of the cleaning frame body 13, a plurality of holes 161 are made in sectional positions in which the photosensitive drum 7 is in contact with the charging roller 8. Moreover, the image-forming apparatus main body 14 is also provided with holes (not shown) made opposite to the holes 161 so that external air can be introduced. Furthermore, on the side of the drive gear of the cleaning frame-body 13 facing the fixing means 5, a plurality of holes 162 are made, and a fan (not shown) is disposed opposite to the holes 162 so that the ozone around the charging roller 8 inside the cleaning frame body 13 can directly be drawn not to contact any other member.

(Charging Means)

Figure 63:
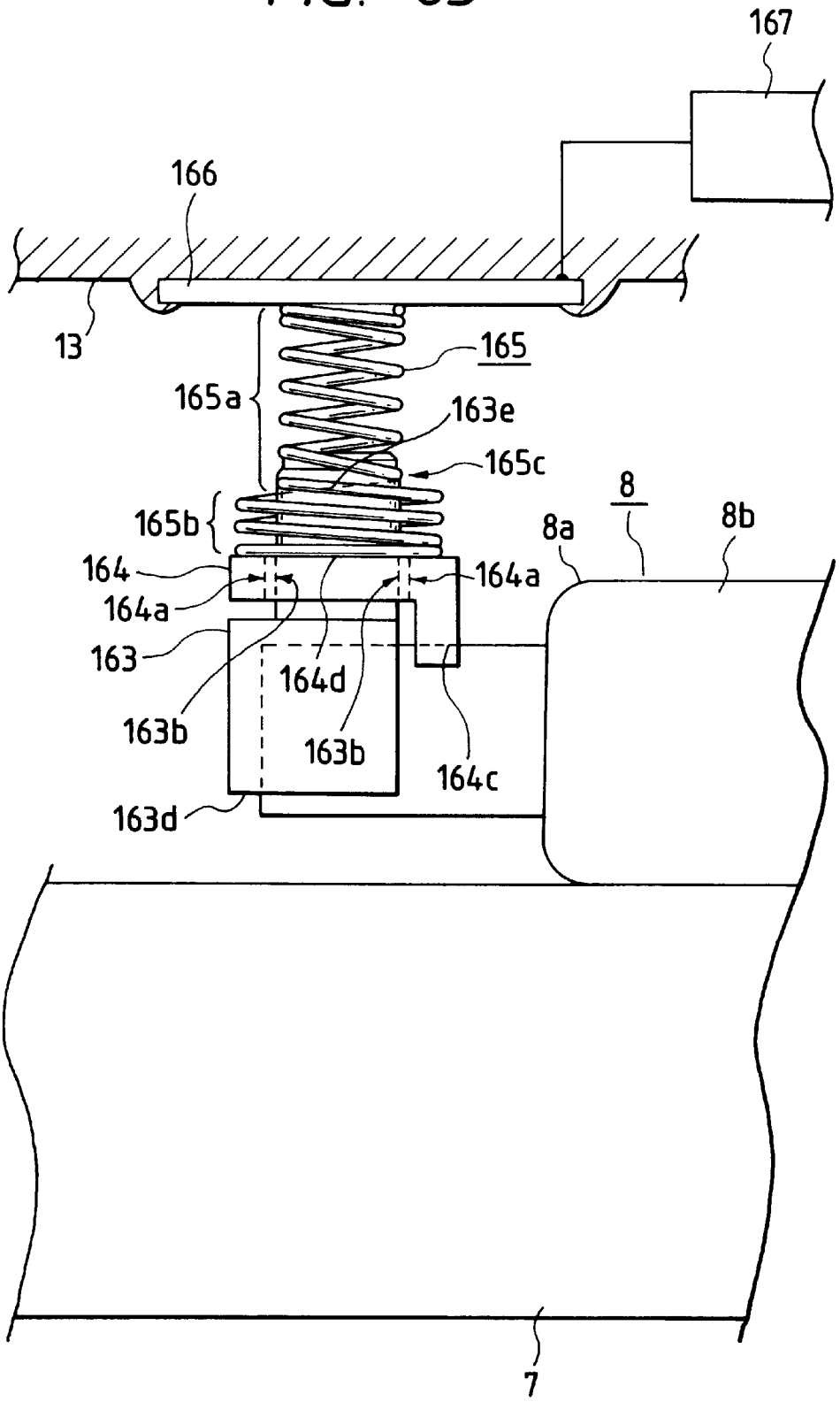
FIG. 63 is a front view showing the charging-roller bearing.

As shown in FIG. 63, for the charging roller 8, both ends of a charging roller shaft 8*a* passing through a center are supported by shaft bearings 163, which are guided via guides (not shown) of the photosensitive drum 7 in radial direction. Furthermore, since each shaft bearing 163 is pushed toward the photosensitive drum 7 by a spring 165 extended between the shaft bearing 163 and the cleaning-frame body 13, the charging roller 8 contacts the photosensitive drum 7 with a predetermined pressure. Additionally, the charging roller 8 has no positive drive means, and is rotated following the rotation of the photosensitive drum 7.

An electrode 166 is fixed to/supported by the cleaning frame body 13 by caulking or the like. When the process cartridge B is mounted in a predetermined position of the apparatus main body 14, a power supply 167 on the side of the apparatus main body 14 and the electrode 166 on the side of the process cartridge B are electrically interconnected.

Figure 50:
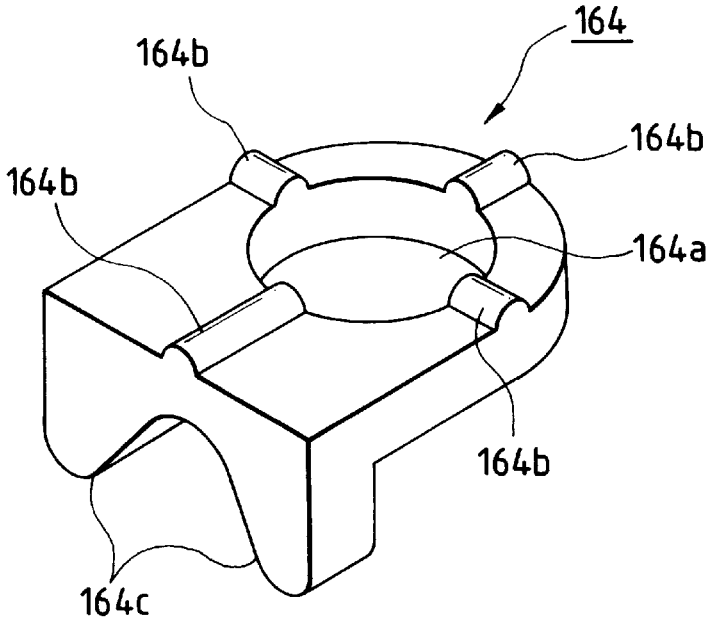
FIG. 50 is a perspective view of a charging roller bearing according to the embodiment of the present invention.
Figure 51:
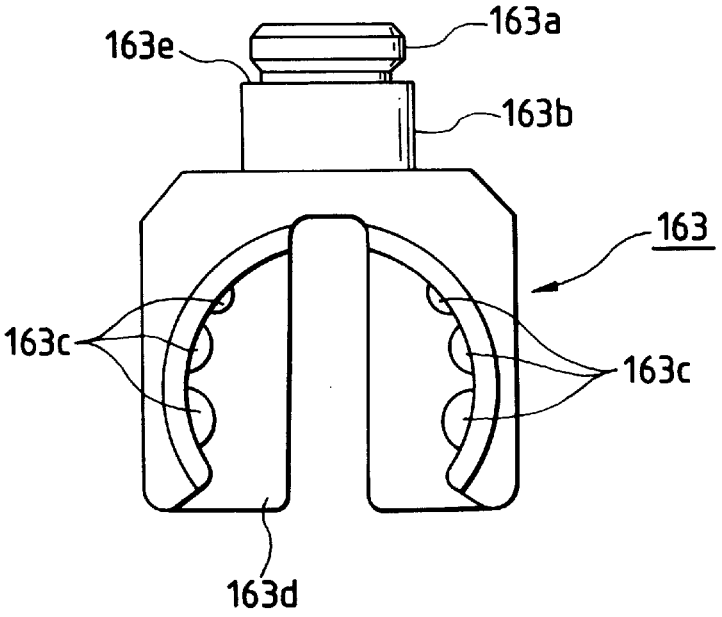
FIG. 51 is a front view of a power supply contact member of the charging roller according to the embodiment of the present invention.

Here, the constitution of the bearing 163 on the power-supply side will be described with reference to FIGS. 50, 51, and 63.

The spring 165 is formed in an integral two-step spring by a first spring 165*a* and a second spring 165*b* having a larger diameter than that of the first spring 165*a*. An end 165*c* of the first spring 165*a* of the two-step spring is engaged in a bearing boss 163*a* to press the bearing 163 by the first spring 165*a*. Here, the bearing 163 has a pressure-receiving seat face 163*e*, the end 165*c* of the first spring 165*a* has at least one or more seat windings, and the pressure of the first spring 165*a* is securely received by the pressure-receiving seat face 163*e* of the bearing 163.

Figure 9A:
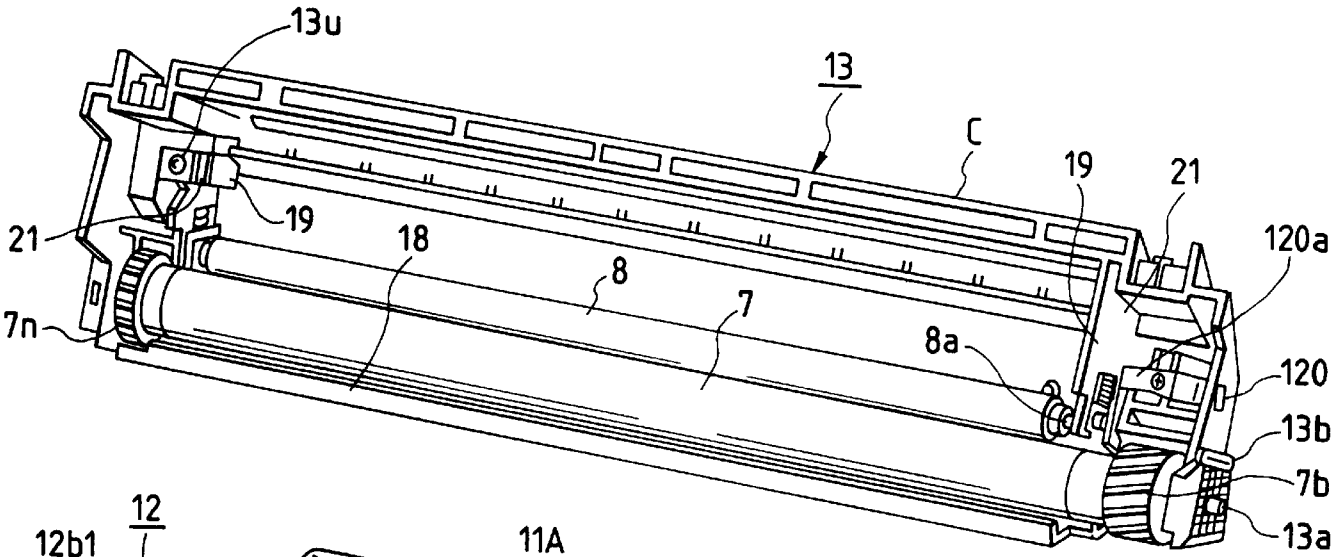
FIG. 9A is a perspective view showing the appearance of a cleaning unit of the process cartridge shown in FIG. 3.
Figure 9B:
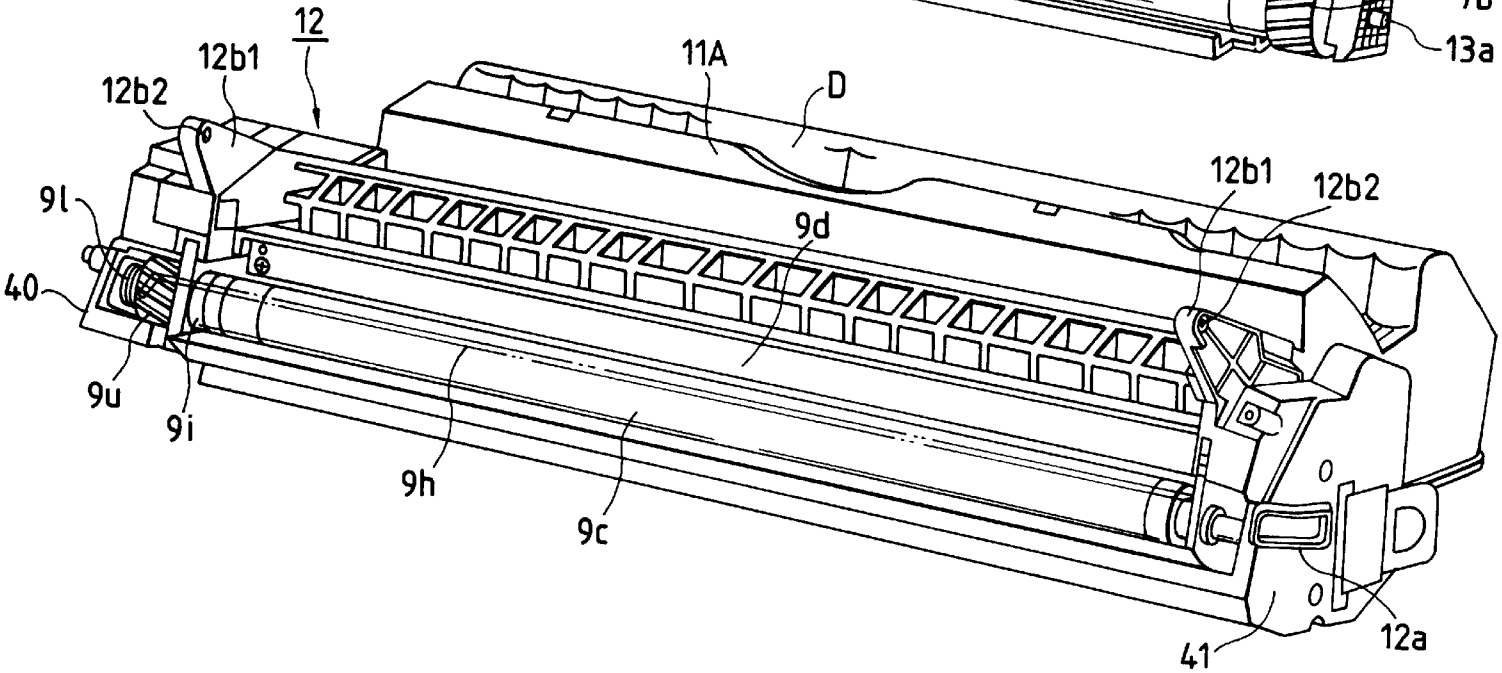
FIG. 9B is a perspective view showing the appearance of a developing unit of the process cartridge shown in FIG. 3.

The bearing 163 is movably engaged in the guide in the radial direction of the photosensitive drum 7 in a charging-member attaching portion 19 shown in FIGS. 9A and 9B.

The bearing 163 is provided with conductivity by dispersing a carbon fiber during molding. Here, in a charger, since a spring pressure of the first spring 165*a* is applied in the range of 400 gf to 1000 gf, to provide the bearing 163 with the conductivity compatible with slidability in this contact pressure, the material with the carbon fiber dispersed in a base resin having a sliding property, for example, polyacetal containing 10 to 30% of carbon fiber in terms of a weight ratio, is preferably used.

The spring 165 is also conductive. Thereby, the electrode 166 and the charging roller shaft 8*a* are electrically interconnected via the spring 165 and the bearing 163. Additionally, the inner sliding portion of the bearing 163 is provided with a plurality of protrusions 163*c* so that the carbon fiber is easily collected. Since the protrusions 163*c* slide on the charging roller shaft 8*a*, the reliability of conductivity is enhanced. The bearing 163 is also provided with a thrust stopper 163*d*, which slides on the end face of the charging roller 8.

Moreover, a hole 164*a* of a contact member 164 is engaged with a root portion 163*b* of the bearing boss 163*a* connected to the spring 165 of the bearing 163, and the hole 164*a* of the contact member 164 is formed to be larger than the root portion 163*b* of the bearing boss 163*a* so as to be slidable to the bearing 163. Furthermore, the end 165*c* of the first spring 165*a* as a transient portion between the first spring 165*a* and the second spring 165*b* is fixed to the bearing boss 163*a*, and the contact member 164 is pressed to the bearing 163 by the second spring 165*b*. The pressed portion of the contact member 164 by the second spring 165*b* is provided with a plurality of protrusions 164*b* so that carbon fiber is easily collected. Since the protrusions 164*b* are in contact with the second spring 165*b*, the reliability of conductivity is enhanced. Moreover, since the contact member 164 is merely a contact member different from the bearing 163 for supporting the shaft, it is not necessary to apply an unnecessary pressure. In the embodiment, the second spring 165*b* of the conductive material having a low pressure of 50 gf to 200 gf is combined with the contact member 164. For example, the material of the contact member 164 preferably contains 30 to 40% by weight of carbon fiber in the base range of polyphenyl sulfide, which is a large amount of carbon fiber in terms of the weight ratio. Additionally, the bearing 163 and the contact member 164 are managed with an electrical resistance value of 5 kΩ.

Contact portions 164*c* of the charging roller shaft 8*a* and the contact member 164 ride over the charging roller shaft 8*a*, and are disposed in two places on one side of the central axis of the spring 165. The position of the bearing 163 is regulated by the longitudinal position of the cleaning blade 10*a* in many cases, but the constitution used as shown in FIG. 63 can be used in different types of process cartridges. By using the same component in various machine types, there is the advantage that cost can be reduced by mass production. Moreover, an end 164*d* of the second spring 165*b* abutting on the contact member 164 has one or more seat windings in order to produce no pressure difference by the position of a spring winding end portion, because the contact portions 164*c* are disposed in two places on one side of the central axis of the spring 165.

In the above-described constitution of the contact member 164, for the power supply path to the charging roller 8 from the power supply 167, there are two paths: a first power supply path via the base end of the electrode 166, the conductive spring 165, and the conductive bearing 163; and a second power supply path via the contact member 164 from the conductive spring 165.

(Connection of Cleaning Unit and Developing Unit)

The connecting constitution of the cleaning frame body 13, as the first frame body for supporting the photosensitive drum, and the developing frame body 12, as the second frame body for supporting the developing roller 9*c*, will be described in detail with reference to FIGS. 64A and 64B.

Additionally, the developing frame body 12 is a type of a toner developing frame body integrally combined with the toner frame body 11.

Figures 64A, 64B:
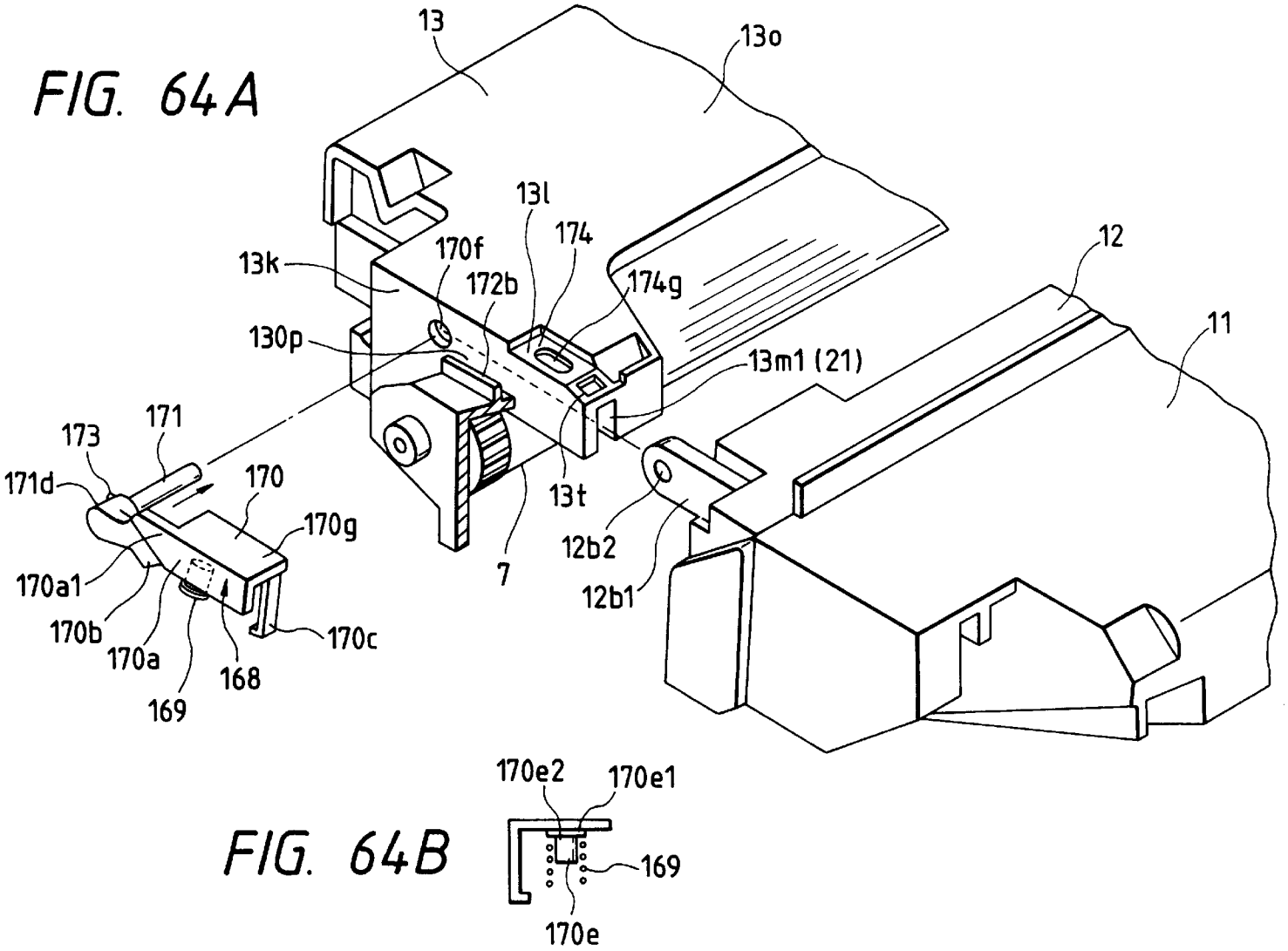
FIG. 64A is an exploded perspective view showing the developing-roller unit and the cleaning unit to be assembled.
FIG. 64B is a side sectional view of a pressure-spring portion.

As shown in FIGS. 64A and 64B, a frame-body connecting member 168 is provided with a shaft portion 171 for rotatably connecting a compression-coil spring 169 for pressing the developing roller 9*c* against the photosensitive drum 7, a spring support portion 170*e* for supporting the compression-coil spring 169, a fixing member 170, the developing frame body 12, and the cleaning-frame body 13; a second shaft portion 171*d* engaged in a hole 170*f* of a side face 13*k* of the cleaning-frame body 13 for supporting the shaft portion 171 and supporting each of both ends of the developing frame body 12 in the longitudinal direction; an inverse click 170*c*; and a dislocation-preventive portion 170*b* disposed on the fixing member 170 for preventing dislocation of the frame-body connecting member 168.

The shape of the frame-body connecting member 168 will be described. The frame-body connecting member 168 is formed by integrally molding the shaft portion 171 of metal with the fixing member 170. In the fixing imember 170, as shown in FIG. 64A, a plate-like side portion 170*a* having a vertical direction in an attached state is close to and parallel with the vertical side face 13*k* on each of both sides of the cleaning-frame body 13 in the longitudinal direction. An upper portion 170*g* bent inwardly from the plate-like side portion 170*a* in the longitudinal direction is substantially a horizontal plate, and a vertical sectional face taken along the longitudinal direction of the upper portion 170*g* and the side portion 170*a* substantially has an L shape. The upper portion 170*g* is configured merely to engage with a recess seat 131 disposed in a corner on the upstream side as seen from the inserting direction of the process cartridge B on each of both sides of an upper face 13*o* of the cleaning-frame body 13. In an assembled state to the cartridge-frame body, the side portion 170*a* of the fixing member 170 has an extended portion 170*a*1 extended in the inserting direction of the process cartridge B, and the extended portion 170*a*1 is provided with the second shaft portion 171*d*, which is longitudinal toward the inside of the cleaning-frame body 13 and round. The lower edge of the extended portion 170*a*1 is provided with the dislocation-preventive portion 170*b*. The dislocation-preventive portion 170*b* is offset outwardly slightly from the side portion 170*a*. The dislocation-preventive portion 170*b* is engaged in a dislocation-preventive groove 130*p* formed downward between the side face 13*k* of the cleaning-frame body 13 and the upper face of a rib 172*b* to prevent the fixing member 170 from being dislocated in the longitudinal direction and to position the fixing member.

Further to securely prevent the fixing member 170 from being dislocated, the second shaft portion 171*d* is provided with a dislocation-preventive boss 173 as a small protrusion. During assembling, after the boss is press-inserted and set, it is engaged in the hole 170*f* in the side face 13*k* of the cleaning frame body 13 in an immobile state. When the upper portion 170*g* of the fixing member 170 is engaged in each of the left and right recess seats 131 on the cleaning frame body 13, the inverse click 170*c* of the fixing member 170 of the frame-body connecting member 168 is caught by the edge of a square hole 13*t* in the end of the recess seat 131.

As shown in FIG. 64B, a spring support portion 170*e* for engaging with the compression-coil spring 169 is protruded from the underside of the upper portion 170*g* of the fixing member 170 of the frame-body connecting member 168. The spring support portion 170*e* is a stepped joggle provided with a large-diameter portion 170*e*1 whose end face serves as a spring seat and a small-diameter portion 170*e*2 to which the inner diameter of the compression-coil spring 169 is press-inserted. The axial line of the spring support portion 170*e* coincides with the center line of the compression-coil spring 169 press-inserted to the small-diameter portion 170*e*2. When the compression-coil spring 169 is press-inserted in the assembled state, the center line is orthogonal to the upper face of an arm portion 12*b*1 of the developing frame-body 12. The hole 170*f* has a center on the plane orthogonal to the longitudinal direction. Moreover, the spring support portion 170*e* is positioned midway between the inverse click 170*c* and the shaft portion 171.

The shaft portion 171 is positioned in the center of the second shaft portion 171*d* which has a center in the longitudinal direction and has a cylindrical shape.

While the frame-body connecting member 168 assembled as described above connects the process cartridge B to the apparatus main body 14, the shaft portion 171 is horizontal in the longitudinal direction, the compression-coil spring 169 is vertical, and the shaft portion 171 and the compression-coil spring 169 are offset to cross each other.

As shown in FIG. 9A, both end portions of the cleaning-frame body 13 in the longitudinal direction are provided with recess portions 21, which are engaged with the arm portions 12*b*1 disposed on both end portions of the developing frame-body 12 in the longitudinal direction and protruded toward the cleaning frame body 13. The outer through hole 170*f* to which the second shaft portion 171*d* of the frame body connecting member 168 is inserted is formed toward the recess portion 21 in the side face 13*k* of the cleaning frame body 13, and a hole 174*g* for passing through the compression-coil spring 169 is formed in a first bottom face 174 of the recess seat 131. While the arm portion 12*b*1 is inserted into the recess portion 21, the hole 174*g* is positioned right above the middle portion of the arm portion 12*b*1.

When the arm portion 12*b*1 of the developing-frame body 12 is inserted to the recess portion 21 of the cleaning-frame body 13 to abut on the bottom of the recess portion 21, a hole 12*b*2 formed in the center of the semicircular tip end of the arm portion 12*b*1 is positioned slightly beyond a position where it coincides with an inner through hole 13*u*, and these holes 12*b*2, 13*u* (see FIGS. 9A and 9B) substantially coincide with each other.

As described above, the inverse click 170*c* vertically extended downward from the end of the upper portion 170*g* is disposed on the end position opposite to the position in which the shaft portion 171 of the frame-body connecting member 168 is disposed, and the square hole 13*t* to which the inverse click 170*c* is to be snap-fitted is disposed in the recess seat 131 of the cleaning-frame body 13.

The assembly method comprises the steps of setting upward the fixing member 170 in the same manner as described above, inserting the shaft portion 171 into the inner through hole 13*u*, additionally inserting the second shaft portion 171*d* into the outer through hole 171*f*, and finally pushing the upper portion 170*g* into the recess seat 131 centering on the shaft portion 171 and the second shaft portion 171*d*. Then, when the inverse click 170*c* enters the square hole 13*t*, its tip end is deflected apart from the shaft portion 171 at the edge of the square hole 13*t*. After the inverse click 170*c* completely enters the square hole 13*t*, the deflection is recovered, and the inverse click 170*c* is engaged with the edge of the square hole 13*t*.

(Constitution of Guide Means of Process Cartridge B)

The guide means by which the process cartridge B is attached to/detached from the apparatus main body will next be described. The guide means is shown in FIGS. 5 to 8 and FIGS. 9A and 9B. Additionally, FIG. 5 is a right-side view as seen in a direction (arrow X) in which the process cartridge B is attached to the apparatus main body 14 (as seen from the side of the developing unit D). FIG. 6 is a left-side view.

Additionally, on both outer faces of a housing 100 (11, 12, 13, 40, 41) as the above-described cartridge frame body, as shown in FIGS. 5 and 6, the guide means, which serve as guides when the process cartridge B is attached to/detached from the apparatus main body 14, are disposed. The guide means is constituted of a cylindrical guide 13*a* as a first guide member, a longitudinal guide 12*a* as a second guide member, and a short guide 13*b* as a third guide member.

The cylindrical guide 13*a* is a cylindrical member disposed on the side face of the cleaning-frame body 13 and protruded outward coaxially with the axial line of the photosensitive drum 7. Then, the cylindrical member supports the drum shaft 7*a* for supporting the photosensitive drum 7 so that the shaft is prevented from rotating. Moreover, the longitudinal guide 12*a* is disposed on the side face of the developing-frame body 12 to ride over the side faces of both the developing-frame body 12 and the cleaning-frame body 13. Furthermore, the short guide 13*b* is disposed above the cylindrical guide 13*a* on the side face of the cleaning frame body 13. Specifically, the longitudinal guide 12*a* is integrally molded with developing holders 40, 41 fixed to the developing-frame body 12 and described later (see FIG. 23). Moreover, the cylindrical guide 13*a* and the short guide 13*b* are integrally molded with the cleaning-frame body 13.

The longitudinal guide 12*a* is extended in the inserting direction of the process cartridge B (direction of arrow X), and its inclination is set so that the inserting angle of the guide becomes substantially the same as that of the process cartridge B. The cylindrical guide 13*a* is disposed along the line extended from the longitudinal guide 12*a* extended in the inserting direction of the process cartridge B. Moreover, the short guide 13*b* is disposed substantially parallel with the longitudinal guide 12*a*. Additionally, as shown in FIG. 6, the cylindrical guide 13*a*, the longitudinal guide 12*a* as the second guide member, and the short guide 13*b* as the third guide member are disposed in the same shapes and positions also on the side face opposite to the side face shown in FIG. 5. Moreover, these three guides are protruded/formed at the same height from the outer plane of the cleaning-frame body 13 and the developing-frame body 12.

Detailed description will follow.

The cylindrical guide 13*a* as the first guide member is disposed on one end (right end 13*c*) C1 and the other end (left end 13*d*) C2 of the cleaning unit C. Here, the one end Cl corresponds to the right end 13*c* of the cleaning frame body 13 disposed on the right end of the axial direction of the photosensitive drum 7 when the process cartridge B is viewed from the developing unit D (when the process cartridge B is viewed from the attaching direction). Moreover, the other end C2 corresponds to the left end 13*d* of the cleaning-frame body 13 disposed on the left end of the axial direction of the photosensitive drum 7. The cylindrical guides 13*a* are cylindrical members protruded outward from both ends 13*c*, 13*d* of the cleaning-frame body 13 along the same axis in the axial direction of the photosensitive drum 7. Additionally, the drum shaft 7*a* of metal is supported in the cylindrical guide 13*a*. Therefore, the cylindrical guide 13*a* is disposed to surround the drum shaft 7*a*. The drum shaft 7*a* is guided by a guide portion 16*a* of the apparatus main body 14 described later via the cylindrical guide 13*a*, and positioned by a groove 16*a*5 (see FIGS. 10 to 17).

The longitudinal guide 12*a* as the second guide member is disposed on one end (right end 12*c*) D1 and the other end (left end 12*d*) D2 of the developing unit D. Here, one end D1 is a part of the developing-frame body 12 disposed on the right end with respect to the axial direction of the photosensitive drum 7. Moreover, the other end D2 is a part of the developing-frame body 12 disposed on the left end with respect to the axial direction of the photosensitive drum 7. The longitudinal guide 12*a* is apart from the cylindrical guide 13*a*, and disposed on the upstream side of the cylindrical guide 13*a* with respect to the process-cartridge attaching direction (direction of arrow X). Specifically, the longitudinal guide 12*a* is disposed in an area L surrounded by lower and upper virtual lines 111, 112 (see FIG. 5) extended toward the upstream side with respect to the attaching direction from the outer peripheral face of the cylindrical guide 13*a*. Additionally, for the longitudinal guide 12*a*, a tip end 12*a*1 of the attaching direction is extended slightly (by about 1 mm to 3 mm) toward the cleaning-frame body 13.

The short guide 13*b* as the third guide member is disposed on the right and left ends 13*c*, 13*d* of the cleaning unit C. The short guide 13*b* is disposed above the cylindrical guide 13*a*. Specifically, when the process cartridge B is viewed with respect to the attaching direction, the short guide 13*b* is disposed substantially right above the cylindrical guide 13*a*. Specifically, the short guide 13*b* is disposed in an area 15 surrounded by straight lines 113, 114, which are drawn substantially orthogonal to the process-cartridge attaching direction (direction of arrow X) to abut on the outer peripheral face of the cylindrical guide 13*a*. Moreover, the short guide 13*b* is disposed substantially parallel with the longitudinal guide 12*a*.

For each of the above-described guide members, an example of size will be described.

Additionally, an allowable range indicates the range employed in the process cartridge B for use in the embodiment, and will indicate the same hereinafter.

The cylindrical guide 13*a* has an outer diameter of about 10.0 mm on the drive side (allowable range of 7.5 mm to 10.0 mm) and 17.0 mm on the non-drive side (allowable range of 14.5 mm to 17.0 mm); the longitudinal guide 12*a* has a length of about 36.0 mm (allowable range of 15.0 mm to 41.0 mm) and a width of about 8.0 mm on the drive side (allowable range of 1.5 mm to 10.0 mm) and about 15.0 mm on the non-drive side (allowable range of 1.5 mm to 17.0 mm); and the short guide 13*b* has a length of about 10.0 mm (allowable range of 3.0 mm to 17.0 mm) and a width of about 4.0 mm (allowable range of 1.5 mm to 7.0 mm). Furthermore, the interval between the outer peripheral face of the cylindrical guide 13*a* and the tip end 12*a*1 of the longitudinal guide 12*a* in the attaching direction is about 9.0 mm on the drive side and about 5 mm on the non-drive side; and the interval between the outer peripheral face of the cylindrical guide 13*a* and a lower end 13*b*1 of the short guide 13*b* is about 35.5 mm on the drive side (allowable range of 33.5 mm to 37.5 mm) and about 19 mm on the non-drive side (allowable range of 17 mm to 21 mm).

The regulating-abutment portion 13*e* and a release-abutment portion 13*f* disposed on an upper face 13*i* of the cleaning unit C will next be described. Here, the upper face is a face positioned upward when the process cartridge B is attached to the apparatus main body 14.

In the embodiment, on the upper face 13*i* of the cleaning unit C, the regulating-abutment portion 13*e* and the release-abutment portion 13*f* are disposed on each of the right and left ends 13*c* and 13*d* in the direction orthogonal to the process-cartridge attaching direction. When the process cartridge B is attached to the apparatus main body 14, the regulating-abutment portion 13*e* regulates the position relating to the posture of the process cartridge B. Specifically, when the process cartridge B is attached to the apparatus main body 14, the regulating-abutment portion 13*e* abuts on a fixed member 25 (FIGS. 10 to 17) disposed on the apparatus main body 14, thereby regulating the position of the process cartridge B. Moreover, the release-abutment portion 13*f* functions when the process cartridge B is removed from the apparatus main body 14. Specifically, when the process cartridge B is removed from the apparatus main body 14, the portion abuts on the fixed member 25, so that the process cartridge B is smoothly removed by action of a moment. The process of attaching/detaching the process cartridge B will be described later with reference to FIGS. 10 to 17.

Specifically, in the embodiment, on the upper face 13*i* of the cleaning unit C, a recess portion 13*g* is disposed on each of both ends of the direction orthogonal to the process-cartridge attaching direction. The recess portion 13*g* is provided with a first slope 13*g*1 inclined upward from the tip end of the attaching direction (direction of arrow X), a second slope 13*g*3 lowered from an upper end 13*g*2 of the slope 13*g*1, and a fourth slope 13*g*5 lowered from a lower end 13*g*4 of the slope 13*g*3 as viewed from the direction of arrow X. Additionally, an upper end 13*g*6 of the slope 13*g*5 is provided with a wall (slope) 13*g*7. Here, the second slope 13*g*3 corresponds to the regulating-abutment portion 13*e*, and the wall 13*g*7 corresponds to the release-abutment portion 13*f*.

An example of each size will be described.

First, the regulating-abutment portion 13*e* has an inclination angle of 0° with respect to a horizontal line x (FIG. 5) of the process cartridge B attached to the apparatus main body 14, and a length of about 6.0 mm (allowable range of 4.5 mm to 8.0 mm). Moreover, the release-abutment portion 13*f* has an inclination angle θ1 of about 45° with respect to the horizontal line x, and a length of about 10.0 mm (allowable range of 8.5 mm to 15.0 mm).

(Process of Attaching/Detaching Process Cartridge)

The process of attaching/detaching the process cartridge B to/from the apparatus main body 14 will next be described with reference to FIGS. 10 to 18 and FIGS. 19A and 19B.

The process cartridge B constituted as described is detachably attachable with respect to cartridge-attaching means disposed on the apparatus main body 14.

Figure 17:
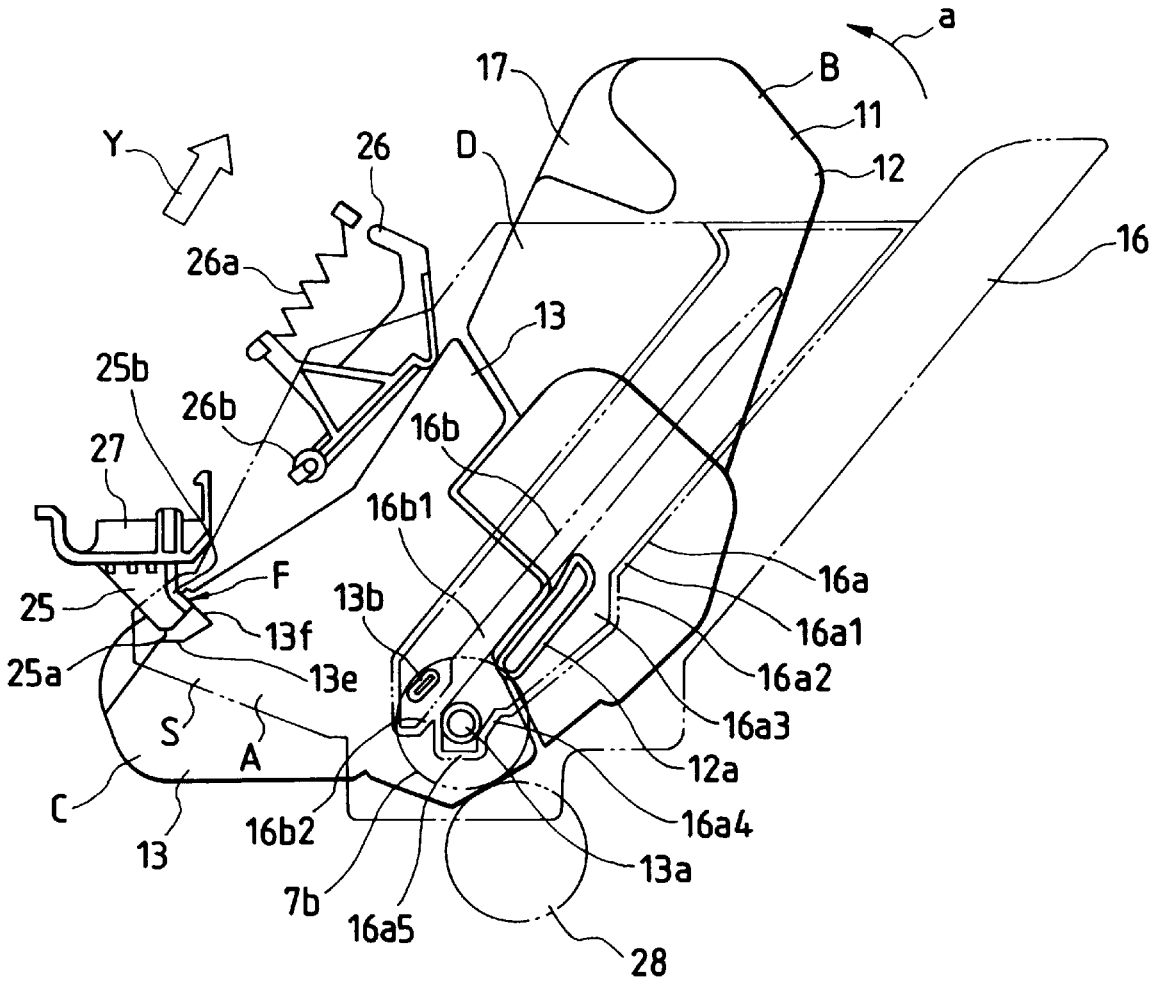
FIG. 17 is a side view showing the attaching/detaching process of the process cartridge shown in FIG. 3 to the apparatus main body.
Figure 18:
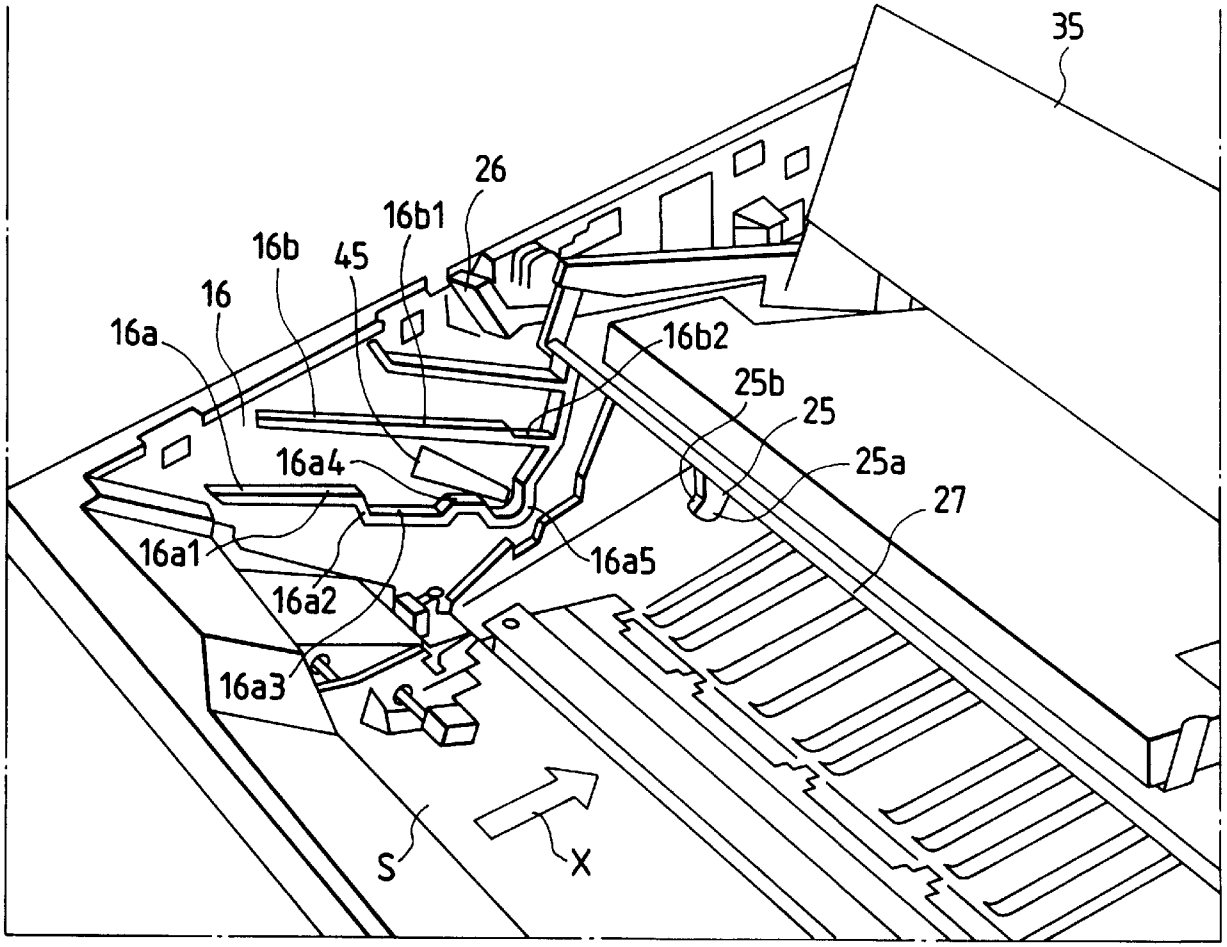
FIG. 18 is a perspective view showing the inside of the apparatus main body.
Figure 19A:
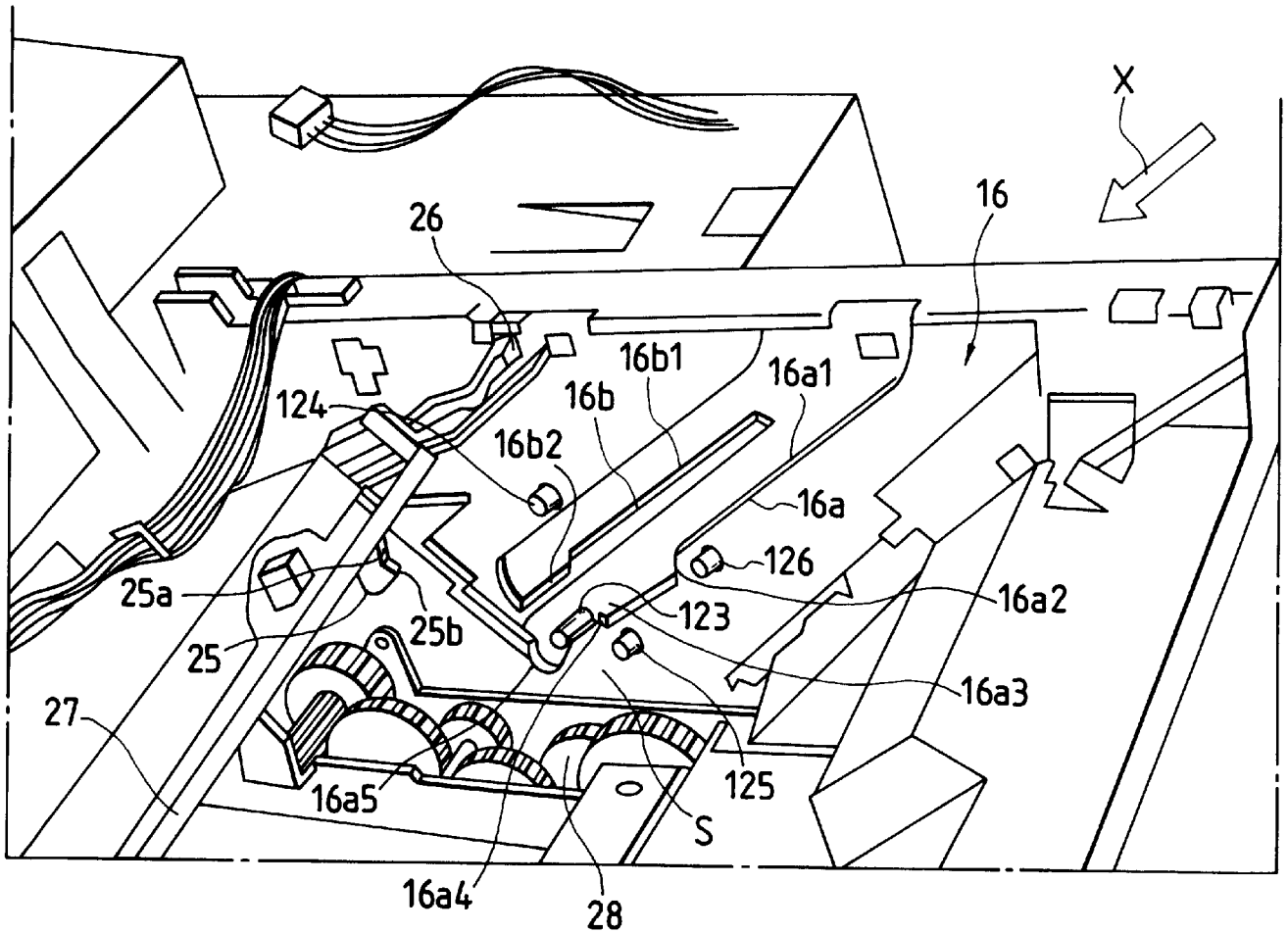
FIG. 19A is a perspective view of the inside of the apparatus main body.
Figure 19B:
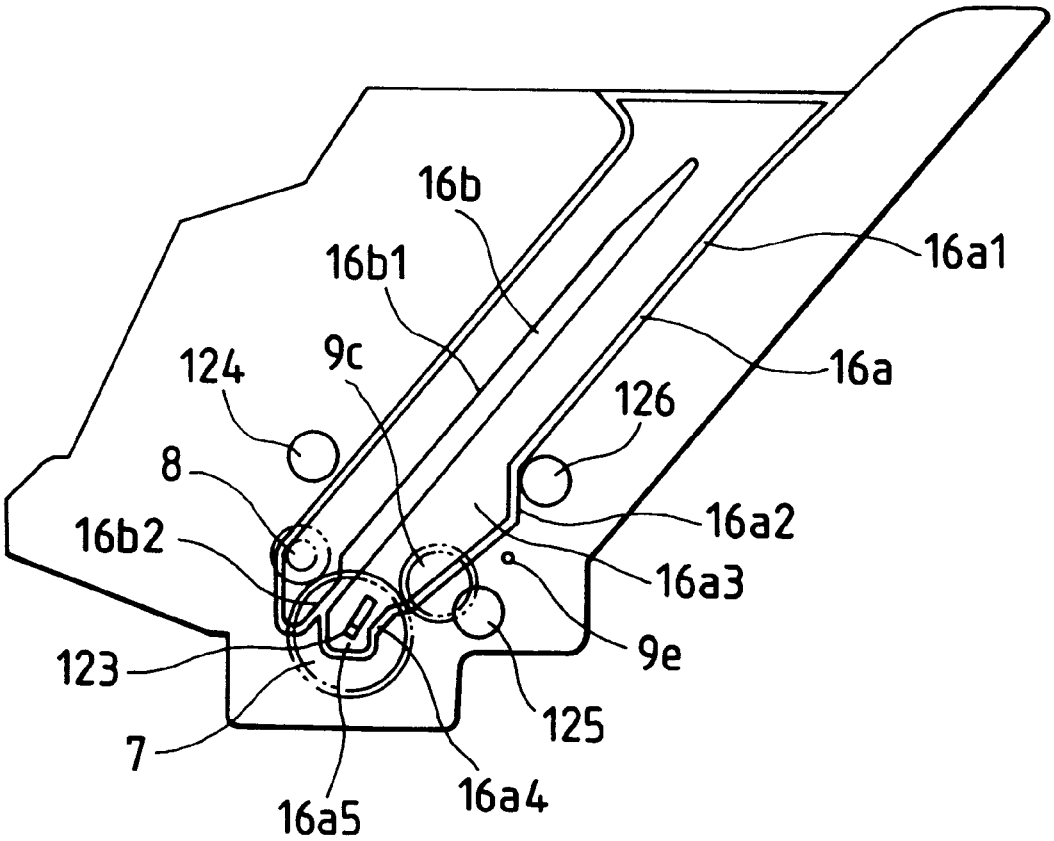
FIG. 19B is a side view of the inside of the apparatus main body.

When an operator rotates and opens an opening/closing member 35 centering on a support point 35*a* in FIG. 1, as shown in FIGS. 18, 19A and 19B, a cartridge-attachment space S is disposed, and cartridge-attaching guide members 16 are attached to left and right inner side faces of the apparatus main body 14. Each of the left and right cartridge-attaching guide members 16 is provided with two members for guiding the guide of the process cartridge B: a first guide portion 16*a*; and a second guide portion 16*b* disposed opposite to the first guide portion. By inserting the process cartridge B along the guide portions 16*a*, 16*b*, and closing the opening/closing member 35, the attaching of the process cartridge B to the image forming apparatus A is completed. Additionally, as shown in FIGS. 10 to 17, the process cartridge B is attached to/detached from the apparatus main body 14 from the direction substantially intersecting the axial line of the photosensitive drum 7. Specifically, the cartridge is attached/detached from the direction substantially orthogonal to the axial line. Then, the cartridge is attached with the cleaning unit C in the front and the developing unit D in the back.

Moreover, a recess portion (see FIG. 3) as a handle portion 17 is disposed in the longitudinal direction of the process cartridge B so that the operator can easily hold the process cartridge B during the attaching/detaching. In this case, the operator grasps the handle portion 17 with both hands to perform the attaching/detaching of the process cartridge B.

(Drum Shutter)

Furthermore, the process cartridge B is provided with the drum shutter member 18 (see FIG. 3) to open/close the transfer opening 13*n* during the attaching/detaching operation. When the process cartridge B is removed from the laser beam printer A, the shutter member 18 closes to protect the transfer area of the photosensitive drum 7. As shown in FIG. 6, the shutter member 18 is attached to/supported by pivots on the tip ends of an arm 18*a* and a link member 18*b* rotatably supported by the cleaning-frame body 13. When the process cartridge B is attached to the apparatus main body 14 in the direction of arrow X in FIG. 6, and the tip end of a lever 23 whose base is fixed to the arm 18*a* in the support point 18*c* for supporting the shutter arm 18*a* abuts on a stopper (not shown) fixed to the apparatus main body 14, the shutter member 18 opens. When the process cartridge B is removed from the apparatus main body 14, the shutter member closes by the elastic force of a torsional coil spring 23*a*.

Figure 66A:
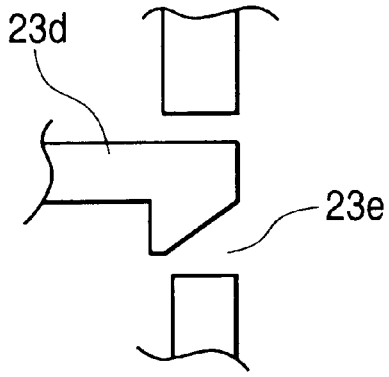
FIG. 66A is a sectional view showing the attachment of the drum-shutter member to the cartridge frame body.
Figure 66B:
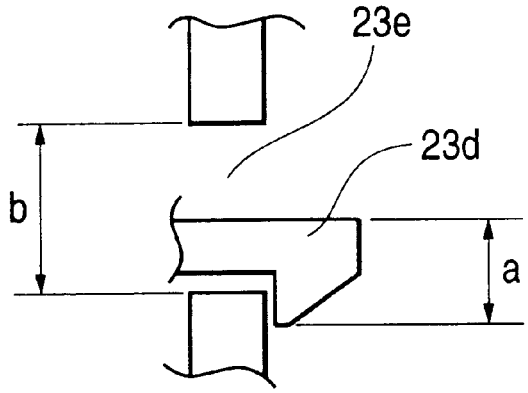
FIG. 66B is a sectional view of a stopper portion showing that the drum-shutter member is opened.
Figure 66C:
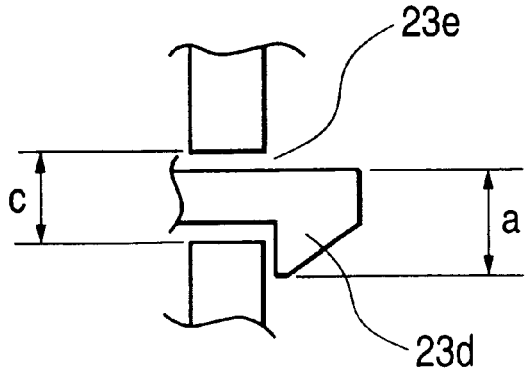
FIG. 66C is a sectional view of the stopper portion showing that the drum-shutter member is closed.

As shown in FIG. 66C, when the process cartridge B is removed from the apparatus main body 14, and the process cartridge B is of a single unit, as described above, the drum shutter member 18 closes. In this case, since a tip end 23*b* of the lever 23 is protruded, the shutter arm 18*a* is provided with a click 23*d* so that the shutter arm 18*a* is prevented from being disengaged when the user applies a force by mistake. As shown in FIGS. 65, 66A, 66B and 66C, a dimension c in the radial direction of part A of a fan-shaped hole 23*e* having the pivot 18*c* for snap-fitting the shutter arm 18*a* of the cleaning frame body 13 is narrower than a thickness a of the click 23*d* for snap-fitting the shutter arm 18*a*. As shown in FIG. 66C, when the drum shutter member 18 is closed, the click 23*d* rotates toward the part A. The relation between the thickness of the click 23*d* and the fan-shaped hole 23*e* is b>a, c<b in FIGS. 66A to 66C. At the time of the attaching of the shutter arm 18*a*, since the snap-fit portion of the shutter arm 18*a* is wider than the click 23*d* for snap-fitting the shutter arm 18*a* in the part B of the fan-shaped hole 23*e*, the shutter arm 18*a* can be attached. As shown in FIG. 66A, the click 23*d* is positioned in the part B while the drum-shutter member 18 is opened. Therefore, as shown in FIG. 66A, when the click 23*d* is deflected against the elastic force and inserted to the hole 23*e*, the state as shown in FIG. 66B is obtained.

As shown in FIGS. 10 to 17, the first guide portion 16*a* is disposed in the lower part of the guide member 16 to guide the longitudinal guide 12*a* and the cylindrical guide 13*a* disposed on the process cartridge B. The first guide portion 16*a* is provided with a main guide portion 16*a*1, a step 16*a*2, an escape potion 16*a*3, a sub-guide portion 16*a*4, and the positioning groove 16*a*5 toward the downstream side from the upstream side with respect to the attaching direction of the process cartridge B (direction of arrow X). The main guide portion 16*a*1 guides the longitudinal guide 12*a* and the cylindrical guide 13*a*. Moreover, the sub-guide portion 16*a*4 guides the cylindrical guide 13*a* toward the positioning groove 16*a*5. Furthermore, the positioning groove 16*a*5 is engaged with the cylindrical guide 13*a* to define the position of the process cartridge B. Furthermore, the second guide portion 16*b* is disposed in the upper part of the guide member 16 to guide the short guide 13*b*. The second guide portion 16*b* is provided with a lowering slope 16*b*1 toward the downstream side from the upstream side with respect to the attaching direction of the process cartridge B, and an escape portion 16*b*2 on the downstream side of the slope.

Moreover, in the cartridge-attachment space S of the apparatus main body 14, the fixed members (rotation regulating members) 25 fixed to a stay 27 are disposed on both ends. The fixed member 25 abuts on the regulating-abutment portion 13*e* to prevent the process cartridge B from rotating in the clockwise direction in FIG. 15. In this case, when the cylindrical guide 13*a* is engaged in the positioning groove 16*a*5, and the regulating-abutment portion 13*e* abuts on the fixed member 25, the process cartridge B is accurately attached to a predetermined attaching position. As described later, when the process cartridge B is removed, the fixed member 25 abuts on the release-abutment portion 13*f*, so that the process cartridge B can smoothly be removed.

Further in the cartridge-attachment space S, pressure members 26 are disposed on both left and right ends (see FIGS. 10 to 18 and FIGS. 19A and 19B). The pressure member 26 can rotate centering on a support point 26*b*, and is pushed in the clockwise direction by an elastic force of tensile coil spring 26*a* in FIGS. 10 to 17. The pressure member 26 elastically presses the upper face of the process cartridge B to prevent the process cartridge B from being vibrated by the vibration of the apparatus main body 14.

Subsequently, the relation between the attaching guide member 16 on the side of the apparatus main body 14 and the guides 12*a*, 13*a*, 13*b* on the side of the process cartridge B during the attaching/detaching of the process cartridge B will be described with reference to the drawings. FIGS. 10 to 15 are schematic diagrams showing the process cartridge from when the process cartridge B begins to be inserted until the cartridge is attached to the predetermined position. Only in FIGS. 10 and 15, the entire side face of the process cartridge B is shown by a solid line, and the attaching-guide member on the side of the apparatus main body 14 is shown by a virtual line. For the process cartridge B, only the guides are shown by solid lines, and the other members are shown by two-dot chain lines, in FIGS. 11 to 14 which show the way of insertion of the process cartridge B.

Figure 10:
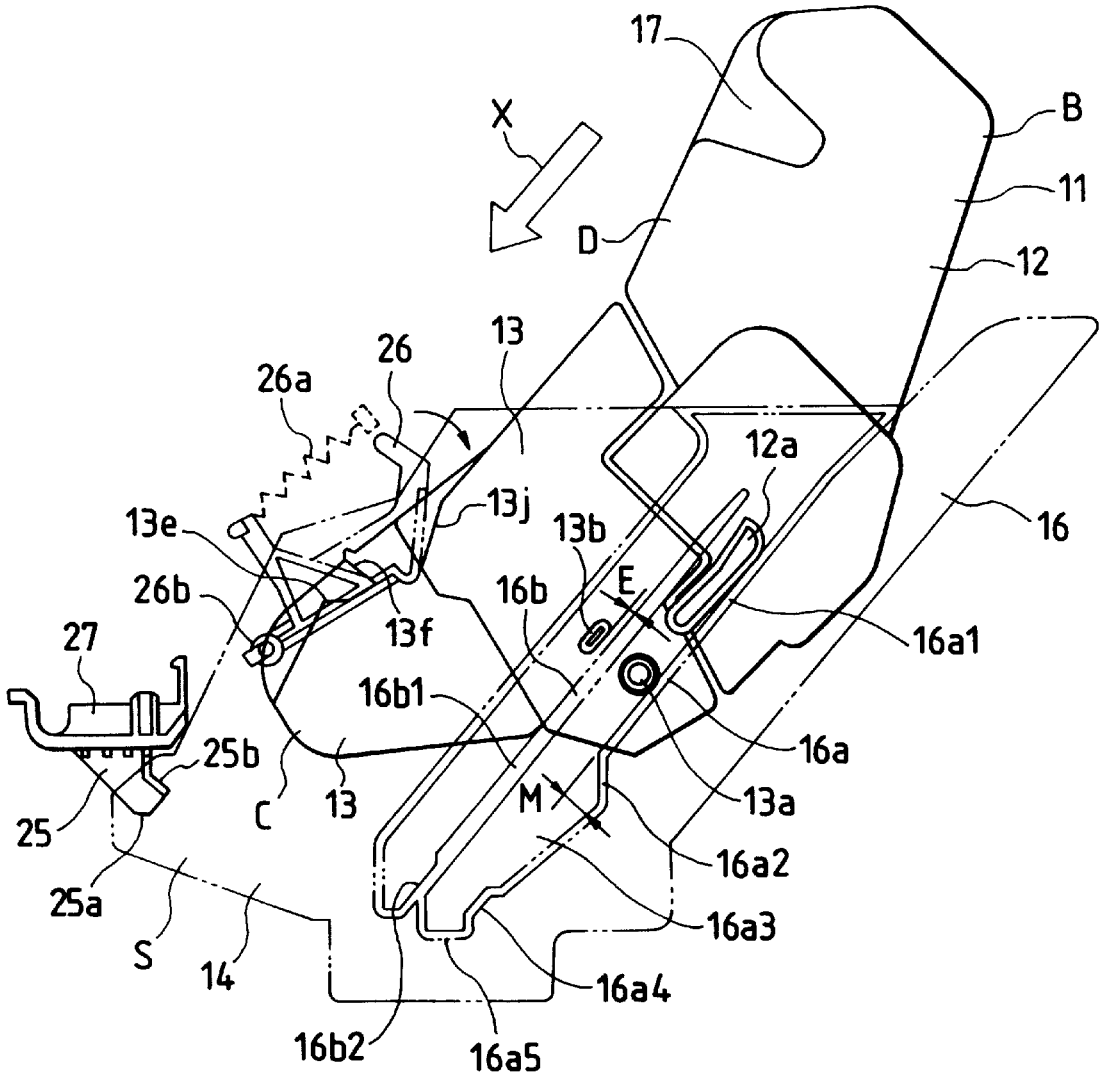
FIG. 10 is a side view showing an attaching/detaching process of the process cartridge shown in FIG. 3 to an apparatus main body.

First, as shown in FIG. 10, when the operator inserts the process cartridge B to the apparatus main body 14, the cylindrical guide 13*a* and the longitudinal guide 12*a* of the process cartridge B slide to be guided on the first guide portion 16*a*. In this case, the short guide 13*b* is not guided by the guide portion 16*b*, and the short guide 13*b* is apart from the second guide portion 16*b* by a predetermined interval E (about 2.0 to 4.0 mm in the embodiment).

In this case, the pressure member 26 is rotated upward along a slope 13*j* disposed on the upper face of the process cartridge B not to obstruct the attaching of the process cartridge B. When the process cartridge B is further inserted, the pressure member 26 slides on the upper face of the process cartridge B to prevent the process cartridge B from floating up. Thereafter, while the process cartridge B is attached, the pressure member 26 continuously presses the upper face of the process cartridge B.

Figure 11:
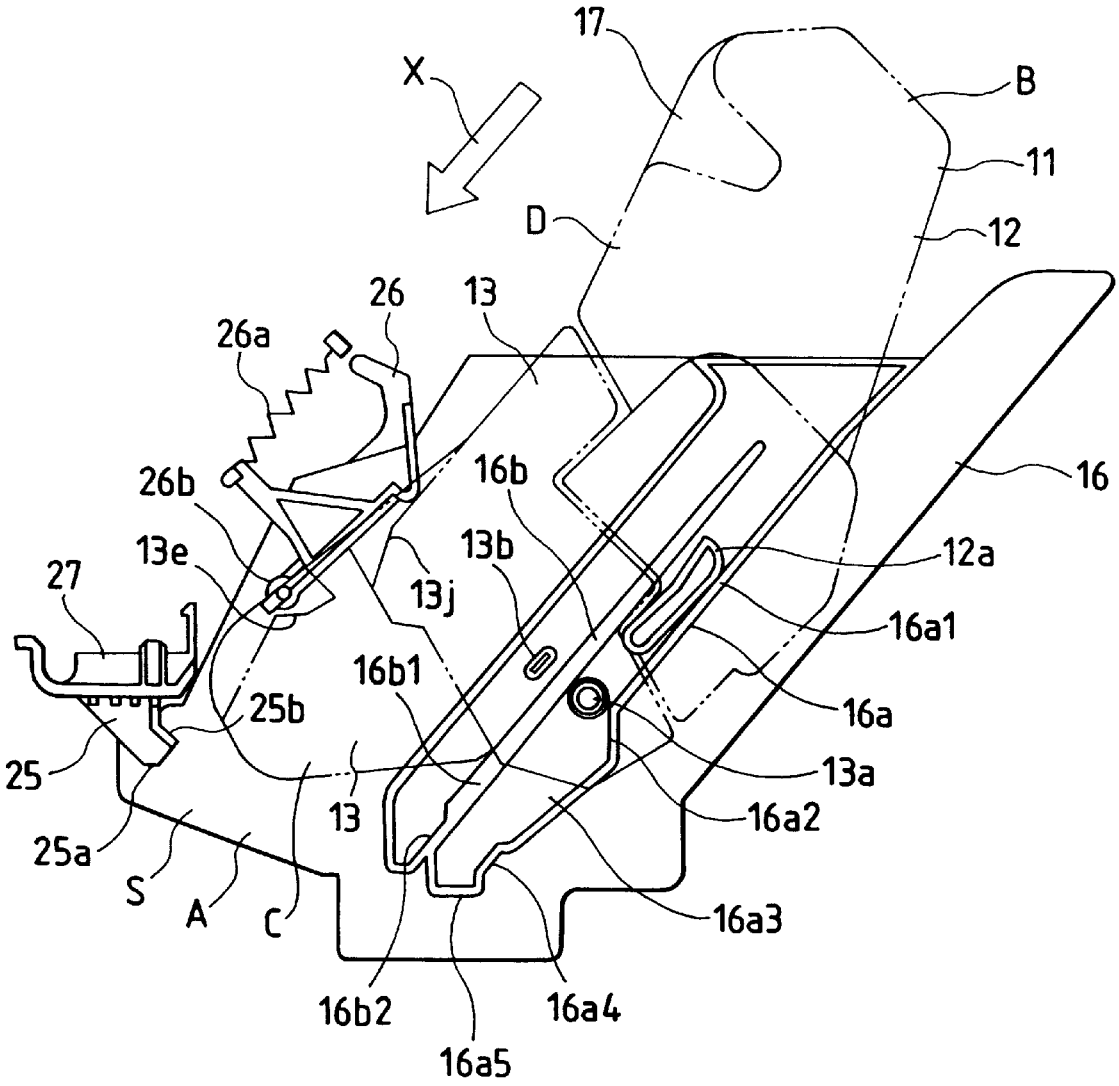
FIG. 11 is a side view showing the attaching/detaching process of the process cartridge shown in FIG. 3 to the apparatus main body.

Subsequently, when the process cartridge B is placed in the state shown in FIG. 11, the cylindrical guide 13*a* passes the step 16*a*2 formed on the first guide portion 16*a* to almost reach the escape portion 16*a*3. The escape portion 16*a*3 of the first guide portion 16*a* allows the longitudinal guide 12*a* to escape when the process cartridge B reaches the predetermined position (see FIG. 15), and depth M of the escape portion (see FIG. 10, about 4.0 to 8.0 mm in the embodiment) is set to be larger than the above-described interval E (E<M). Additionally, as shown in FIGS. 10 and 11, the short guide 13*b* does not contact the second guide portion 16*b* (lower slope 16*b*1).

Figure 12:
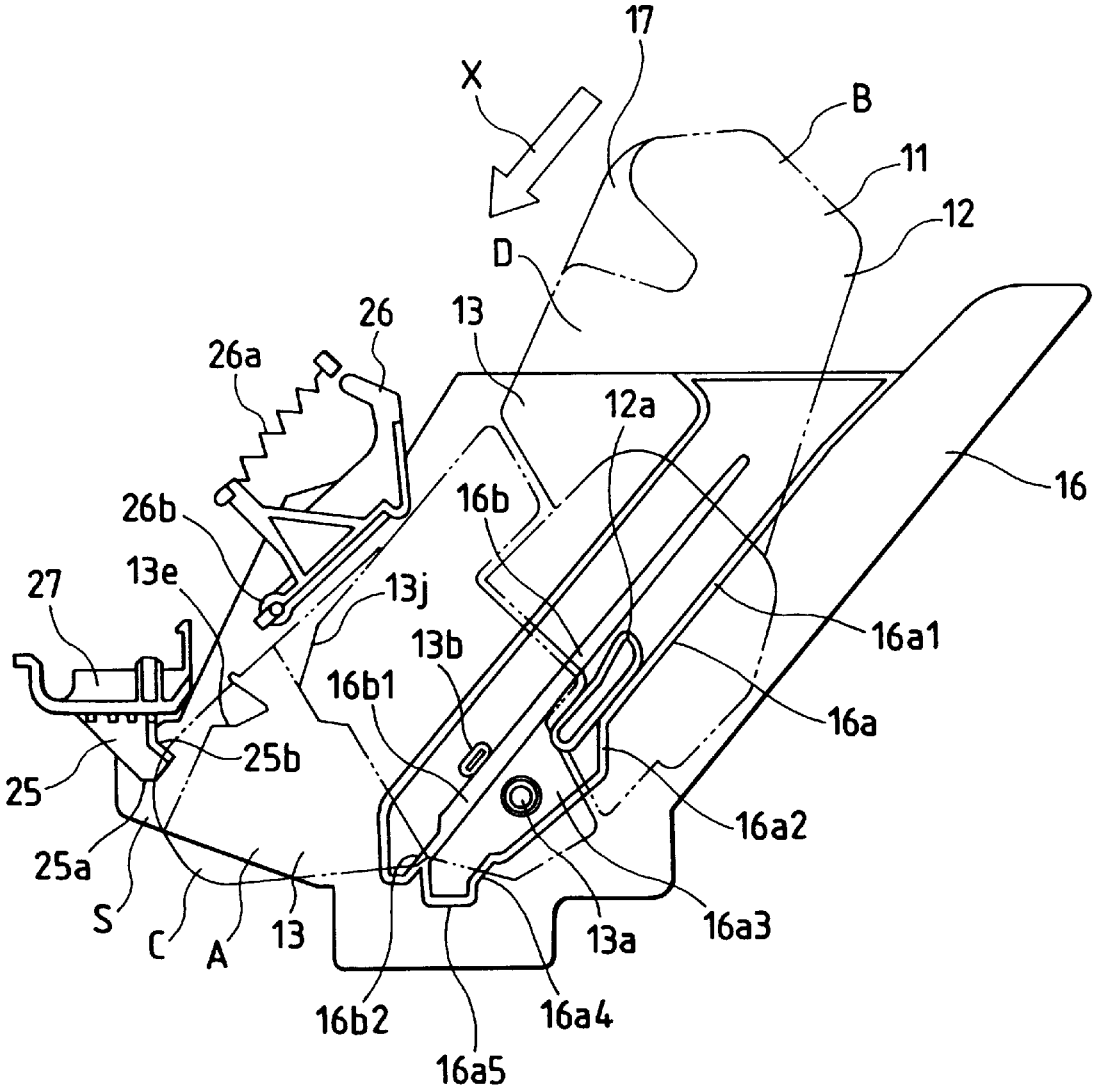
FIG. 12 is a side view showing the attaching/detaching process of the process cartridge shown in FIG. 3 to the apparatus main body.

Therefore, when the process cartridge B advances to the state shown in FIG. 12, the short guide 13*b* contacts the second guide portion 16*b* before the cylindrical guide 13*a* of the process cartridge B reaches the lower edge of the escape portion 16*a*3. Specifically, the longitudinal guide 12*a* and the short guide 13*b* function as the inserting guides of the process cartridge B, thereby alleviating the shock by the difference in level of the process cartridge B, and the like.

Figure 13:
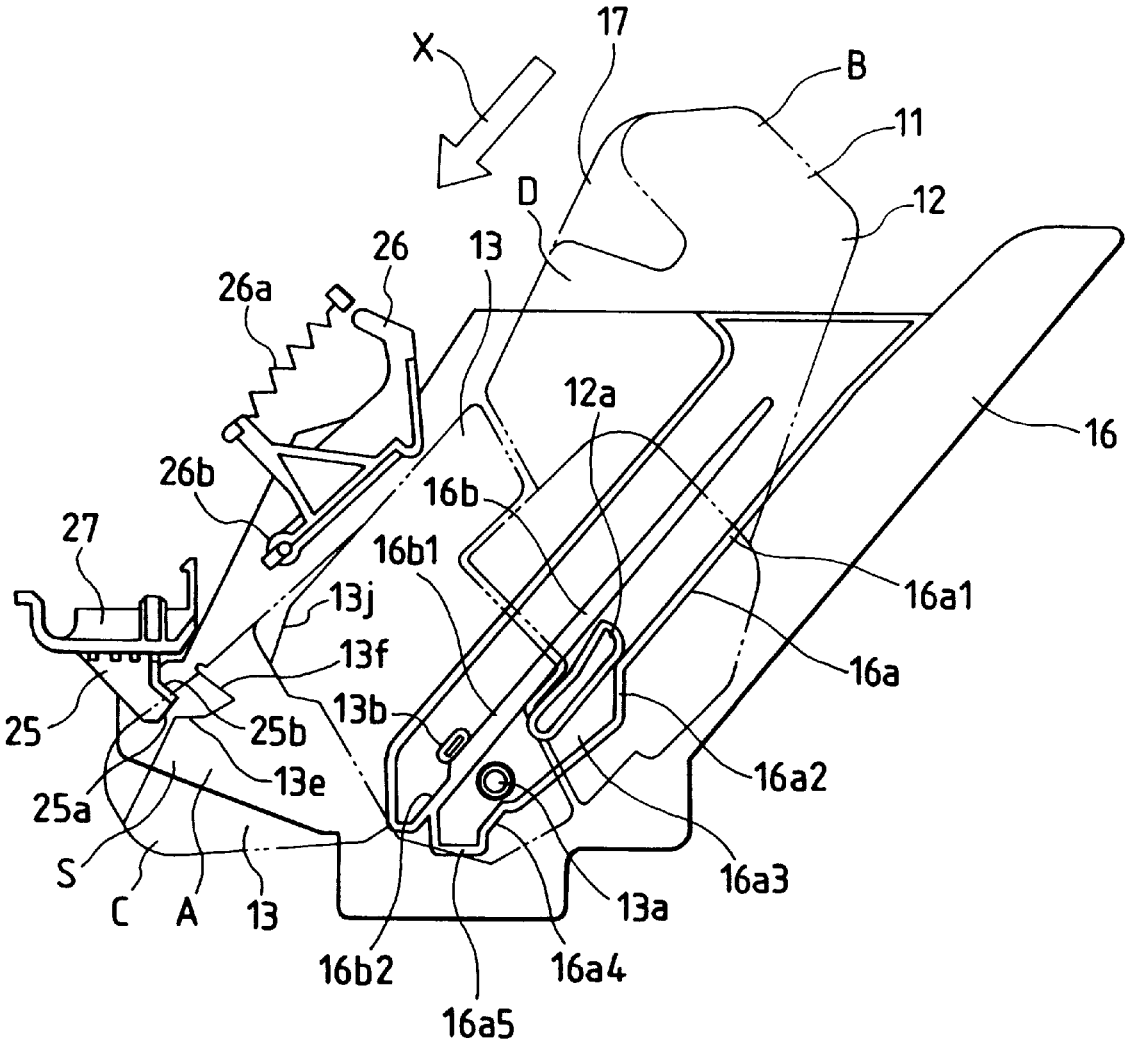
FIG. 13 is a side view showing the attaching/detaching process of the process cartridge shown in FIG. 3 to the apparatus main body.

Furthermore, when the process cartridge B advances to the state shown in FIG. 13, the longitudinal guide 12*a* of the process cartridge B substantially reaches the above-described escape portion 16*a*3 of the first guide portion 16*a*. Then, the cylindrical guide 13*a* of the process cartridge B slides along the sub-guide portion 16*a*4. In this case, for the process cartridge B, the cylindrical guide 13*a* and the short guide 13*b* are guided by the first guide portion 16*a* and the second guide portion 16*b*, respectively.

Figure 14:
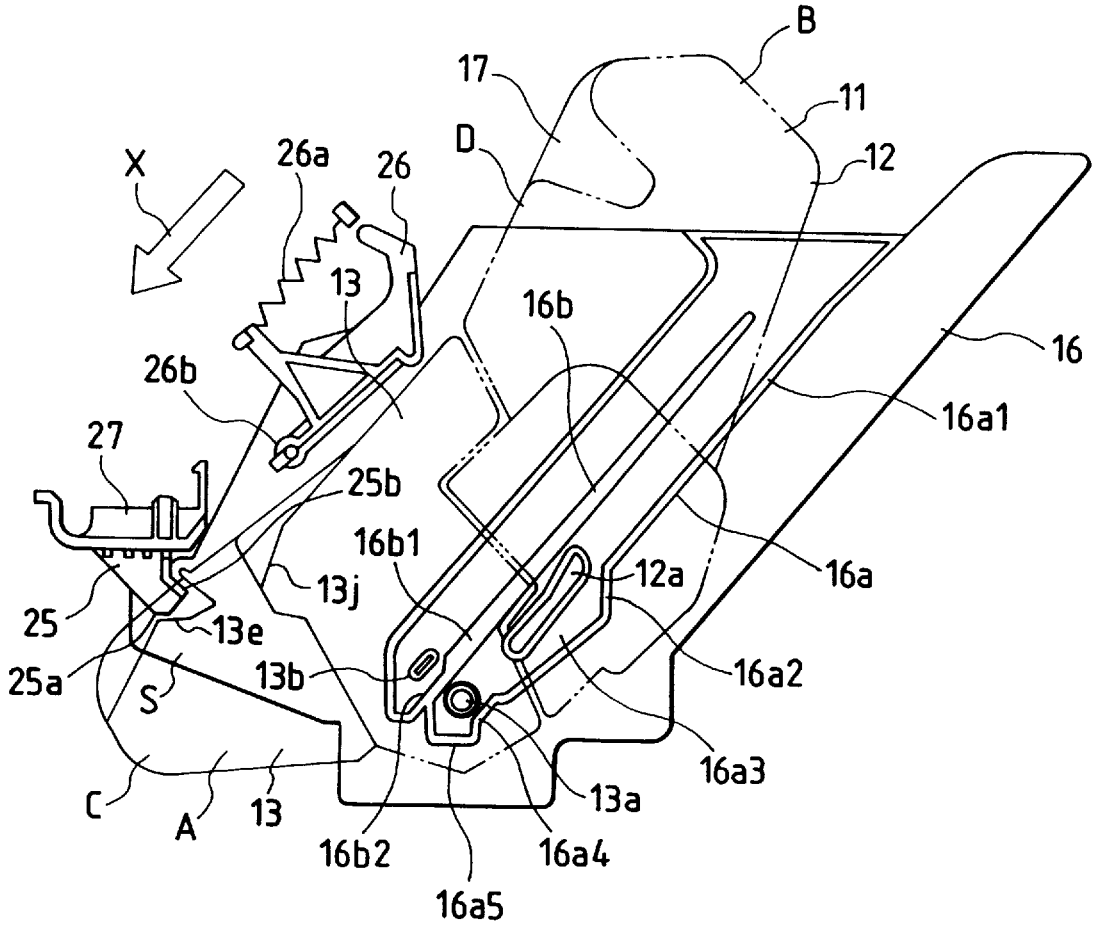
FIG. 14 is a side view showing the attaching/detaching process of the process cartridge shown in FIG. 3 to the apparatus main body.

Subsequently, when the process cartridge B advances to the state shown in FIG. 14, the short guide 13*b* substantially reaches the escape portion 16*b*2 of the second guide portion 16*b*. Since the short guide 13*b* escapes, only the cylindrical guide 13*a* slides along the sub-guide portion 16*a*4 only for a short time. Finally, the process cartridge B rotates slightly in counterclockwise direction, and the cylindrical guide 13*a* enters the positioning groove 16*a*5 of the first guide portion 16*a* (see FIG. 15). Substantially at the same time, the regulating-abutment portion 13*e* formed on the cleaning-frame body 13 abuts on a rotation-regulating portion 25*a* (see FIG. 15) of the fixed member 25 fixed to the apparatus main body 14. Thereby, the entire position of the process cartridge B is determined. Therefore, the process cartridge B is positioned centering on the cylindrical guide 13*a*, and the other guides (longitudinal guide 12*a*, short guide 13*b*) do not contact any portion of the guide member 16 of the apparatus main body 14. Therefore, the process cartridge B is positioned with good precision.

Additionally, for the positional relation of the regulating-abutment portion 13*e* and the rotation-regulating portion 25*a*, as described later, they are directed to receive a moment generated by the driving of the process cartridge B. Furthermore, the distance of the regulating-abutment portion 13*e* and the abutment portion of rotation-regulating portion 25*a* from the center of the cylindrical guide 13*a* is set to be longer than the distance of the longitudinal guide 12*a* and short guide 13*b* from the center of the cylindrical guide 13*a*. Therefore, the posture of the process cartridge B during the driving is stabilized more.

Subsequently, in the state shown in FIG. 15, a helical drum gear 7*b* disposed on one end of the photosensitive drum 7 in the axial direction meshes with a drive helical gear 28 disposed on the apparatus main body 14. The drive force from the apparatus main body 14 is transmitted to the photosensitive drum 7 via the gears 28, 7*b*. Here, when the helical gear 28 transmits the drive force to the helical gear 7*b*, the process cartridge B is subjected to a force to rotate in the clockwise direction in FIG. 15. The movement of the process cartridge B is regulated by the regulating abutment portion 13*e*.

Moreover, the pressure member 26 pushes the process cartridge B downward from above. Therefore, for example, unless the cylindrical guide 13*a* is engaged in the groove 16*a*5 of the apparatus main body 14, a moment acts using the contact portion of the rotation-regulating portion 25*a* and regulating-abutment portion 13*e* as a support point, so that the cylindrical guide 13*a* is engaged in the positioning groove 16*a*5.

The case of removing the process cartridge B from the apparatus main body 14 will next be described with reference to FIGS. 16 and 17. Additionally, an arrow Y shows a direction in which the process cartridge B is removed.

Figure 16:
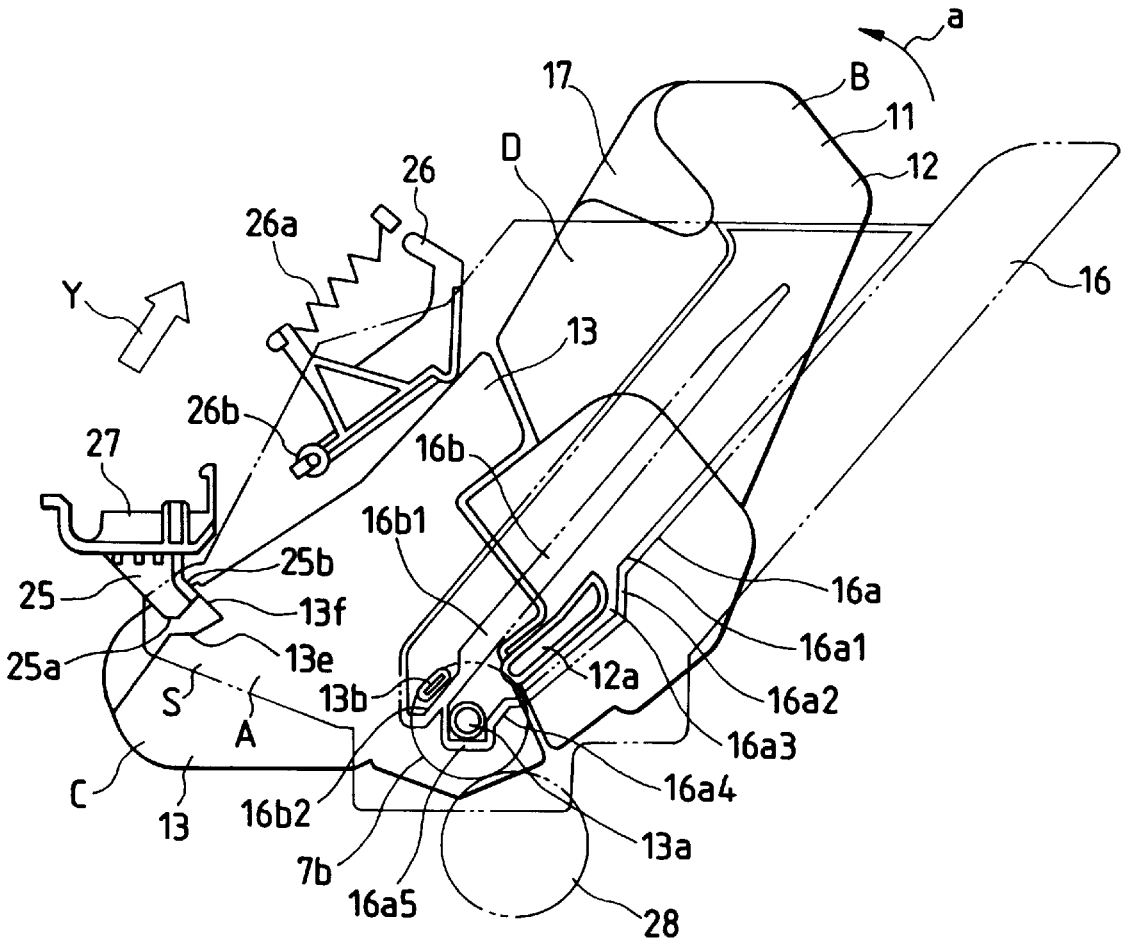
FIG. 16 is a side view showing the attaching/detaching process of the process cartridge shown in FIG. 3 to the apparatus main body.

First, to remove the process cartridge B, as shown in FIG. 16, the operator holds the handle portion 17 of the process cartridge B (the portion of the toner frame body 11 on the downstream side of the removing direction from the recess portion disposed in the developing-frame body 12), and lifts the handle portion 17 upward (direction of arrow a). Then, the process cartridge B rotates in the counterclockwise direction centering on the cylindrical guide 13*a*. Subsequently, the release-abutment portion 13*f* of the process cartridge B collides against a release-abutment portion 25*b* of the fixed member 25 disposed on the apparatus main body 14. When the operator further lifts up the process cartridge B, as shown in FIG. 17, the process cartridge B rotates using an abutment point F of the release-abutment portion 13*f* of the process cartridge B and the release-abutment portion 25*b* of the fixed member 25 as a support point. By this action, the cylindrical guide 13*a* is lifted up, and detached from the positioning groove 16*a*5. In this case, the meshing of the helical drum gear 7*b* and drive helical gear 28 is smoothly released. In this state the process cartridge B is drawn straight. Then, in the procedure shown in FIGS. 14, 13, 12, 11, 10 in order, the process cartridge B can be removed from the apparatus main body 14.

As described above, according to the embodiment of the present invention, since the longitudinal guide as the second guide member is extended in the cartridge inserting direction to ride over the side faces of both the developing unit D and the cleaning unit C, the process cartridge is prevented from becoming unsteady at the time of the attaching/detaching, and stable inserting can be performed, so that operability is enhanced.

Moreover, the guide means for guiding the process cartridge B to the apparatus main body 14 during the attaching/detaching is constituted of the above-described three guides (cylindrical guide 13*a*, longitudinal guide 12*a*, short guide 13*b*), and the process cartridge B is guided by at least two guides during the attaching/detaching. Thereby, even if the attaching guide member on the side of the apparatus main body has a difference in level or the like, the shock on the process cartridge is absorbed.

Moreover, the positioning of the process cartridge B is performed by the rotation-regulating portion 25*a* and the cylindrical guide 13*a* which are directed to receive the moment of the process cartridge B generated by the driving, and the other guides (longitudinal guide 12*a*, short guide 13*b*) are constituted not to contact the guide member of the apparatus main body. Thereby, the posture of the process cartridge B becomes more stable during driving (image forming).

Additionally, for the process cartridge B of the above-described embodiment, the guide means constituted of three guide members as the guide for attaching/detaching the cartridge has been illustrated. However, the present invention is not limited to the embodiment. For example, the guide means may be constituted of at least the cylindrical guide as the first guide member and the longitudinal guide as the second guide member, or guide members other than the above-described three guide members may be disposed to constitute the guide means.

Additionally, as shown in FIGS. 9A, 9B, a spur gear 7*n* is disposed on the end of the axial direction opposite to the end on which the drum gear 7*b* of the photosensitive drum 7 is disposed. When the process cartridge B is attached to the apparatus main body 14, the gear 7*n* meshes with a gear (not shown) on the same axis as that of the transfer roller 4 disposed on the apparatus main body 14, and transfers the drive force to rotate the transfer roller 4 from the process cartridge B.

Moreover, a helical gear 9*u* is disposed on one end of the axial direction of the developing roller 9*c*, and meshes with the helical drum gear 7*b* to transmit the drive force to rotate the developing roller 9*c* from the helical drum gear 7*b*.

(Toner-Frame Body)

Figure 30:
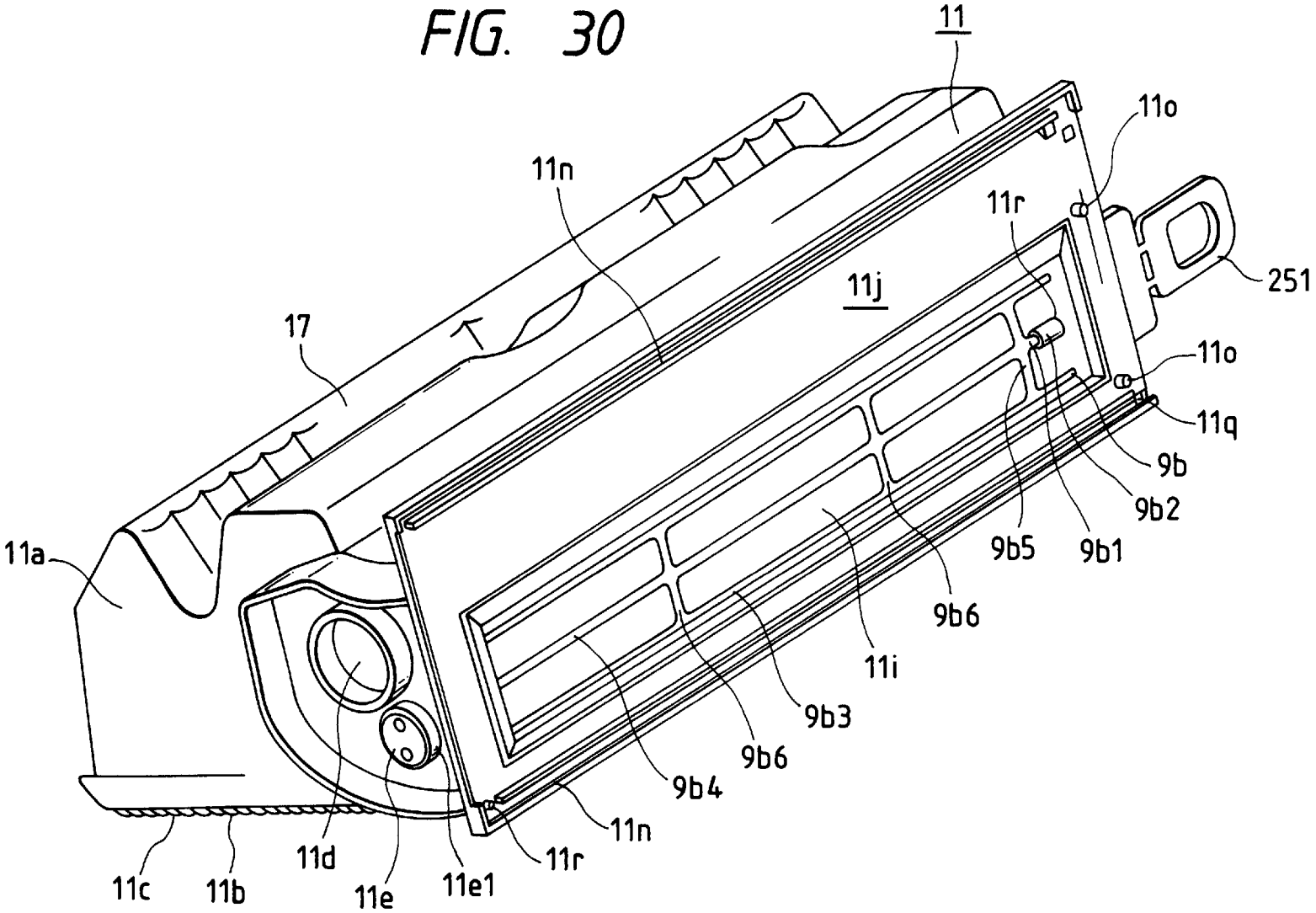
FIG. 30 is a perspective view of a toner frame body.
Figure 31:
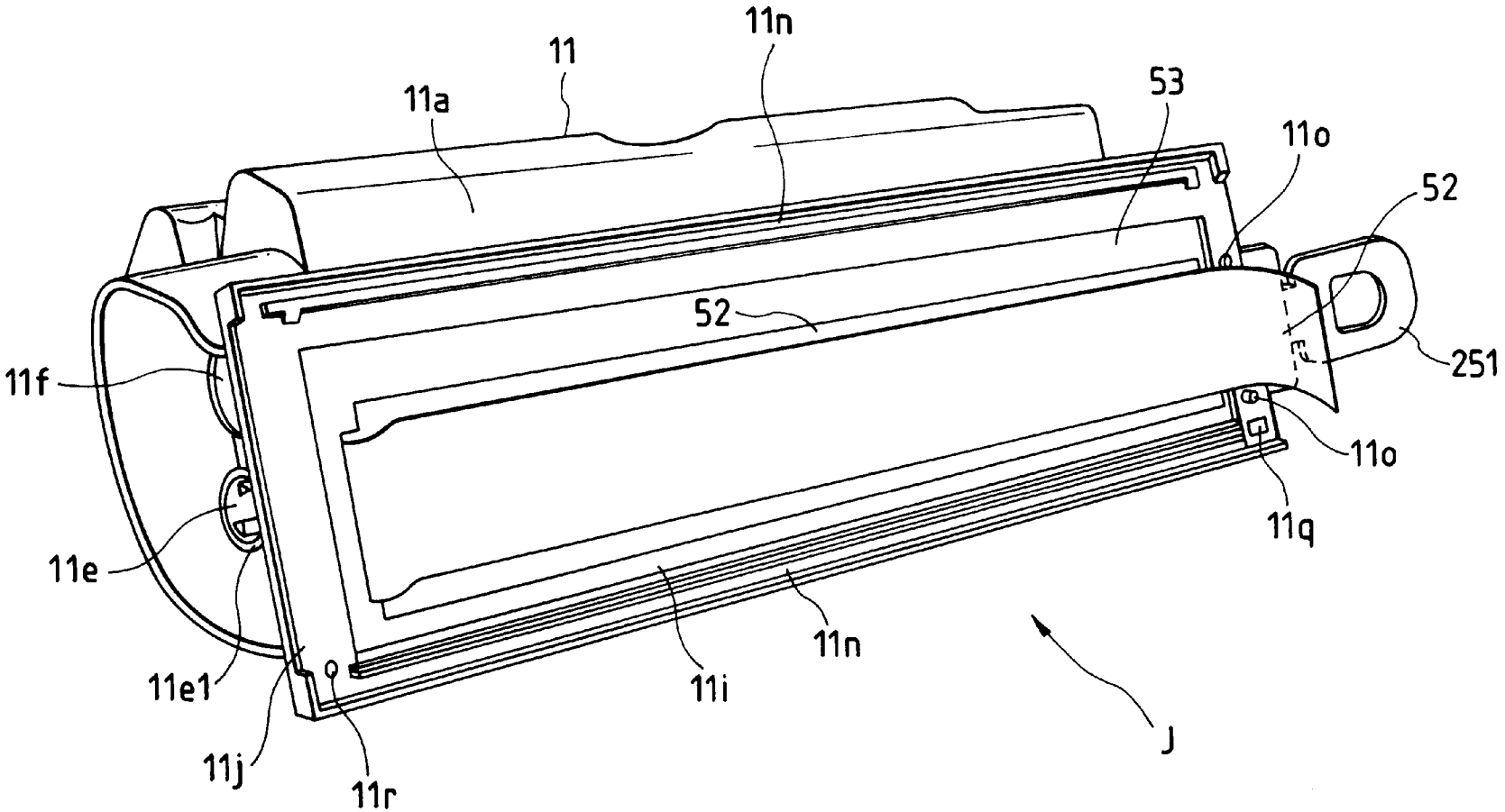
FIG. 31 is a perspective view showing that a toner seal is attached to the toner frame body.
Figure 33:
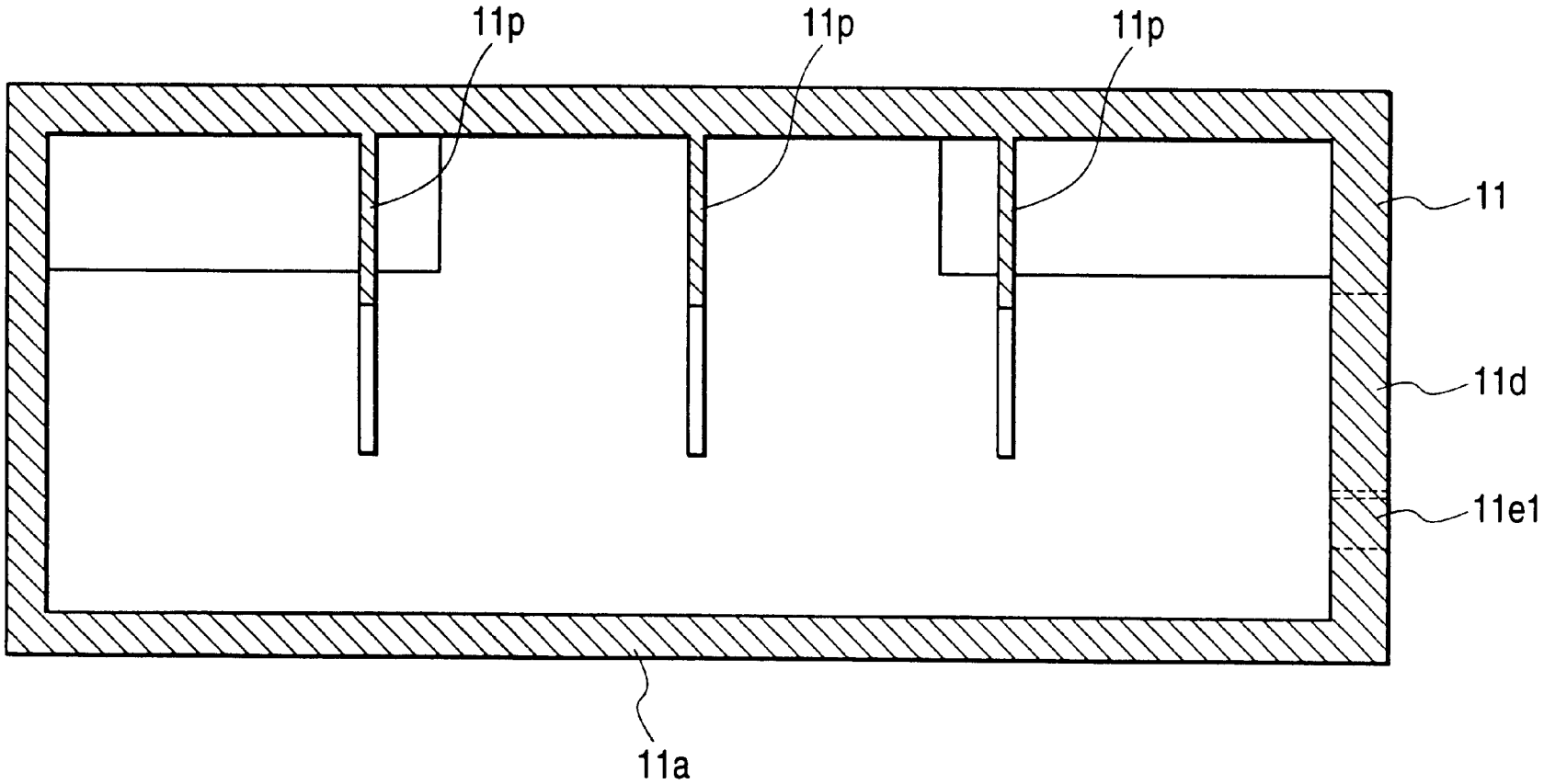
FIG. 33 is a sectional view showing the inside of the toner frame body and taken along line XXXIII—XXXIII of FIG. 3.
Figure 34:
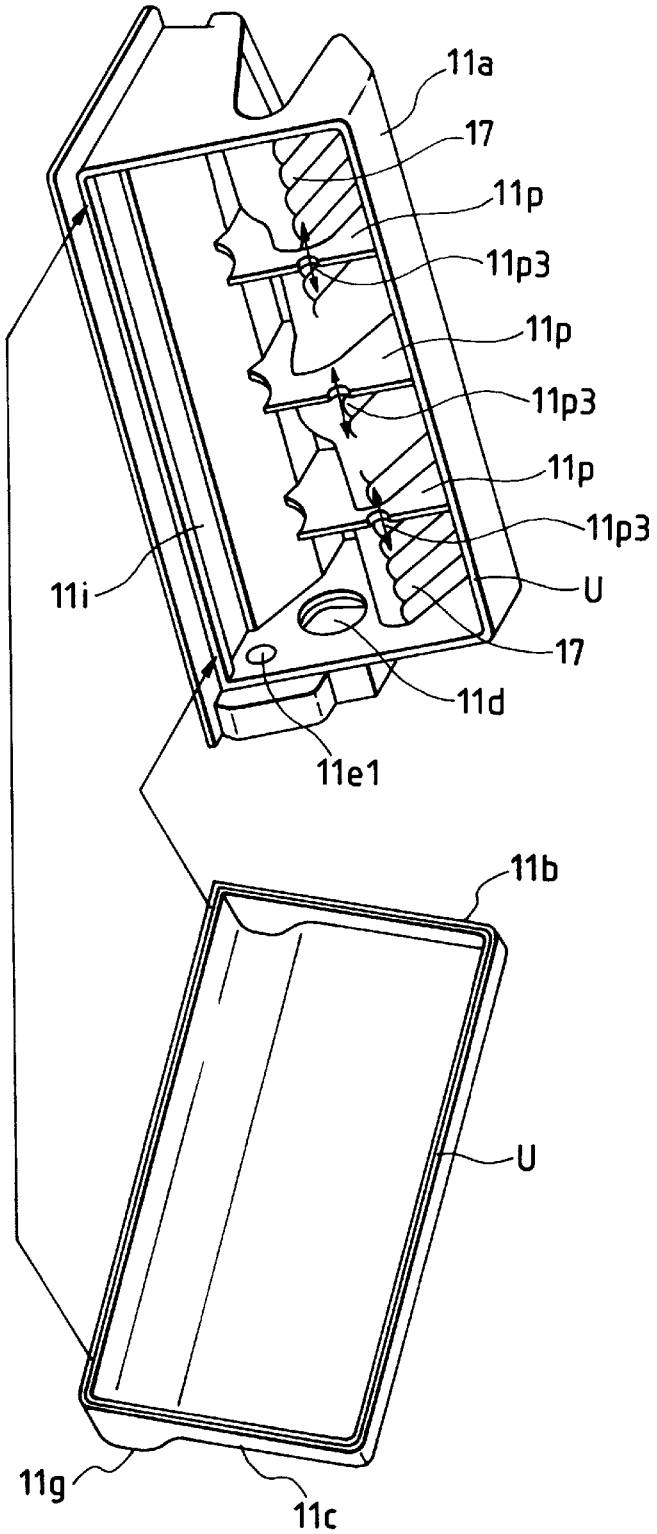
FIG. 34 is an exploded perspective view of the toner frame body.

The toner-frame body will be described in detail with reference to FIGS. 3, 30, 31, 33 and 34. FIG. 30 is a perspective view before the toner seal is welded, FIG. 31 is a perspective view after the filling of toner, FIG. 33 is a plan view of an upper-frame body 11*a*, and FIG. 34 is a perspective view showing that the toner-frame body is disassembled.

As shown in FIG. 3, the toner-frame body 11 is constituted of two components: the upper-frame body 11*a* and a lower-frame body 11*b*. The upper-frame body 11*a* is provided with the handle portion 17 formed by the recess portion in the longitudinal direction from above and from the outside, and has the above-described function as the handle. When the process cartridge B is constituted, a large number of ribs 11*c* parallel to the longitudinal direction are arranged on the outer surface of the lower-frame body 11*b* constituting the bottom in the longitudinal direction with an interval of about 1 to 2 mm. In this case, the operator grasps the recess portion 17 and the ribs 11*c* with both hands. Additionally, the ribs 11*c* provide slip resistance when the process cartridge B is hand-held. Subsequently, the lower-frame body 11*b* is connected to the upper-frame body 11*a* on a welding face U, and both frame bodies 11*a*, 11*b* are formed into one unit by dissolving welded ribs on the welding face U by forced vibration. However, the connecting method is not limited to the vibration welding and, for example, thermal welding, ultrasonic welding, bonding, and the like may be performed. Additionally, the toner-feeding member 9*b* is incorporated into the upper-frame body 11*a* before both the frame bodies 11*a*, 11*b* are combined. Furthermore, a coupling member 11*e* is assembled via a hole 11*e*1 to be engaged with the end of the toner-feeding member 9*b* (state shown in FIG. 30). The hole 11*e*1 is made in one end of the upper-frame body 11*a* in the longitudinal direction. A toner-filling port 11*d* with a diameter of about 30 mm for filling the body with toner is disposed on the same side as this hole 11*e*1. Therefore, the hole 11*e*1 and the toner-filling port 11*d* are arranged side by side. Furthermore, an opening 11*i* of the toner-frame body 11 for feeding the toner to the developing frame body 12 from the toner-frame body 11 is disposed in the longitudinal direction of the upper frame body 11*a*, and a seal (described later) is welded so as to cover the opening 11*i*. Thereafter, the body is filled with the toner via the toner-filling port 11*d*, and the toner-filling port 11*d* is closed by a toner cap 11*f* to complete a toner unit J (see FIG. 31). The toner cap 11*f* is formed of a soft material such as polyethylene and polypropylene, and press-inserted and located in the filling port 11*d* formed in the toner frame body 11. Furthermore, the toner unit J is ultrasonic-welded to the developing-frame body 12 described later to constitute the developing unit D shown in FIG. 9B. However, the connecting method is not limited to the ultrasonic welding and, for example, bonding, snap-fitting using an elastic force, and the like may be performed.

Moreover, as shown in FIG. 3, an inclined face K of the lower-frame body 11*b* of the toner-frame body 11 has an inclination angle θ such that toner naturally drops when consumed, that is, the inclined face K of the process cartridge B attached to the apparatus main body 14 while the apparatus main body 14 is laid horizontally preferably has an angle θ of about 60° with a horizontal line Z. Furthermore, the rotating area of the toner-feeding member 9*b* extends downward from the inclined face K. Therefore, the lower frame body 11*b* has a concave portion 11*g* in its lower portion so as to escape from the rotating area of the toner-feeding member 9*b*. The rotating diameter of the toner-feeding member 9*b* is about 30 mm. (According to the embodiment, the lower frame body 11*b* is recessed by about 4 mm from the bottom face. Additionally, the range of about 2.0 mm to 10 mm is preferable.) If the rotating area of the toner-feeding member 9*b* is above the inclined face K, for the toner naturally dropping from above the inclined face K, in the vicinity of the toner-feeding member 9*b*, the toner fails to be fed into the developing-frame body 12 by the distance between the toner-feeding member 9*b* and the inclined face K, and the toner is presumed to remain. In the embodiment, however, the toner can securely be fed to the developing-frame body 12 from the toner-frame body 11.

Additionally, an iron material obtained by punching a flat plate with a thickness of about 1 mm is used in the toner-feeding member 9*b*, and to secure the toner-feeding performance and suppress the torque increase during rotating, as shown in FIG. 30, an outer peripheral frame 9*b*3 having a width of about 4 mm and a rotating-shaft central portion 9*b*4 are secured to form a rectangular shape. One of flat support shafts 9*b*1 disposed on opposite sides 9*b*5 (drive side is not shown) is inserted to a cylindrical rotation supporting member 9*b*2 in a round hole 11*r* of the upper frame body 11*a* and pivotably attached to the portion of the round hole 11*r* facing the inside of the opening 11*i* of the upper frame body 11*a*, while the other shaft is fixed to the coupling member 11*e*. The coupling member 11*e* regulates the thrust direction to the toner-frame body 11 by snap-fitting, E-ring, and the like. Additionally, the rotating-shaft central portion 9*b*4 is connected to the outer peripheral frame 9*b*3 via an arm 9*b*6 for reinforcement.

As described above, since the toner-frame body 11 is constituted of two members, the upper-frame body 11*a* and the lower-frame body 11*b*, and the bottom face of the lower-frame body 11*b* is provided with the concave portion 11*g* as the escape of the toner-feeding member 9*b*, a stable toner-feeding performance can be obtained even with a large-capacity process cartridge without increasing costs.

It is contemplated that the toner and air in the toner frame body 11 rapidly move by the vibration, impact, and the like during the transport, from when the process cartridge B is delivered from a factory until it is transferred to the user.

To solve the problem, in the embodiment, a plurality of partition plates 11*p* are further arranged inside the upper-frame body 11*a* of the toner-frame body 11 in the longitudinal direction (see FIGS. 3, 33, 34). In the embodiment, there are provided three partition plates 11*p*, and the partition plate has an edge 11*p*1 facing the toner-feeding member 9*b* and substantially surrounding the quadrant of the toner-feeding member 9*b* and an edge 11*p*2 abutting on or having a slight gap from the lower-frame body 11*b*. The edge 11*p*1 facing the toner-feeding member 9*b* is disposed in a position where a part of the toner-filling port 11*d* is covered with the partition plate 11*p* as seen from the longitudinal direction. Moreover, each partition plate 11*p* is provided with at least one notch 11*p*3.

Here, to prevent the toner from moving in the toner container 11A, the partition plate 11*p* is preferably formed to be as large as possible. However, to fill the toner container with the toner with the toner-filling port 11*d* facing upward, if the partition plate 11*p* is positioned right under the toner-filling port 11*d* to completely cover the toner-filling port lid, it is difficult to fill the innermost part of the toner container 11A with the toner. Here, as described above, when the partition plate 11*p* is constituted as in the embodiment, the toner is fed to the innermost part through a space where the toner-filling port 11*d* is not covered with the partition plate 11*p*. Moreover, the partition plate 11*p* occupies the inner sectional face of the toner frame body 11 orthogonal to the longitudinal direction with a sufficiently large ratio. Even if the vibration, impact, and the like occur with the process cartridge B, the partition plate 11*p* obstructs the toner movement, so that the toner is not compressed. Moreover, the notch 11*p*3 disposed in the partition plate 11*p* is disposed in a position of about 40 $mm^2$ such that the toner movement has to be prevented and apart from a toner seal 52 (e.g., the central position of the edge on the side of the lower frame body 11*b* of the partition plate 11*p*). The notch 11*p*3 is positioned in the inner part of the upper-frame body 11*a* as seen from the opening 11*i*. Thereby, air flow is generated in the toner-frame body 11 at the time of vibration, impact or the like of the process cartridge B, and the air flow is rapidly stopped to alleviate the air impact by which the velocity energy of the air flow containing the toner is converted to the pressure and to reduce the load toward the toner seal 52, so that the toner seal is prevented from being torn. Particularly in the inner part of the toner-frame body 11 as viewed from the opening 1*i*, air is confined between the partition plates 11*p* so that the impact of jet air into the toner is avoided. Therefore, the notch disposed in the partition plate 11*p* is positioned in the inner side of the toner-frame body 11 as viewed from the opening 11*i*. In the embodiment, the notch 11*p*3 is formed as the passage for air movement, but a hole may be made in the partition plate 11*p*.

(Constitution of Portion of Toner-Frame Body opposite to Developing-Frame Body)

Figure 32:
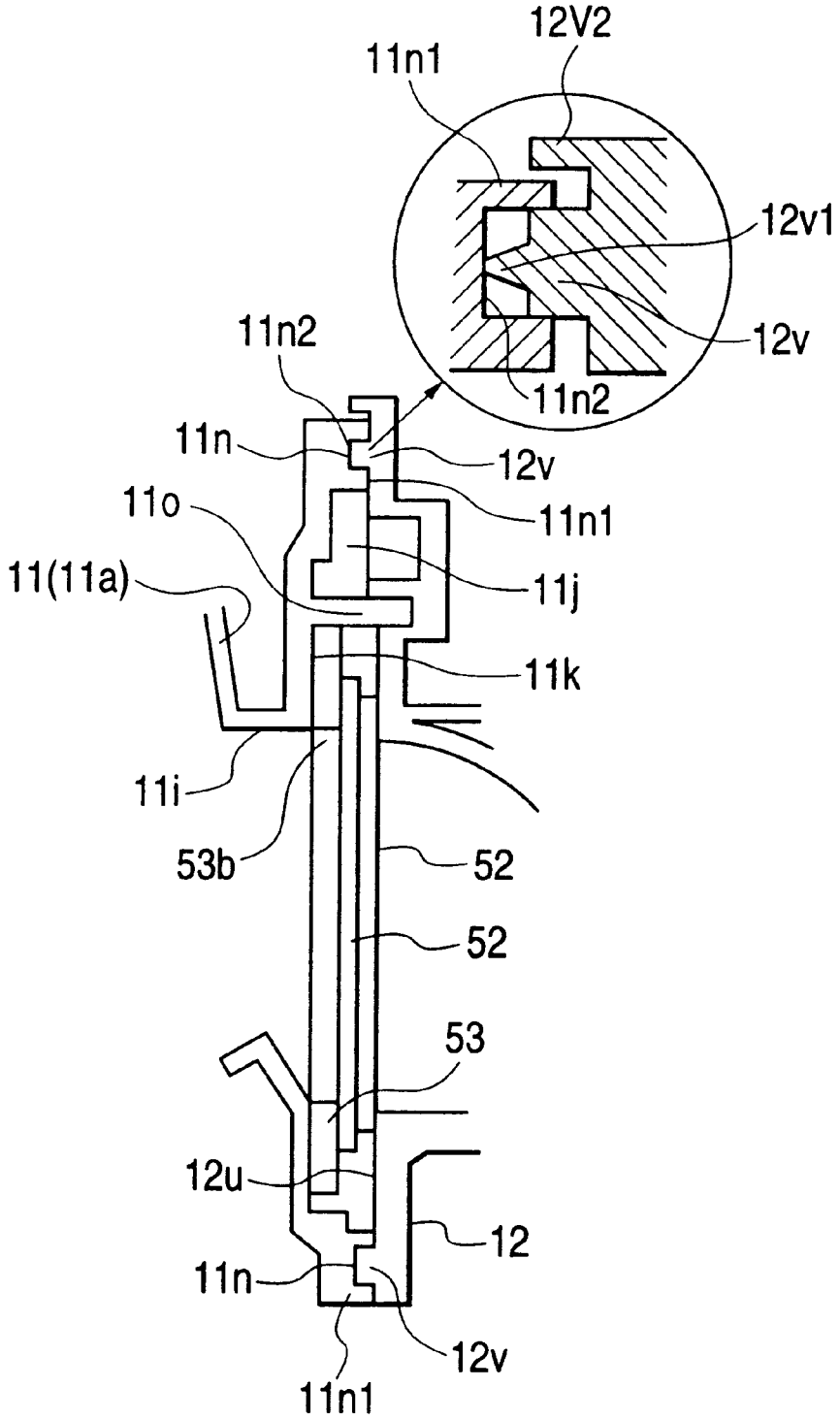
FIG. 32 is a longitudinal sectional view of a toner seal portion of FIG. 31.

As shown in FIGS. 3, 30, 32, the opening 11*i* for feeding the toner to the developing-frame body 12 from the toner-frame body 11 is disposed in the bonded portion of the toner-frame body 11 with the developing-frame body 12. On one end of a surface 11*j* of the toner-frame body 11 in the longitudinal direction, joggles 11*o* as guides for pulling out the toner seal 52 are disposed outside in the width direction (short direction) of the toner seal 52. Furthermore, longitudinal grooves 11*n* are disposed in parallel along both edges of the short direction of the surface 11*j*, and a bottom 11*n*2 of the groove 11*n* is protruded out of the surface 11*j* (toward the developing frame body 12) (see FIG. 32).

A flat face 12*u* of the developing-frame body 12 is opposite to the toner-frame body 11, and the edges of the flat face 12*u* are provided in the longitudinal direction with protrusions 12*v* which are engaged in the grooves 11*n* of the toner-frame body 11. A triangular protrusion 12*v*1 for the ultrasonic welding is disposed on the top surface of the protrusion 12*v* (see FIG. 32). In this case, while the protrusions 12*v* are engaged in the grooves 11*n*, the toner-frame body 11 and the developing-frame body 12 are ultrasonically welded along the longitudinal direction.

Furthermore, as shown in FIGS. 31 and 32, a cover film plate 53 having an opening 53*b* similar to the opening 11*i* is placed on a toner-seal face 11*k* of the toner-frame body 11 so as to close the opening 11*i*, and the toner seal 52, which is easily torn in the longitudinal direction, is attached to the cover film plate 53 by thermal welding. The toner seal 52 is folded back at one end of the longitudinal direction of the opening 11*i*, passed between an elastic seal member 54 (see FIG. 28), such as a felt, placed on the end of longitudinal direction of the flat face of the developing-frame body 12 opposite to the toner-frame body 11, and the toner-frame body 11, and pulled to the outside. The toner seal 52 is bonded to a handle member 251 for the user to pull the process cartridge B with a double-coated tape or the like (see FIGS. 6 and 31). Additionally, a tape 55 of a synthetic resin film with a small friction coefficient is placed to the inner part of the surface of the seal member 54. Furthermore, on the end of the longitudinal direction opposite to the position to which the seal member 54 is placed, an elastic seal member 56 is attached onto the flat face 12*u* (see FIG. 28).

Furthermore, when the toner-frame body 11 and the developing-frame body 12 are combined, to easily position both the frame bodies 11, 12, the surface 11*j* of the toner-frame body 11 is provided with a round hole 11*r*, and a square hole 11*q* which are engaged with a cylindrical joggle 12*w*1, and a square joggle 12*w*2 disposed on the developing-frame body 12. Here, the rough hole 11*r* is closely engaged with the joggle 12*w*1, and the square hole 11*q* is roughly engaged with the joggle 12*w*2 in the longitudinal direction. Additionally, the seal member 56 is bonded to the flat face 12. Moreover, recess portions 12*y* in which the joggles 11*o* disposed on the toner-frame body 11 are loosely engaged are disposed on the flat face 12*u* of the developing frame body 12 opposite to the toner frame body 11.

Figure 61:
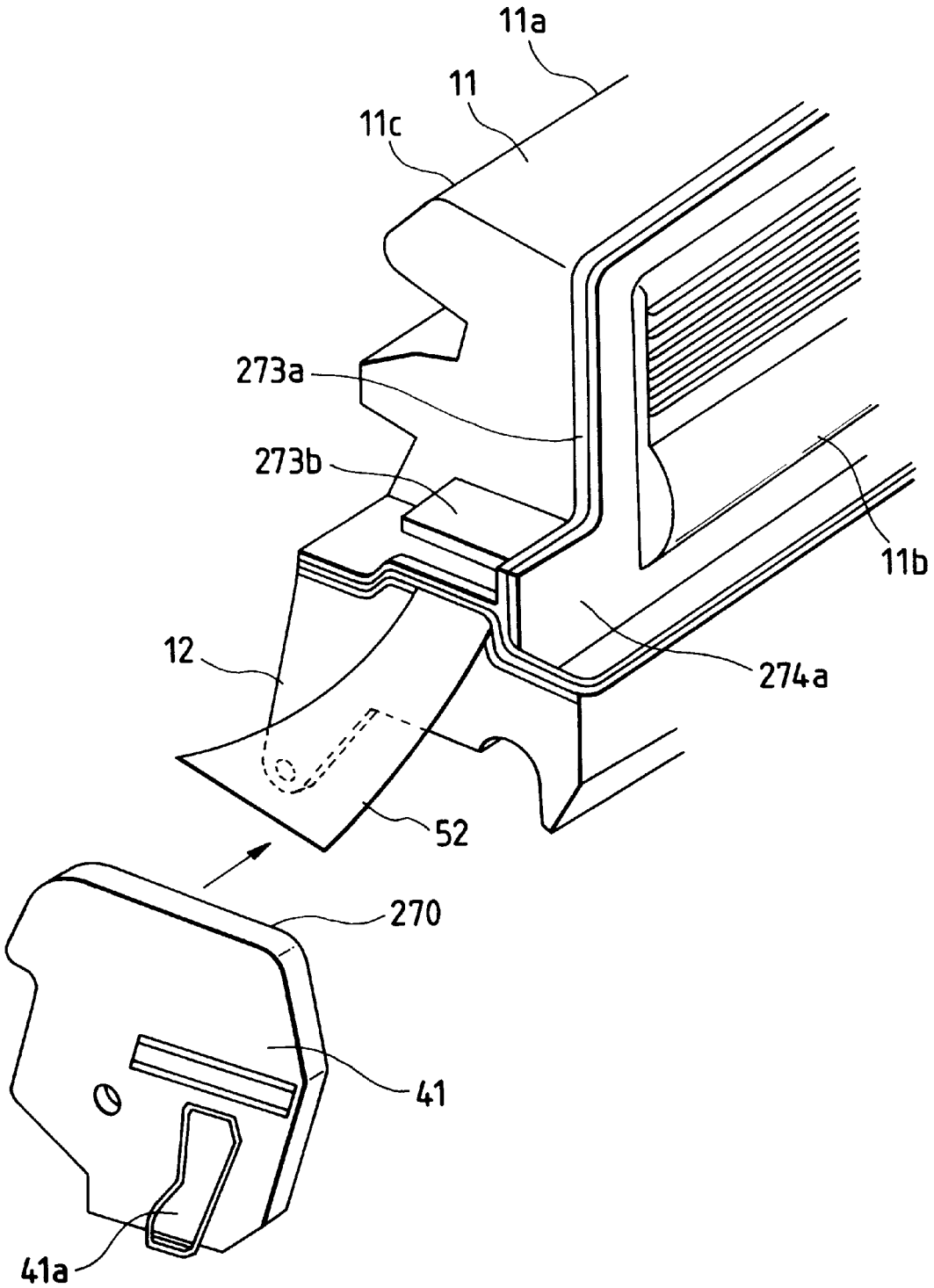
FIG. 61 is a perspective view of the developing-frame body and toner-frame body in the vicinity of a toner seal pulling section.
Figure 62:
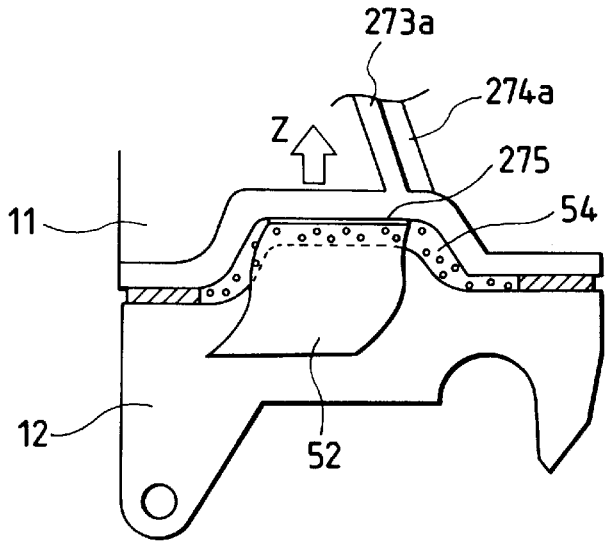
FIG. 62 is a side view of the developing-frame body and toner-frame body in the vicinity of the toner-seal pulling section.
Figure 65:
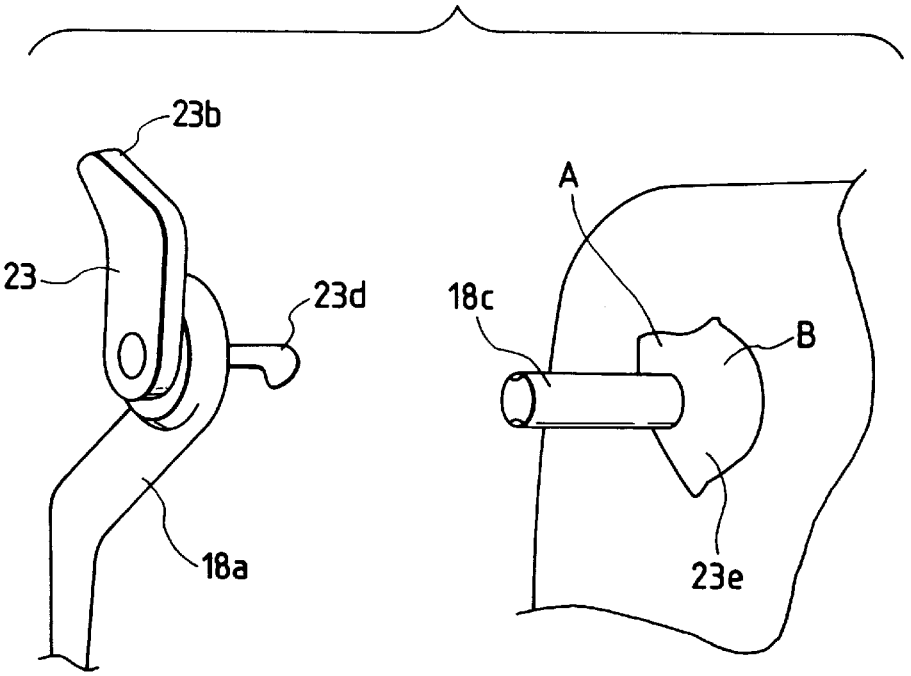
FIG. 65 is an exploded perspective view showing a stopper of a drum-shutter member.

To combine the toner-frame body 11 and the developing-frame body 12, the toner-frame body 11 and the developing-frame body 12 are independently assembled as assemblies. Thereafter, the cylindrical joggle 12*w*1 and square joggle 12*w*2 for positioning the developing-frame body 12 are inserted to the round hole 11*r* and the square hole 11*q* for positioning the toner-frame body 11. Moreover, the protrusions 12*v* of the developing-frame body 12 are engaged in the grooves 11*n* of the toner-frame body 11. Subsequently, when the toner-frame body 11 and the developing-frame body 12 are pressed against each other, the seal members 54, 56 are compressed, and protrusions 12*z*, formed along the short direction on both sides of the longitudinal direction of the flat face 12 of the developing-frame body 12 by integral molding to serve as spacers, come close to the surface 11*j* of the toner-frame body 11. After welding the developing-frame body 12 and the upper-frame body 11*a* by the seal member 54, the toner-frame body 11 receives a force in the direction z shown in FIG. 62 to expand an opening 275 disposed on the end of the longitudinal direction between the toner-frame body 11 and the developing-frame body 12 for passing the toner seal 52 during the pulling of the toner seal 52. However, since the upper-frame body 11*a* and the lower-frame body 11*b* welded to the upper-frame body 11*a* are provided with reinforcing ribs 273*a*, 274*a* and a reinforcing rib 273*b* (see FIG. 61) at right angles to the reinforcing rib 273*a* in the vicinity of the toner-seal opening 275, the opening 275 is prevented from expanding, thereby preventing seal non-uniformity for each product of seal member 54. Here, in order to allow the toner seal 52 to pass through, the protrusions 12*z* are disposed only on both sides of the width direction (short direction) of the toner seal 52.

(Backup of Developing Holder)

When the reinforcing ribs 273*a*, 274*a* in the vicinity of the toner-seal opening 275 of the upper-frame body 11*a* and the lower-frame body 11*b* welded to the upper frame body 11*a* abut on (back up) a back face 270 of the developing holder 41, the crack of the developing holder 41 at the time of drop impact and the falling of the developing holder 41 at the time of the attachment of the process cartridge B to the apparatus main body 14 are prevented. In this portion, a gap may be formed between the developing holder 41 and the reinforcing ribs 273*a*, 274*a* in a range in which the developing holder 41 is allowed to be deformed, and the gap between the back face 270 of the developing holder and the reinforcing ribs 273*a*, 274*a* is in the range of 0.5 mm to 3.0 mm, preferably about 1.0 mm.

In the above-described state, the toner-frame body 11 and the developing-frame body 12 are pressed to apply an ultrasonic vibration between the protrusion 12*v* and the groove 11*n*, and the triangular protrusion 12*v*1 is dissolved by friction heat and welded to the bottom of the groove 11*n*. Thereby, an edge 11*n*1 of the groove 11*n* of the toner-frame body 11 and the protrusion 12*z* for the spacer of the developing-frame body 12 are closely bonded to opposite members, respectively, and a space with a sealed peripheral edge can be formed between the surface 11*j* of the toner-frame body 11 and the opposite flat face 12*u* of the developing-frame body 12. The toner seal 52 is set in this space.

In order to feed the toner contained in the toner-frame body 11 to the developing-frame body 12, when the operator manually pulls an end 52*a* (FIG. 6) of the toner seal 52 protruding to the outside of the process cartridge B, the toner seal 52 is torn, and the opening 53*b* (11*i*) is opened, so that the toner can be fed to the developing-frame body 12 from the toner-frame body 11.

Since the opposite faces of the toner-frame body 11 and the developing-frame body 12 are constituted as described above, the toner seal 52 can smoothly be pulled from between both the frame bodies 11 and 12.

Moreover, during the ultrasonic welding of the toner-frame body 11 and the developing-frame body 12, friction heat is generated to melt the triangular protrusion 12*v*1. There is a possibility that the friction heat generates a thermal stress to thermally deform the toner-frame body 11 and the developing-frame body 12. However, according to the embodiment, the groove 11*n* of the toner-frame body 11 is engaged with the protrusion 12*v* of the developing-frame body 12 over substantially the entire range of the longitudinal direction, the vicinity of the welded portion is reinforced in the combined state of both the frame bodies 11, 12, and the thermal deformation by thermal stress is prevented from easily occurring.

Moreover, even if a longitudinal rib 12*v*2 of the developing-frame body 12 is welded to the developing-frame body 12 by the friction heat to produce burrs, the burrs can be prevented from appearing outside. Because, as shown in FIG. 32, the rib 12*v*2 disposed on the edge of the developing-frame body 12 in the longitudinal direction covers the edge 11*n*1 of the toner-frame body 11.

(Another Example of Opening/Closing Cover of Cartridge Attaching Portion of Device Main Body)

Figure 15:
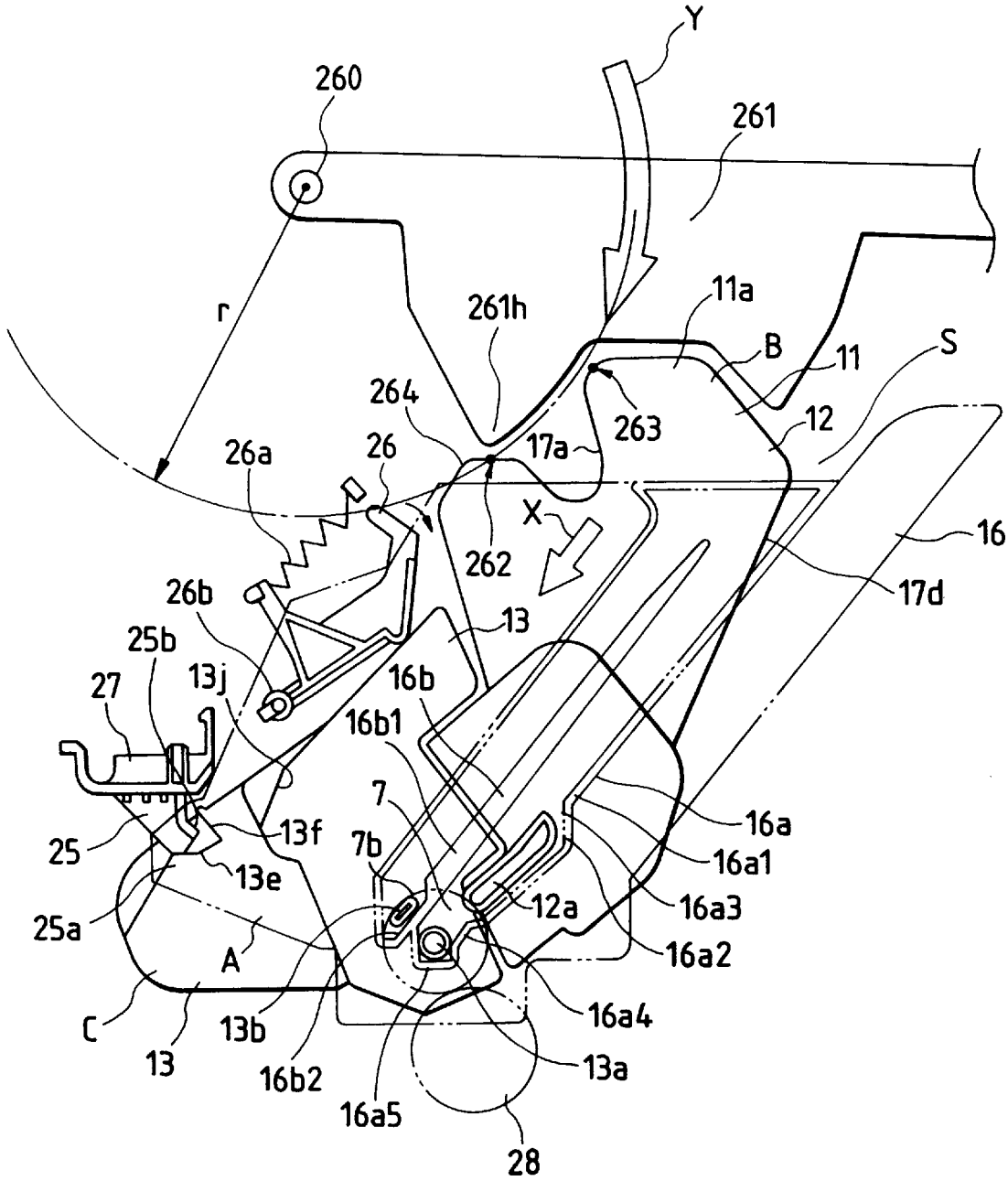
FIG. 15 is a side view showing the attaching/detaching process of the process cartridge shown in FIG. 3 to the apparatus main body.

Moreover, when the process cartridge B is mounted in the cartridge attachment space S as shown in FIG. 15, instead of the opening/closing member 35, a main-body cartridge cover 261 is disposed to make uniform and minimize a clearance in the vicinity of the handle portion 17 of the process cartridge B in the substantially entire area.

Specifically, each of points 262, 263 for determining the shape of the handle portion 17 of the upper-frame body 11*a* of the process cartridge B is set to have a radius r from a rotating center 260 on which the cartridge cover 261 is rotatably attached to the apparatus main body 14.

The shape of the handle portion 17 is determined from the points 262, 263 determined as described above. Thereby, as shown in FIGS. 4 and 7, except a part of a concave portion 17*b* opposite to a finger grip portion 17*a* gripped by fingers when the user attaches/detaches the process cartridge B to/from the apparatus main body 14, and a finger grip portion 17*e* having the ribs 11*c* (see FIG. 37), a clearance of the apparatus main body 14 and the process cartridge B is substantially uniform substantially in the entire area as viewed in radial directions from the center of the photosensitive drum 7. Additionally, the concave portion 17*b* is disposed on a flat face 17*d* of a wall opposite to the finger grip portion 17*a*.

Figure 60:
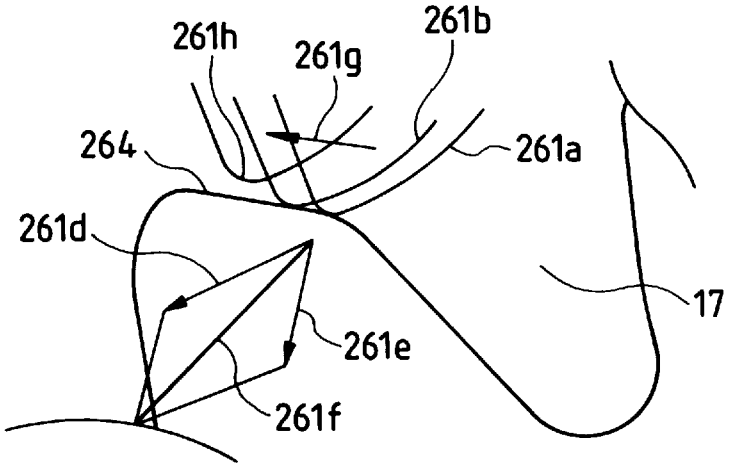
FIG. 60 is an enlarged view of a part of FIG. 15.

Moreover, as shown in FIGS. 15 and 60, the vicinity of the point 262 of the upper frame body 11*a* determined by the radius r from the rotating center 260 of the cartridge cover determined as described above is formed as a flat face (horizontal face) 264 so that in the process of attaching the process cartridge B to the cartridge attachment space S, the process cartridge B can smoothly move in its inserting direction X.

Specifically, since the flat face 264 is disposed, as shown in FIG. 60, which is a partially enlarged view of FIG. 15, a displacement 261*f* obtained by synthesizing a displacement 261*d* by a force received by the process cartridge B from a lower end 261*h* of the cartridge cover 261 and a displacement 261*e* of the process cartridge B determined based on the weight of the process cartridge B is a vector having substantially the same direction as the process-cartridge inserting direction shown by the arrow X. In this case, the main-body cartridge cover 261 moves with respect to the process-cartridge flat face 264 (relative movement) in a direction shown by an arrow 261*g*, which provides a vector parallel to the cartridge flat face 264.

Here, the cartridge flat face 264 is horizontal. Therefore, even when the process cartridge B is not in a normal position, the cartridge cover 261 moves to a point 261*b* from 261*a*, so that the process cartridge B can be pushed to the normal position by the main-body cartridge cover 261.

As described above, the upper-frame body 11*a* is integrally molded of the grooves 11*n*, the handle portion (recess portion) 17, the (finger grip portions 17*a*, 17*c*, 17*e*), the partition plates 11*p*, the toner-filling port 11*d*, the hole 11*e*1, round hole 11*r*, the square hole 11*q*, the attaching portion of the cover film plate 53, the toner-seal face 11*k*, joggles 11*o*, opening 11*i*, and the like. Moreover, the lower-frame body 11*b* is integrally molded of the ribs 11*c* and concave portion 11*g*. Additionally, examples of materials forming these upper and lower frame bodies 11*a*, 11*b* include plastic such as polystyrene, ABS resin (acrylonitrile-butadiene-styrene copolymer), polycarbonate, polyethylene, and polypropylene. Additionally, as shown in FIG. 7, for the finger grip portions 17*a*, 17*c*, either or both of opposite wall faces are corrugated to prevent the fingers on the handle portion 17 from easily moving so that the intervals of the concave portions change variously. Moreover, as shown in FIG. 3, the finger-grip portion 17*e* of the lower portion of the handle portion 17 comprises the ribs 11*c* as the longitudinal protrusions so as to prevent fingers from easily moving toward the end, and the portions of the ribs 11*c* gripped by the fingers are entirely formed into ridge shapes.

Figure 37:
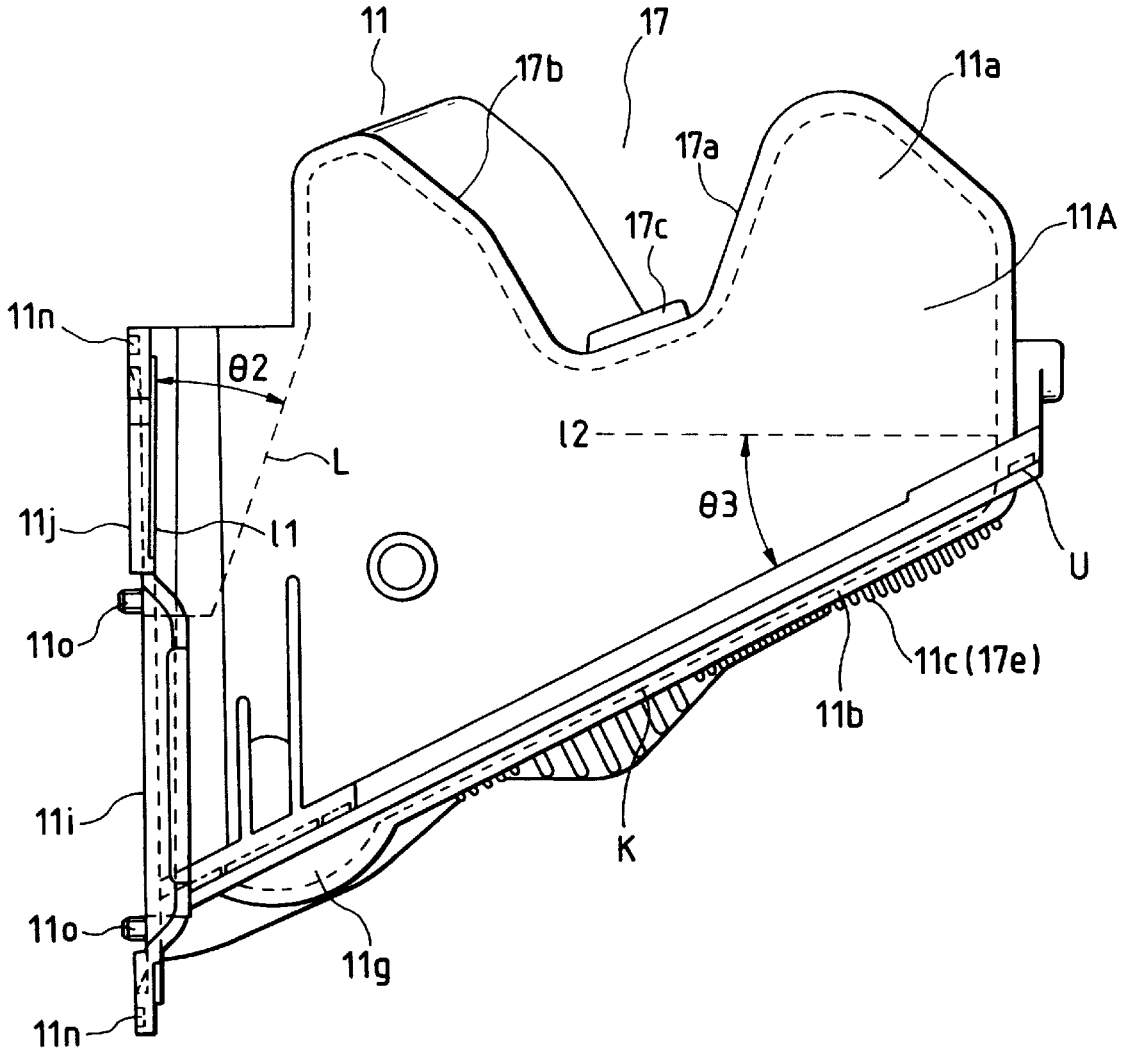
FIG. 37 is a side view of the toner frame body.

Here, FIG. 37 shows a sectional view of the toner-frame body 11 used in the present embodiment. FIG. 37 is a sectional view of the toner-frame in which the bonded surface (surface) 11*j* bonding the toner frame body 11 and developing-frame body 12 is disposed in vertical direction.

The toner-frame body 11 for use in the embodiment has two inclined faces K, L in order to efficiently drop one-component toner contained in the toner container 11A toward the opening 11*i*. Both the inclined faces K and L are disposed over the entire width in the longitudinal direction of the toner frame body 11. The inclined face L is disposed above the opening 11*i*, and the inclined face K is disposed on the inner side of the opening 11*i* (in the short direction of the toner frame body 11). Moreover, the inclined face L is formed on the upper-frame body 11*a*, and the inclined face K is constituted by the lower-frame body 11*b*. Additionally, the inclined face L has an angle θ2 of about 10 to 40 degrees (θ2 is set to about 24 degrees in the embodiment) to a vertical straight line 11 (surface 11*j* as the bonded face). Moreover, the inclined face K has an angle θ3 of about 20 to 40 degrees (θ3 is set to about 27 degrees in the embodiment) to a horizontal line 12 orthogonal to the straight line 11. In other words, in the embodiment, in connecting the lower-frame body 11*b* to the upper-frame body 11*a*, the shape of the upper-frame body 11*a* is defined so that the lower-frame body 11*b* can be installed with the above-described installation angles. Therefore, according to the embodiment, even the toner-storage section 11A, in which a large capacity (e.g., the toner with a weight of about 800 g or more) of toner is contained, can efficiently supply the toner toward the opening 11*i*.

The developing-frame body will next be described in more detail.

(Developing-Frame Body)

Figure 27:
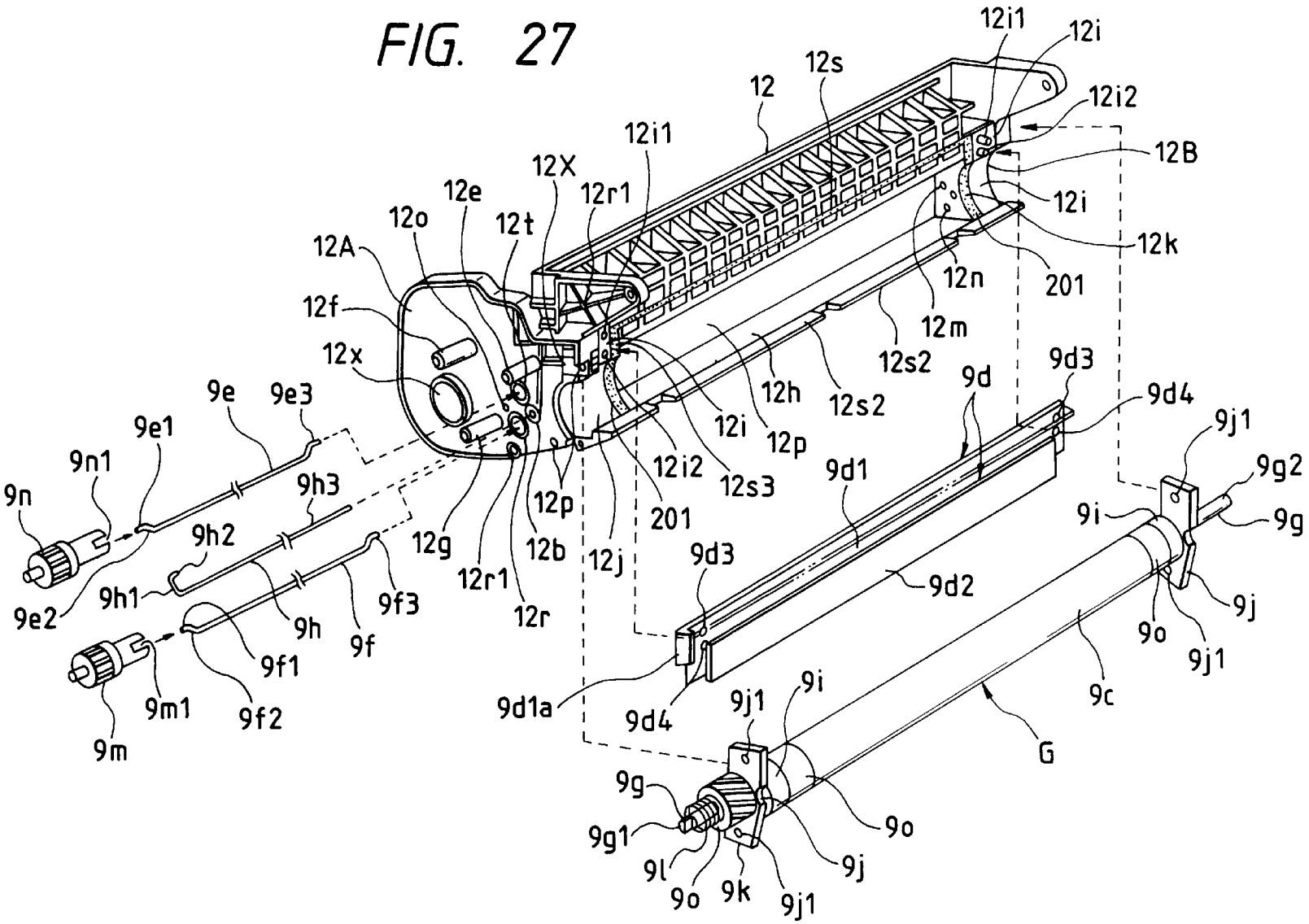
FIG. 27 is an exploded perspective view of the developing unit.
Figure 28:
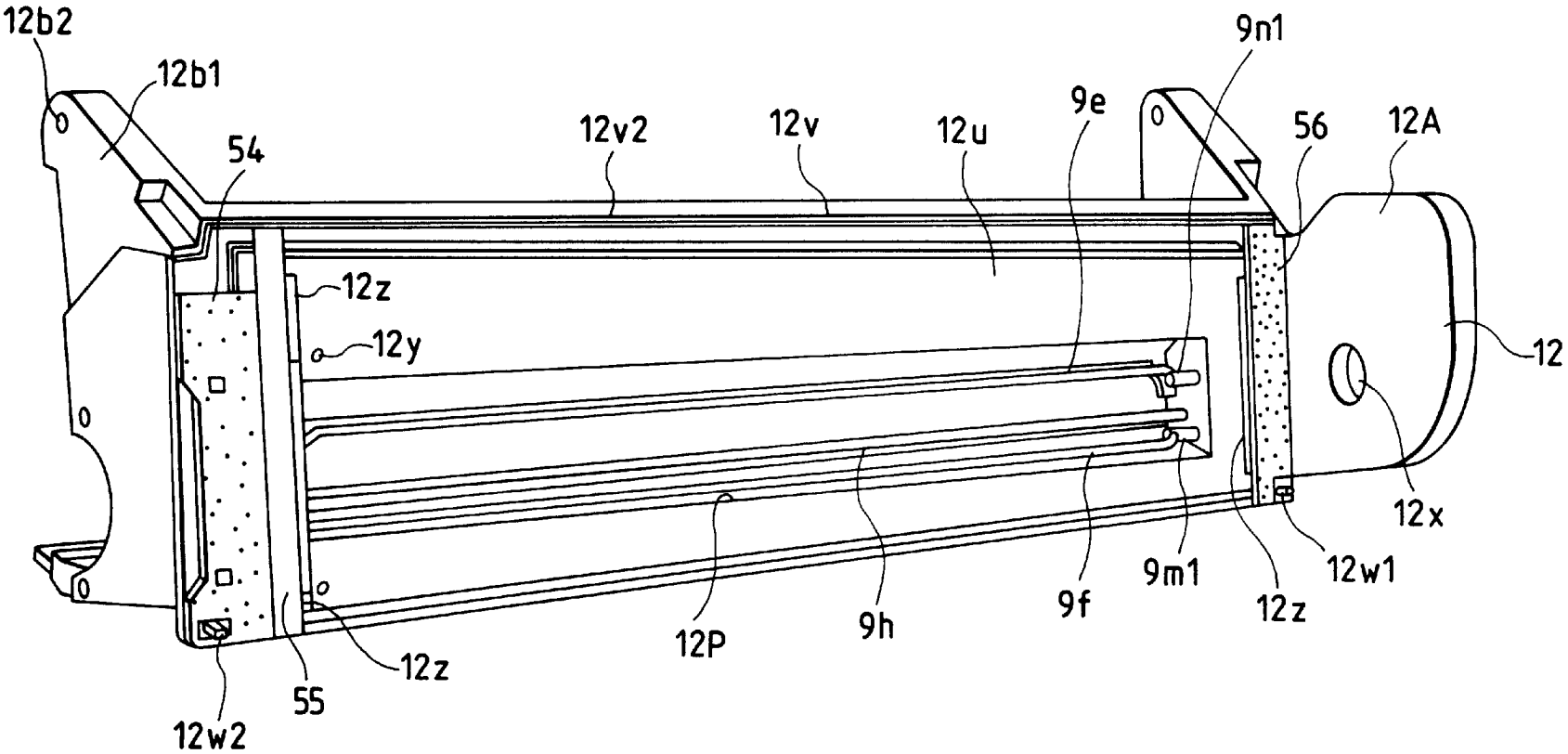
FIG. 28 is a perspective view of a developing frame body.
Figure 29:
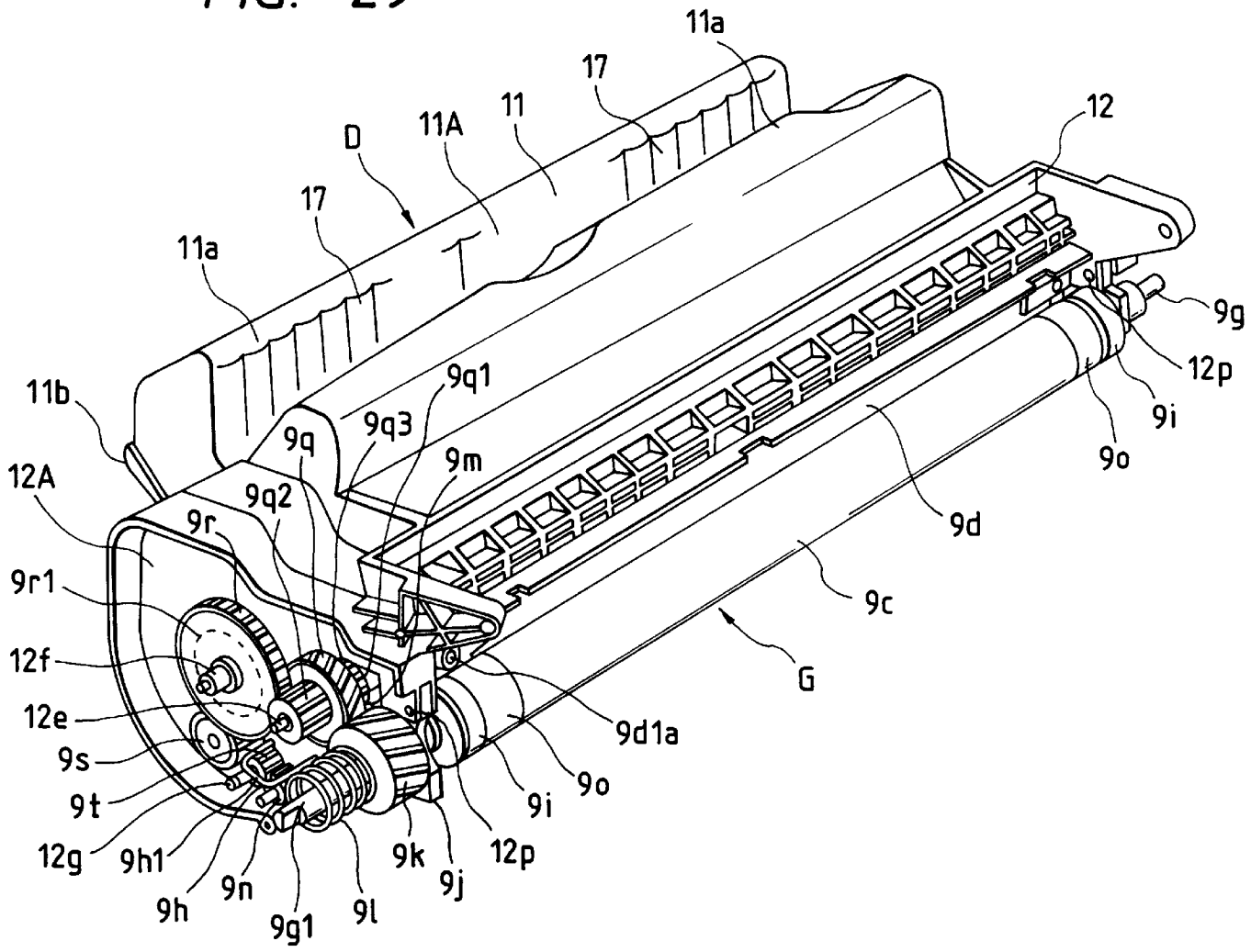
FIG. 29 is a perspective view showing that the developing holder of the developing unit is removed.

The developing-frame body 12 will be described with reference to FIGS. 3, 27, 28, 29 and 52. FIG. 27 is a perspective view showing that components are to be assembled to the developing-frame body 12, FIG. 28 is a perspective view as viewed from the welded face showing that the toner-agitating members 9*e*, 9*f* are incorporated in the developing-frame body 12, and FIG. 29 is a perspective view showing the developing unit without the developing holder.

As described above, the developing-frame body 12 is provided with the developing roller 9*c*, the developing blade 9*d*, toner-agitating members 9*e*, 9*f*, and the antenna rod 9*h* for detecting the toner residual amount.

Figure 52A:
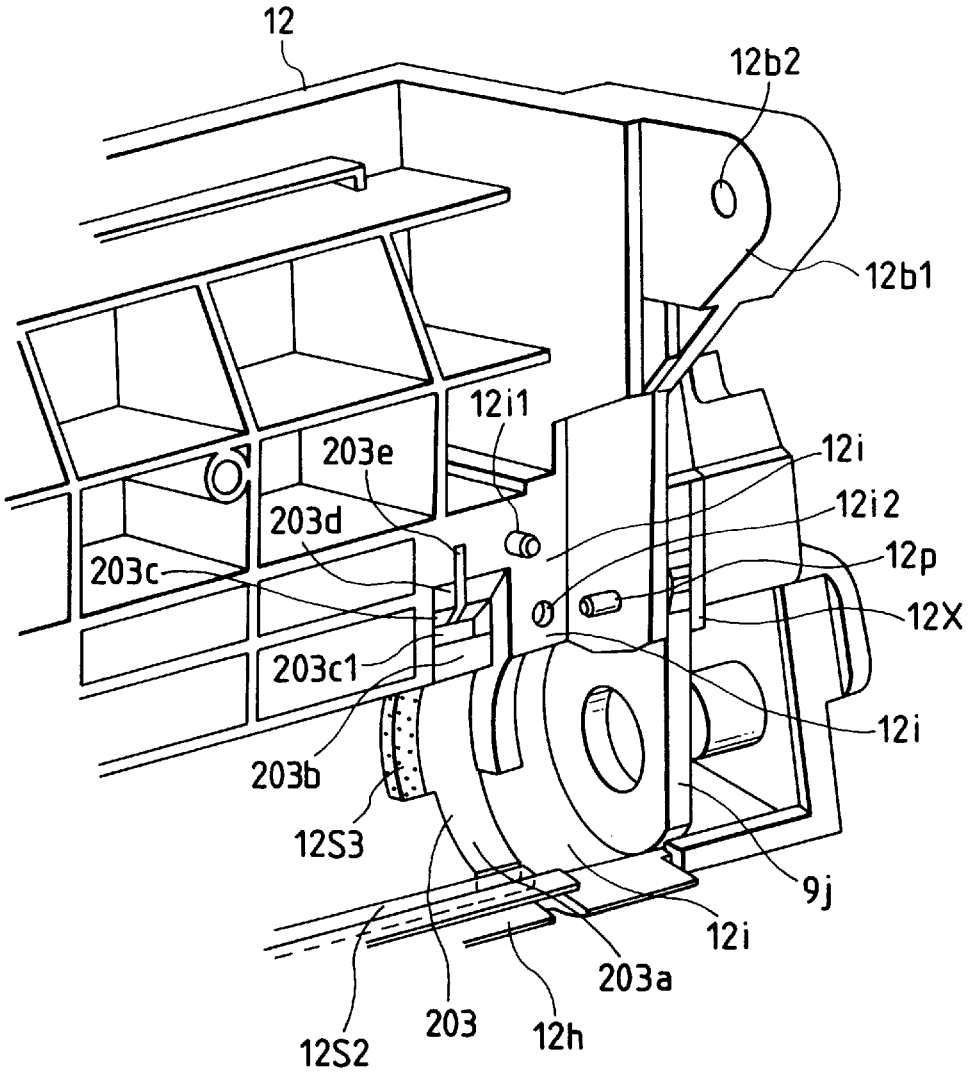
FIGS. 52A and 52B are perspective views of a magnetic-seal-member attaching section of the developing-frame body.
Figure 52B:
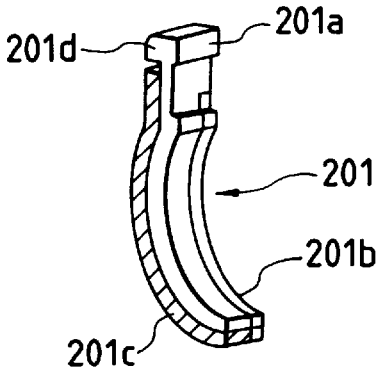

The developing blade 9*d* is formed by fixing a urethane rubber 9*d*2 to a sheet metal 9*d*1 with a thickness of about 1 to 2 mm by hot melt, double-coated tape, and the like, to regulate the toner amount on the peripheral face of the developing roller 9*c*. For blade-thrust flat faces 12*i* as blade-attachment portions disposed on both ends of the developing-frame body 12 in the longitudinal direction, a flatness is regulated to about 0.05 mm. The flat face 12*i* is provided with a joggle 12*i*1 and a screw hole 12*i*2. The joggles 12*i*1 are engaged in holes 9*d*3 formed in the sheet metal 9*d*1. Thereafter, the sheet metal 9*d*1 is fixed with screws to the flat face 12*i* via screw holes 9*d*4 formed in the sheet metal 9*d*1, and the screw holes 12*i*2. Additionally, an elastic seal member 12*s*, such as molt plane, is attached to the developing-frame body 12 above the sheet metal 9*d*1 along the longitudinal direction to prevent the invasion of toner. Furthermore, magnetic seal members 201 are attached to circular arc faces 12*j* formed continuously from both ends of the elastic seal member 12*s* along the developing roller 9*c*. Additionally, elastic seal members 201*c*, such as molt plane, are placed on the undersides of the magnetic seal members 201 to close gaps between the developing-frame body 12 and the magnetic seal members 201 (see FIGS. 52A and 52B). Moreover, as shown in FIG. 27, a thin elastic seal member 12*s*2 is attached to a lower-jaw portion 12*h* to contact the main line of the developing roller 9*c*. Furthermore, as shown in FIGS. 52A and 52B, an elastic seal member 12*s*3 for preventing the toner from leaking from the sides of the urethane rubber 9*d*2 is attached to the developing-frame body 12 adjacent to a circular arc groove 203*a* engaged with the magnetic seal member 201.

(Magnetic Seal)

Here, the magnetic seal member will be described with reference to FIGS. 52A and 52B, and FIGS. 53 to 55.

Figure 53:
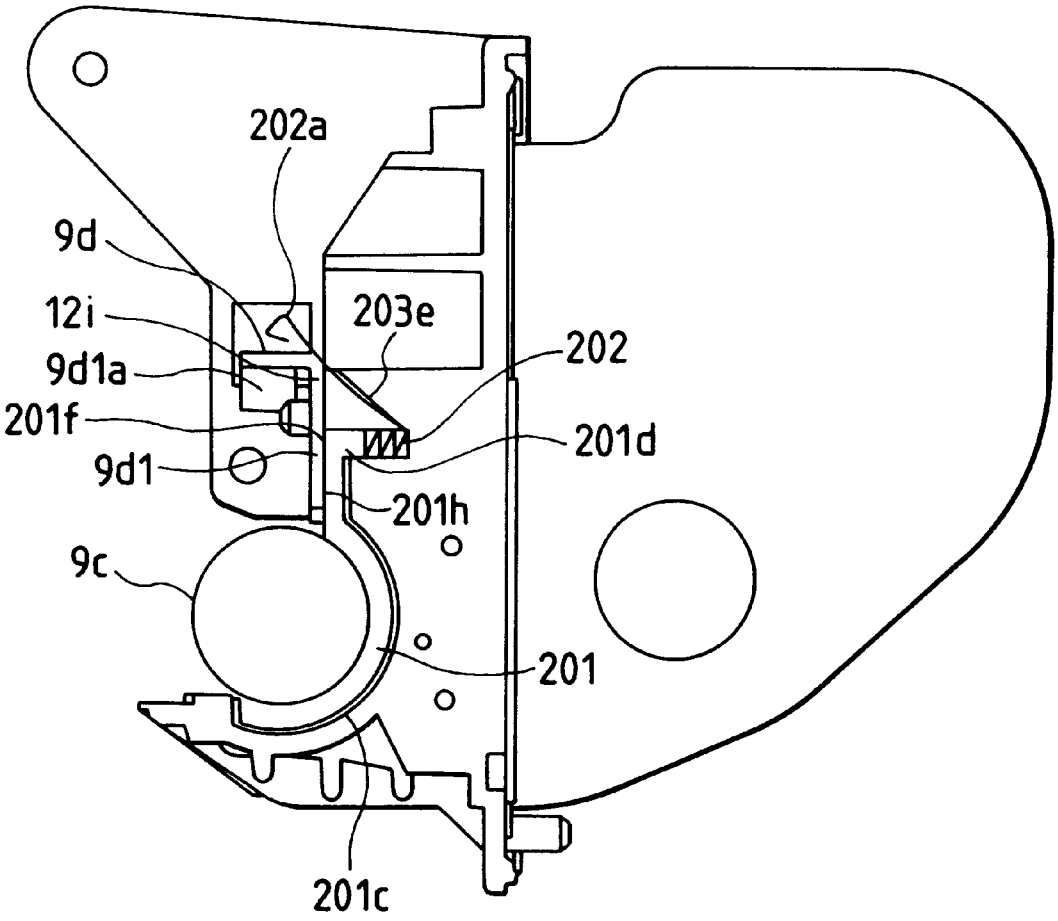
FIG. 53 is a longitudinal sectional view of the magnetic-seal attaching section of the developing-frame body.

The magnetic seal member 201 is constituted of a magnet 201*a* and a magnetic member 201*b*. The magnet is an injection molded material provided with a nylon binder containing magnetic powder of Nd—Fe—B and the magnetic member 201*b* is an iron material. The magnetic seal member 201 is attached to the developing-frame body 12 keeping a gap of 0.1 to 0.7 mm from the developing roller 9*c*. The magnetic seal member 201 has an arm portion 201*d* to be positioned by the developing-frame body 12. As shown in FIG. 53, the arm portion 201*d* is disposed opposite to an abutment face 201*f* on the sheet metal 9*d*1 of the developing blade 9*d*. The arm portion 201*d* is pushed to abut on the developing blade 9*d* by a spring member 202 disposed in a positioning groove 203*c* as the arm attachment portion of the developing frame body 12. The spring member 202 can securely place the magnetic seal member 201 in contact with the developing blade 9*d*. Moreover, since a contact portion 202*a* extended from the end of the spring member 202 not contacting the magnetic seal member 201 elastically abuts on the sheet metal portion 9*d*1 of the developing blade 9*d*, electricity can be conducted to the magnetic seal member 201 and the developing blade 9*d* in parallel. To place the contact portion 202*a* into contact with the sheet metal portion 9*d*1, a slit 203*e* is extended to the blade-thrust flat face 12*i* from the bottom of the positioning groove 203*c* so that the contact portion 202*a* can enter the slit (see FIGS. 52A and 52B). Thereby, the surface potentials of the developing roller 9*c*, the sheet metal portion 9*d*1 of the developing blade 9*d*, and the magnetic seal member 201 can stably be set to the same electric potential so that noise is prevented from being caused by a leak. The magnetic seal member may be a magnetic member facing the magnet in the developing roller.

(Magnetic Seal Assembly)

A method of assembling the magnetic seal member will briefly be described.

As shown in FIGS. 52A and 52B, the developing-frame body 12 is provided with an attaching groove 203 of the magnetic seal member 201, which is extended to the circular arc face 12*j* from the flat face 12*i*. The groove 203 is constituted of the circular arc groove 203*a* disposed along the circular arc of the circular arc face 12*j*, a linear groove 203*b* disposed along the flat face 12*i* in the vertical direction, and the positioning groove 203*c* of the depth direction in which the arm portion 201*d* of the magnetic seal member 201 is fitted. An entrance portion 203*d* of the attaching groove 203 of the magnetic seal member 201 is formed like a chamfered inclined portion, and the arm portion 201*d* of the magnetic seal member 201 slides along the inclined portion when the attaching operation is performed. The arm portion 201*d* is engaged in the positioning groove 203*c* on the inner side of the inclined portion. The positioning groove 203*c* has a square section in which the arm portion 201*d* is fitted on its inner side.

Figure 54:
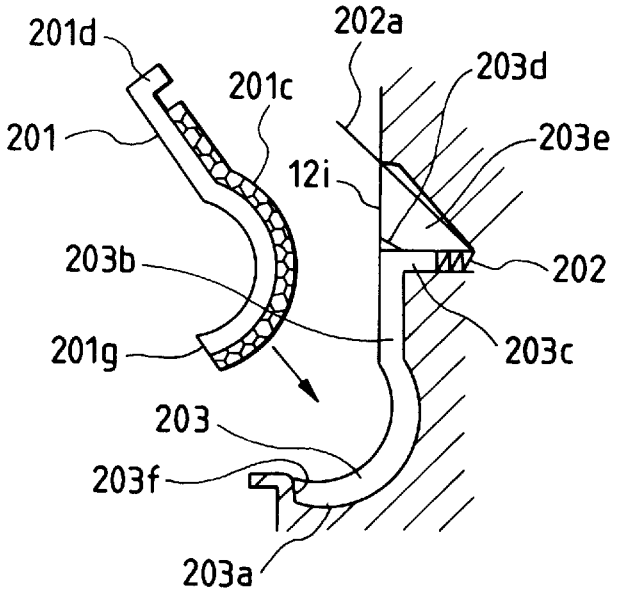
FIG. 54 is a longitudinal sectional view showing a process of attaching the magnetic-seal member to the developing-frame body.
Figure 55:
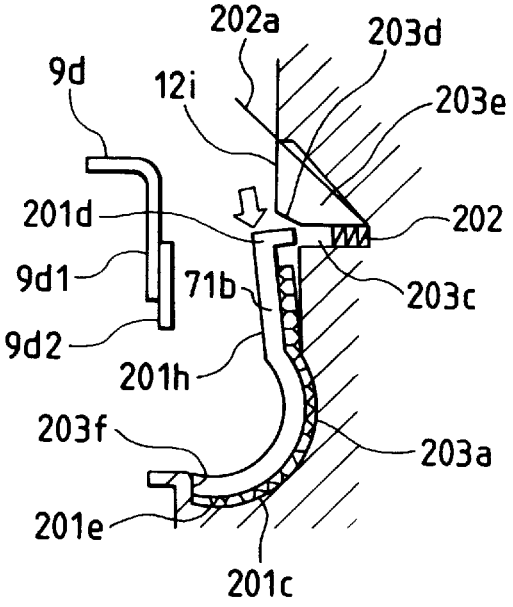
FIG. 55 is a longitudinal sectional view showing the process of attaching the magnetic-seal member to the developing-frame body.

After the spring member 202 is engaged in the positioning groove 203*c* and the slit 203*e* as shown in FIG. 54, the magnetic seal member 201 is brought into the magnetic-seal-member attaching groove 203 of the developing-frame body 12 as shown by an arrow. As shown in FIG. 55, the semicircular portion of the magnetic seal member 201 is engaged in the circular arc groove 203*a*, and the arm portion 201*d* is lightly pushed obliquely toward the back in an arrow direction so that a lower-end face 201*g* of the magnetic seal member 201 is aligned onto a lower-end face 203*f* of the attaching groove 203 of the developing-frame body 12. Then, a lower portion 201*e* of the elastic seal member 201*c* disposed along the back face of the magnetic seal member 201 is compressed, and the tip end of the arm portion 201*d* is guided to the entrance portion 203*d* and engaged in this positioning groove 203*c*. In the condition, the pressure for pushing up the magnetic seal member 201 by the spring member 202 inserted into the positioning groove 203*c* is weak, and the abutment face of the magnetic seal member 201 with the sheet metal 9*d*1 of the developing blade 9*d* is floated above the thrust flat face 12*i* of the developing blade 9*d*. By attaching the developing blade 9*d* to the developing-frame body 12 in the condition, as shown in FIG. 53, the magnetic-seal member 201 is positioned on the developing-frame body 12 while the abutment face 201*f* of the magnetic seal member 201 is in contact with the developing blade 9*d*. The positioning portion of the magnetic seal member 201 to the developing-frame body 12 (toner-frame body 11 as a developer container and a part of the developer container as an integral part of the developing-frame body 12) is disposed on the side opposite to the abutment face of the developing blade 9*d* as the developer-regulating member.

Since the magnetic seal member is constituted as described above, the position of the magnetic-seal member is accurately determined. Additionally, since the positioning portion of the magnetic seal member is pressed against the positioning portion of the developer-regulating member by the spring member 202 as the elastic member, the position of the magnetic-seal member to the developing-frame body is maintained in a stable state, and there is little influence of vibration or the like.

Moreover, since the developing-blade sheet metal 9*d*1 as the electric conductive portion of the developer-regulating member abuts on the elastic member, a developing bias circuit is doubled in this portion, thereby enhancing the reliability.

Since the back portion of the positioning portion of the magnetic seal member is pushed by the elastic member, the elastic member and the magnetic-seal member are pushed into the attaching groove of the developing-frame body, and pressed by the developer-regulating member. Since the developer-regulating member is pressed/fixed in the condition, the magnetic-seal member is easily attached.

In this case, since the elastic member is provided with the portion that abuts on the electric conductive portion of the developer-regulating member, the developing-bias circuit can be parallel in this portion so that the reliability is enhanced.

(Developing Blade)

One end of the longitudinal direction of the sheet metal 9*d*1 of the developing blade 9*d* is bent substantially by 90° to form a bent portion 9*d*1*a* (see FIGS. 27, 53). The bent portion 9*d*1*a* contacts a leaf-spring portion 121*a* (see FIG. 24) of a developing-bias contact 121 held by the developing holder 40 described later to set the sheet metal 9*d*1 to the same potential as that of the developing roller 9*c*. This prevents the electrostatic capacity from being influenced by the sheet metal 9*d*1 or irregularly changing, because the toner amount is detected by the change of the electrostatic capacity between the antenna rod 9*h* for detecting the toner residual amount and the developing roller 9*c*.

(Developing Roller)

A developing roller unit G will next be described.

As shown in FIG. 27, the developing roller unit G if formed as a unit by (1) the developing roller 9*c*, (2) a spacer roller 9*i*, which has the same center as that of the developing roller 9*c* and a larger diameter than that of developing roller 9*c* so that the distance between the peripheral faces of the developing roller 9*c* and the photosensitive drum 7 is set to be constant, (3) a developing-roller bearing 9*j* for positioning the developing roller 9*c* in the developing-frame body 12, (4) a developing-roller gear 9*k* (helical gear) for receiving a drive from the helical gear 7*b* disposed on the photosensitive drum 7 to rotate the developing roller 9*c*, (5) C-shaped stopper 9*o* as a shaft stopper ring for keeping the developing roller gear 9*k* in the predetermined position of the developing roller 9*c*, (6) a developing-coil spring contact 9*l* whose one end is engaged with the developing-roller gear 9*k* on the end of the developing roller 9*c*, and (7) a magnet 9*g* disposed inside the developing roller 9*c* for attaching the toner onto the peripheral face of the developing roller 9*c*.

For the developing-roller unit G, two holes 9*j*1 formed in the developing-roller bearing 9*j* are aligned with holes 12*p* formed on each of both ends of the longitudinal direction of the developing frame body 12, and pins disposed on the developing holder 40 described later are inserted to the holes 9*j*1, 12*p*. Subsequently, by screwing and fixing the developing holder 40 to the developing-frame body 12, the developing-roller unit G is attached to a developing-roller attaching section 12X of the developing-frame body 12. Additionally, grooves to fit with the developing-roller bearings 9*j* are formed above the attaching sections 12X on both ends of the longitudinal direction (see FIGS. 52A and 52B).

(Developing Roller Bearing)

Figure 58:
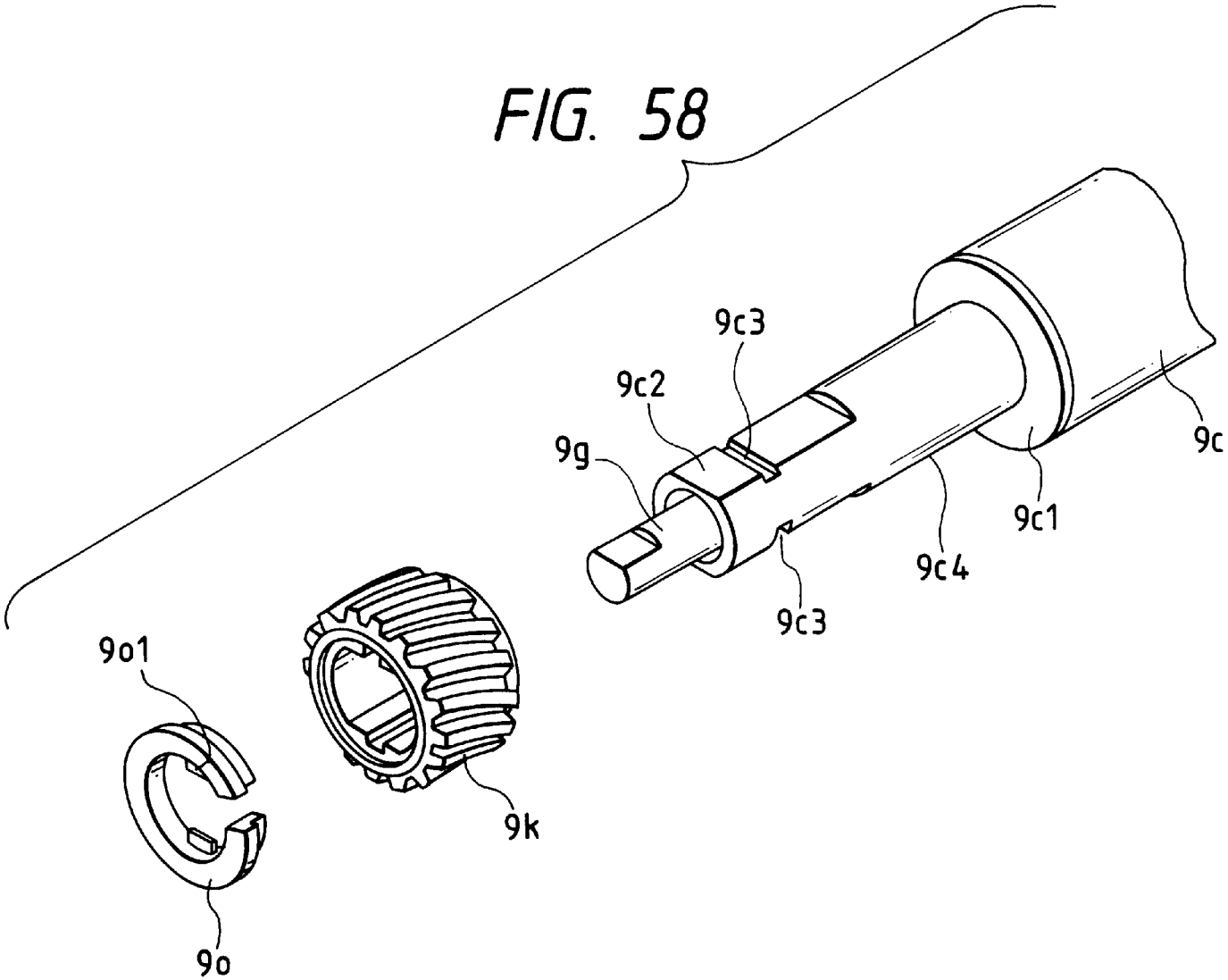
FIG. 58 is an exploded perspective view of a developing roller unit.

As shown in FIG. 58, the developing-roller bearing 9*j* is engaged with a journal 9*c*4 of a developing-roller flange 9*c*1 fixed to the end of the developing roller 9*c*, and a double-face width portion 9*c*2 disposed adjacent to the outside of the developing-roller bearing 9*j* is engaged with the developing-roller gear 9*k*, which has a hole having the same section as that of the double-face width portion 9*c*2, so that the movement of the axial direction is stopped by the C-shaped stopper 9*o*.

Figure 56:
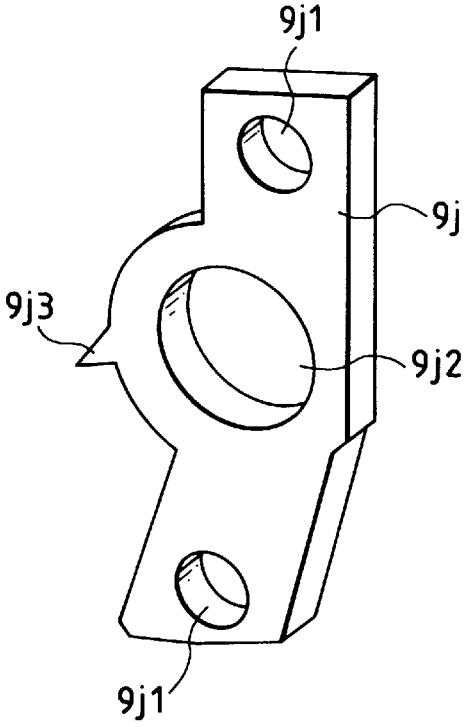
FIG. 56 is a perspective view of a developing roller bearing.
Figure 57:
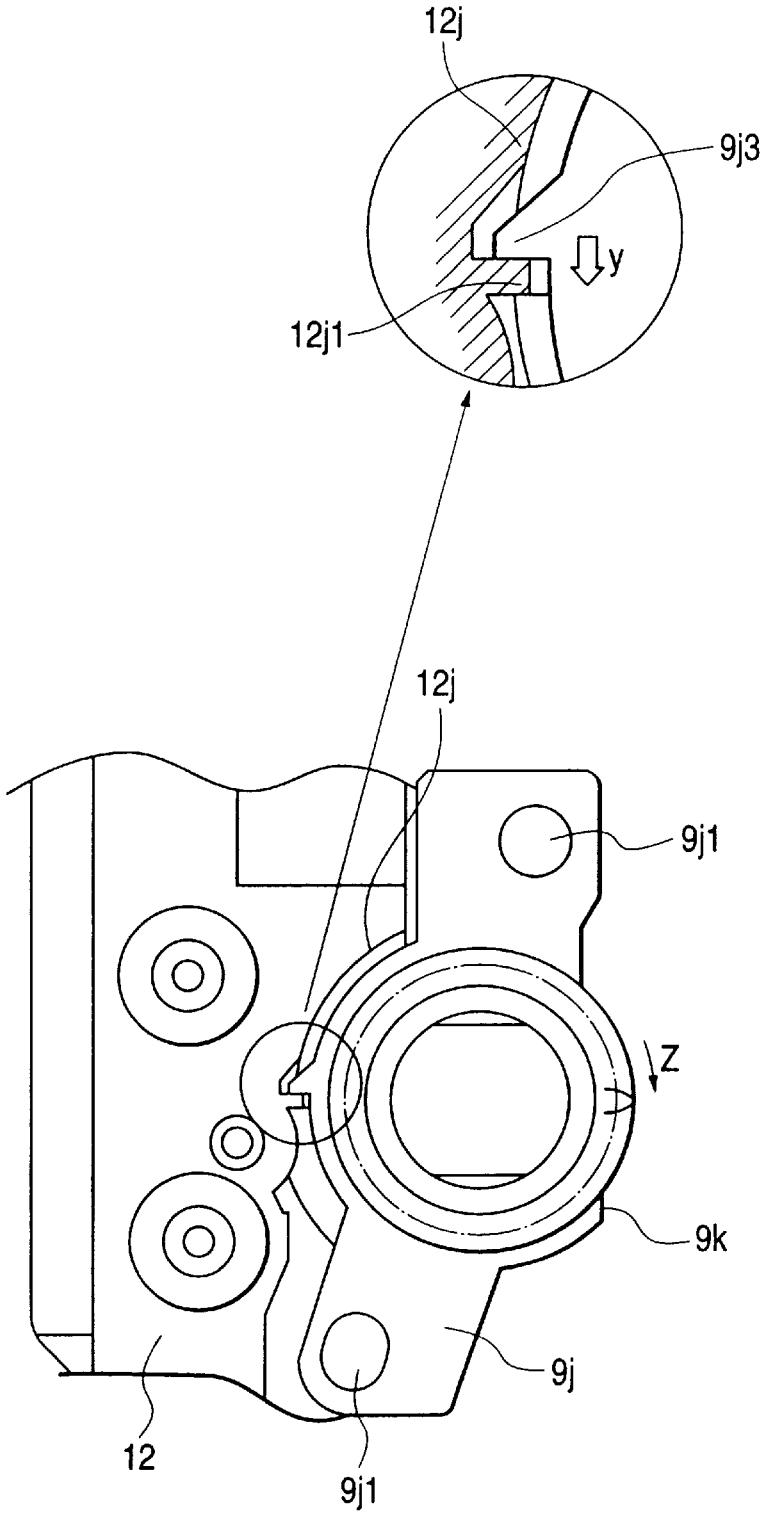
FIG. 57 is a side view of the developing roller bearing.

The developing-roller bearing will next be described with reference to FIGS. 56 and 57.

Figure 23:
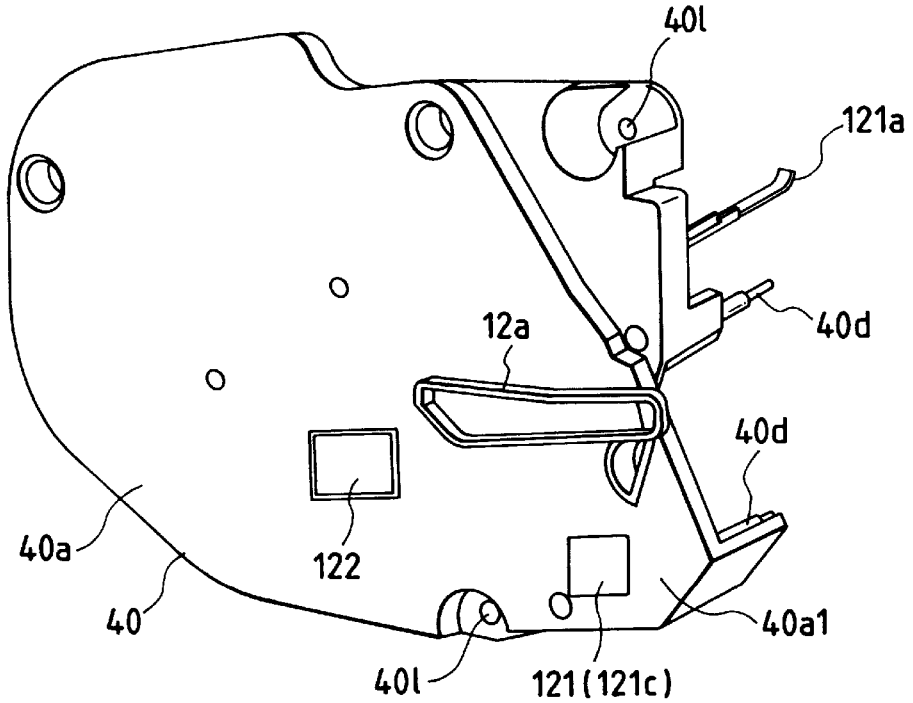
FIG. 23 is an appearance perspective view of a developing holder.
Figure 24:
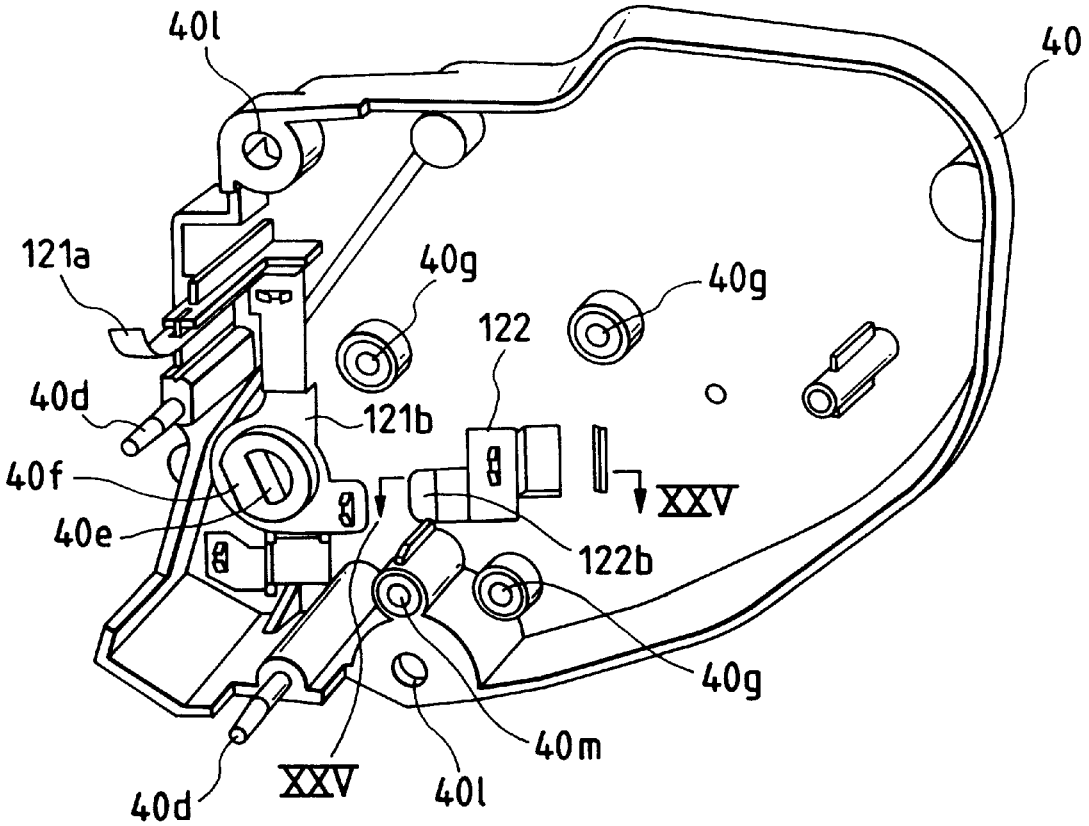
FIG. 24 is a perspective view of the inside of the developing holder.

The developing-roller bearing 9*j* is provided with a hole 9*j*2 engaged with the journal 9*c*4 for rotatably supporting the developing roller 9*c*, and the holes 9*j*1 to which pins 40*d* of the developing holder 40 shown in FIGS. 23, 24 are inserted to fix the roller to the developing-frame body 12. Moreover, when the developing roller gear 9*k* receives the drive (arrow z of FIG. 57) from the photosensitive drum gear 7*b*, the developing roller 9*c* drops in the direction of arrow y shown in FIG. 57. In order to prevent the dropping of the developing roller 9*c* and secure the gap between the developing roller 9*c* and the magnetic-seal member 201, the developing-roller bearing 9*j* is provided with a rib 9*j*3 as an engaging portion protruding toward the circular arc face 12*j* of the developing-frame body 12 along the developing roller 9*c*. The rib 9*j*3 is disposed in the position opposite to the position where the roller gear 9*k* receives the drive force from the drum gear 7*b* with respect to the rotating center of the developing roller 9*c*, which is effective for preventing the dropping of the roller 9*c*. During driving, the rib 9*j*3 abuts on a rib 12*j*1 disposed on the circular arc face 12*j* of the developing-frame body 12 along the developing roller 9*c*, and the rib 12*j*1 accepts the developing roller bearing 9*j* so that the dropping of the developing roller 9*c* can be reduced. When the contact faces of the ribs 12*j*1, 9*j*3 are substantially horizontal faces, the plane including the contact faces includes the axial line of the developing roller 9*c* or passes near the axial line. Additionally, the gear load generated by setting the action line of the meshing of developing-roller gear 9*k* and drum gear 7*b* to be at right angles to the contact faces is supported by the rib 12*j*1 without producing any transverse load (load crossing the action line), and only the rotating force can substantially be transmitted to the developing roller gear 9*k* from the drum gear 7*b*. Of course, the contact faces of the ribs 12*j*1, 9*j*3 do not have to be at right angles to the action line of meshing of drum gear 7*b* and developing-roller gear 9*k*. When they are not at right angles, the load is supported by the pins 40*d* of developing holder 40 engaged in the holes 9*j*1, and the displacement by transverse load components can be handled. The pins 40*d* are molded of resin integrally with the holder 40.

The above-described constitution is substantially on the line which connects the meshing point (pitch point) of the developing-roller gear 9*k* with the drum gear 7*b*, and the center of the developing roller 9*c*, when viewed from the axial center direction of the developing roller 9*c*, and the rib 9*j*3 as a part of the developing-roller bearing 9*j* is engaged with the rib 12*j*1 of the developing-frame body 12 on the side opposite to the meshing point via the center of the developing roller 9*c*.

(C-shaped Stopper)

Figure 59:
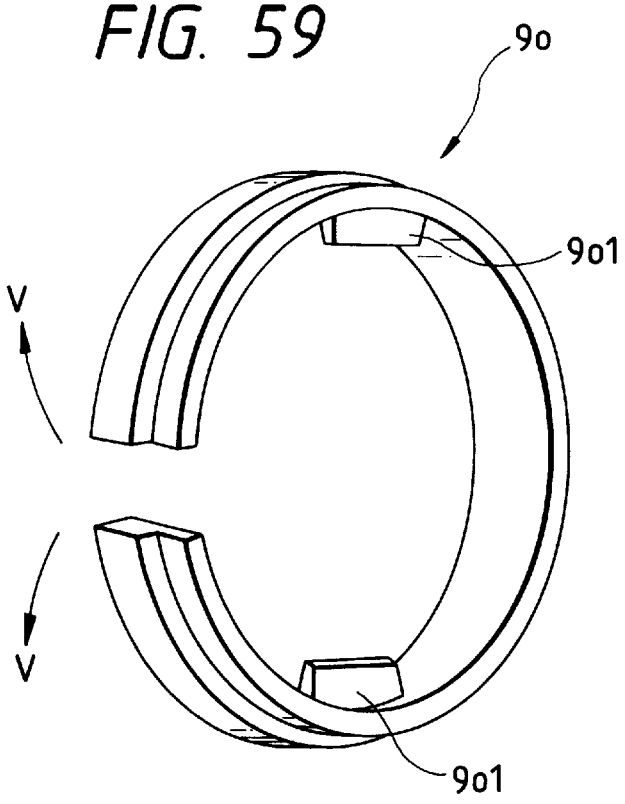
FIG. 59 is a perspective view of a shaft stop ring.

The C-shaped stopper 9*o* as the shaft-stop ring will be described. As shown in FIGS. 58 and 59, the C-shaped stopper 9*o* has an annular shape and two clicks 9*o*1 for engaging with the developing-roller flange 9*c*1. The clicks 9*o*1 are engaged in grooves 9*c*3 which are disposed orthogonal to the developing roller 9*c* in the double-face width portion 9*c*2 disposed on the developing-roller flange 9*c*1, in order to stop the developing-roller gear 9*k* from turning. This engagement prevents the developing-roller gear 9*k* from being moved or detached in the longitudinal direction. Here, the C-shaped stopper 9*o* has a C shape, and can be expanded in directions v of FIG. 59, so that when the C-shaped stopper 9*o* is attached to the developing roller flange 9*c*1, the force applied to the clicks 9*o*1 can be reduced and the C-shaped stopper 9*o* can easily be assembled. As the material of the C-shaped stopper 9*o*, POM, nylon resin, and the like may be molded.

As described above, in the embodiment, to attach the developing roller 9*c* to the developing-frame body 12, first the developing-roller unit G is assembled. Subsequently, the assembled developing-roller unit G is attached to the developing-frame body 12 using the developing holders 40, 41 (the developing holder 41 has pins similar to the pins 40*d* of the developing holder 40). Thereby, the assembling efficiency is enhanced, as compared with when the developing roller 9*c* alone is attached to the developing-frame body 12.

Additionally, the assembling of the developing roller unit G is performed in the following process (see FIG. 27). First, the spacer rollers 9*i* are attached to both ends of the developing roller 9*c*, and the developing-roller bearings 9*j* are attached to the outside of the rollers. Subsequently, the developing roller gear 9*k* is attached to the outside of the bearing 9*j* on one end of the developing roller 9*c*, the C-shaped stoppers 9*o* are attached for preventing dislocation, and the developing coil spring contact 9*l* is attached to the outside of the stopper so that the developing-coil spring contact 9*l* contacts the developing-roller gear 9*k*. One end 9*g*1 formed by D-cutting the tip end of the magnet 9*g* is protruded from one end with the developing-roller gear 9*k* of the developing roller 9*c* attached thereto. Moreover, the other end 9*g*2 of the cylindrical magnet 9*g* is protruded from the other end of the developing roller 9*c*. The developing-roller unit G is constituted in this manner.

(Toner Residual Amount Detection)

The antenna rod 9*h* for detecting the toner residual amount will next be described. As shown in FIG. 27, one end of the antenna rod 9*h* is bent in a U-shape. This "U-shape" portion 9*h*1 contacts a toner-detecting contact 122 attached to the developing holder 40 (see FIG. 24) described later, and is electrically connected. To attach the antenna rod 9*h* to the developing-frame body 12, first, a tip end 9*h*3 of the antenna rod 9*h* is passed through a through hole 12*b* formed in a side plate 12A of the developing-frame body 12 and inserted to the inside. Then, the tip end 9*h*3 is supported by a bag hole 12*k* formed in the opposite side face of the developing frame body 12. The antenna rod 9*h* is thus positioned and supported by the through hole 12*b*, and the bag hole 12*k*.

Moreover, a terminal end 9*h*2 of the "U-shaped" portion 9*h*1 is inserted to a bag hole 12*o* of the developing-frame body 12 with a depth of about 5 mm, to position the antenna rod 9*h* in the axial direction. Furthermore, this enhances the rigidity of the "Ushaped" portion 9*h*1 as the contact portion that contacts the toner-detecting contact 122 described later. Moreover, the bag hole 12*k* to engage with the tip end 9*h*3 of the antenna rod 9*h* has a bag-hole constitution to prevent the invasion of toner.

(Toner-Agitating Member)

The toner-agitating members 9*e*, 9*f* will next be described. As shown in FIG. 27, the toner-agitating members 9*e*, 9*f* have crank shapes to agitate the toner when rotating. Additionally, the members form a path via which the toner contained in the toner container 11A reaches the developing roller 9*c*, and are provided in the vicinity of the developing roller 9*c* and the antenna rod 9*h*. Moreover, the toner-agitating members 9*e*, 9*f* are mutually arranged in the vertical direction.

First, tip ends 9*e*3, 9*f*3 of the toner-agitating members 9*e*, 9*f* are inserted via through holes 12*t*, 12*r* formed in the side plate 12A of the developing-frame body 12 on the same side as the side on which the antenna rod 9*h* is assembled. Subsequently, the tip ends 9*e*3, 9*f*3 are engaged in bag holes 12*m*, 12*n* formed in a side plate 12B on the other side of the side plate 12A of the developing-frame body 12. After inserting the toner-agitating members 9*e*, 9*f*, agitating gears 9*n*, 9*m* are inserted into the through holes 12*t*, 12*r*. In this case, notches 9*n*1, 9*m*1 disposed in the axial direction on the tip ends of the gears 9*n*, 9*m* are engaged with crank arms 9*e*2, 9*f*2 of the toner-agitating members 9*e*, 9*f*. Furthermore, journals 9*e*1, 9*f*1 of the toner-agitating members 9*e*, 9*f* are engaged in center holes (not shown) formed on the inner side of the notches 9*n*1, 9*m*1 formed in the gears 9*n*, 9*m*, so that the toner-agitating members 9*e*, 9*f* are supported in the developing-frame body 12.

Here, when the toner-frame body 11 and the developing-frame body 12 are combined, the side plate 12A of the developing-frame body 12 via which the antenna rod 9*h* and toner-agitating members 9*e*, 9*f* are inserted is extended to the side face of the toner frame body 11 to face and cover the toner cap 11*f* disposed on the upper-frame body 11*a* (see FIG. 31). The side plate 12A is also provided with an engagement hole 12*x*, in which a toner-feeding gear 9*s* (see FIG. 29) for transmitting the drive force to the toner feeding member 9*b* is rotatably engaged. The toner-feeding gear 9*s* is engaged with the end of the toner-feeding member 9*b*, and connected to the coupling member lie (see FIGS. 30, 31) rotatably supported on the upper-frame body 11*a*, to transmit the drive force to the toner-feeding member 9*b*.

The transmission of the drive force will next be described.

(Drive Transmitting Device)

Figure 36:
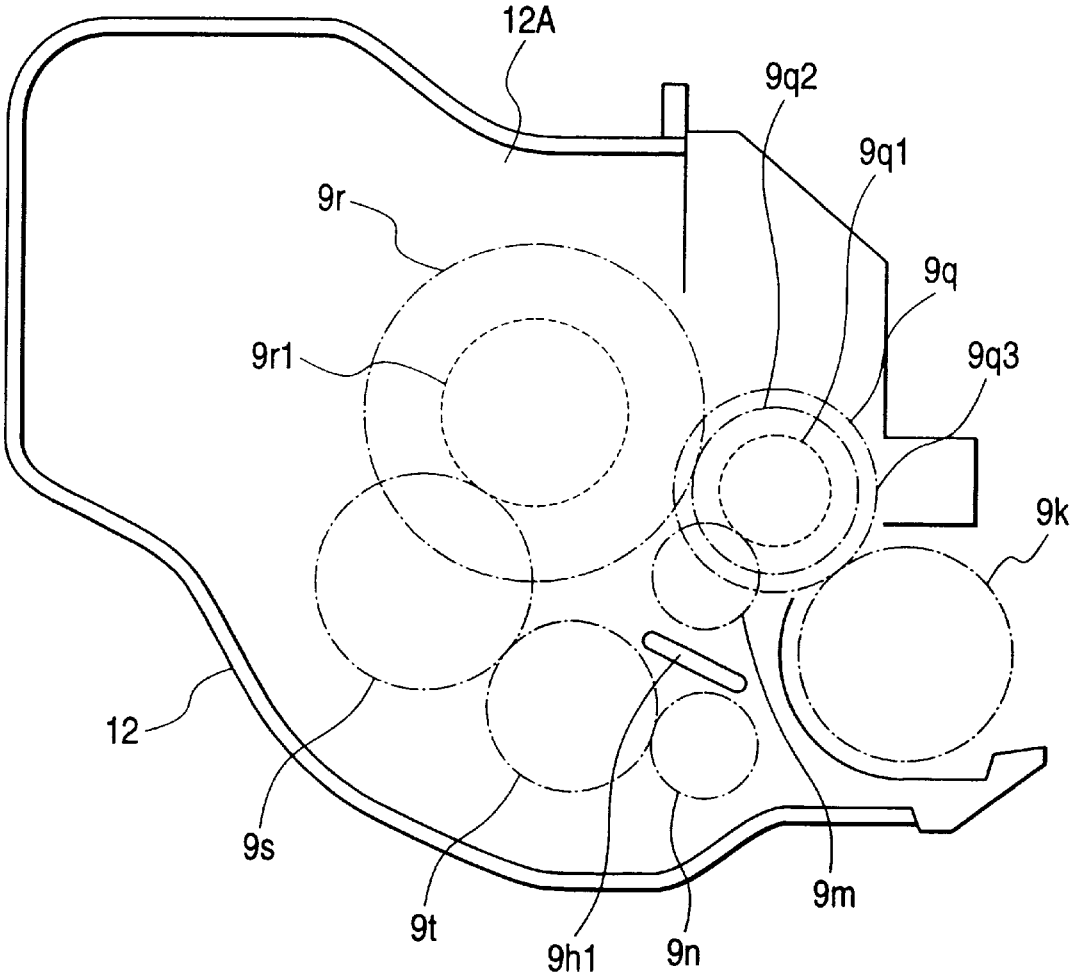
FIG. 36 is a side view showing a gear train of FIG. 29.

As shown in FIGS. 29 and 36, the agitating gears 9*m*, 9*n* and the toner-feeding gear 9*s* receive the drive force from the developing-roller gear 9*k*. First, the drive force is transmitted to the agitating gear 9*m* via a small gear 9*q*1 of an idler gear 9*q* as a stepped gear. Upon receiving the drive force, the agitating member 9*m* rotates. Additionally, for the idler gear 9*q*, a large gear 9*q*3 meshes with the developing-roller gear 9*k* to receive the drive force transmitted from the developing-roller gear 9*k*. Furthermore, the drive force is transmitted to an idler gear 9*r* as a stepped gear from an intermediate gear 9*q*2 of the idler gear 9*q*. Furthermore, the drive force is transmitted to the toner-feeding gear 9*s* via a small gear 9*r*1 of the idler gear 9*r*, to rotate the toner-feeding member 9*b*. Moreover, the drive force is transmitted to the agitating gear 9*n* from the toner-feeding gear 9*s* via an idler gear 9*t*, so that the toner-agitating member 9*f* rotates. Here, the idler gears 9*q*, 9*r*, 9*t* are rotatably attached to joggles 12*e*, 12*f*, 12*g* integrally molded on the developing-frame body 12. Joggle tip ends are supported by the developing holder 40 described later.

Moreover, the above-described gear train is disposed on the same side face as that of the "Ushaped" portion 9*h*1 of the antenna rod 9*h* described above.

In the above-described constitution, the supporting of the gears constituting the gear train, and the electric connecting of the toner-residual amount detecting contact can be performed by the same member (developing holder 40 in the embodiment). Moreover, in the longitudinal direction of the developing-frame body 12, the toner-agitating members 9*e*, 9*f*, the antenna rod 9*h*, and the idler gears 9*q*, 9*r*, 9*t*, the agitating gears 9*m*, 9*n*, and toner-feeding gear 9*s* constituting the gear train can be assembled from the same side face. Therefore, assembling properties can remarkably be enhanced.

Additionally, the lower-jaw portion 12*h* of the developing-frame body 12 also serves as the conveying guide of the recording material 2 such as the recording sheet. Specifically, as shown in FIG. 8, a large number of guide ribs 12*l*1 as short protrusions are arranged in parallel in the longitudinal direction. Moreover, in order to enhance the rigidity, the developing-frame body 12 may be molded by hollow molding.

Moreover, in FIG. 28, an opening 12P is formed along the longitudinal direction of the developing-frame body 12. When the toner-frame body 11 and the developing-frame body 12 are combined, the opening 12P is opposite to the opening 11*i* of the toner-frame body 11. Then, the toner contained in the toner-frame body 11 can be supplied to the developing roller 9*c*. Furthermore, the agitating members 9*e*, 9*f* and antenna rod 9*h* are attached along the entire width in the longitudinal direction of the opening 12P.

Additionally, according to the embodiment, the developing-frame body 12 is provided with the developing-roller attaching section 12X, the side plate 12A, developing-blade attaching section (blade thrust flat face 12*i*), the attaching section of antenna rod 9*h* (through hole 12*b*, bag hole 12*k*, hole 12*o*), the agitating member attaching section (through holes 12*t*, 12*r*, bag holes 12*m*, 12*n*), the gear-attaching section (joggles 12*e*, 12*f*, 12*g*), and the like, and is integrally molded. Moreover, the material for molding the developing-frame body 12 is the same as the above-described material of the toner-frame body 11.

(Developing Holder)

The developing holder 40 will next be described.

Figure 25:
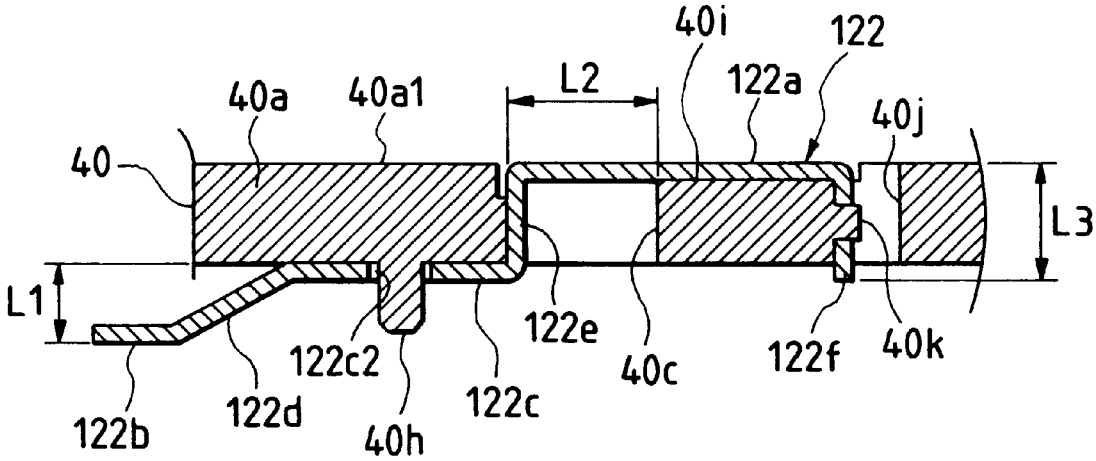
FIG. 25 is an enlarged sectional view taken along line XXV—XXV of FIG. 24.
Figure 26:
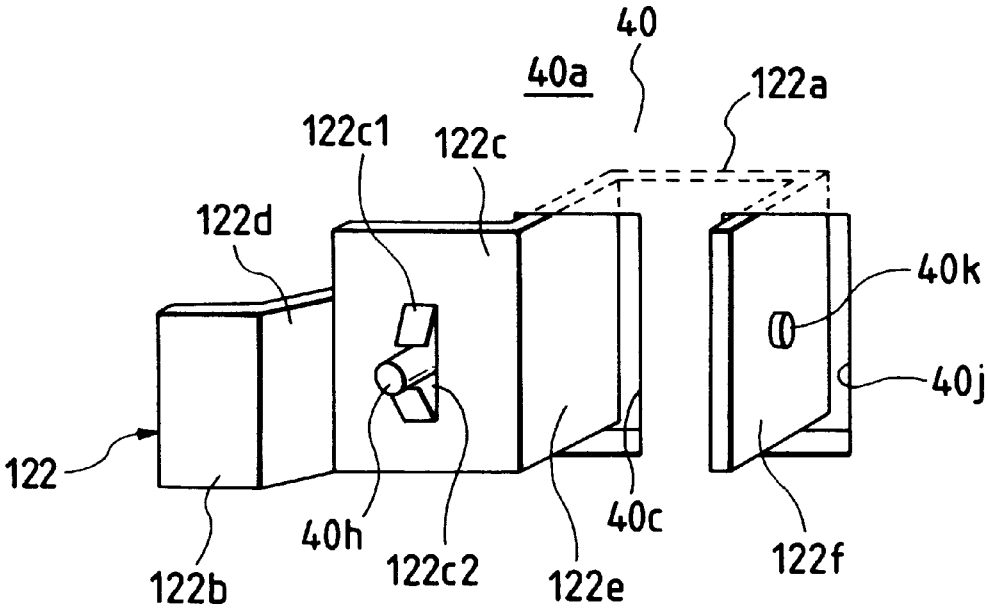
FIG. 26 is an enlarged view in the vicinity of a toner detecting contact of FIG. 24.

The developing holder will be described with reference to FIGS. 4 to 8, FIGS. 9A and 9B, FIGS. 23 to 25. FIG. 23 is a perspective view of the developing holder attached to the drive side as viewed from the outside, FIG. 24 is a perspective view as viewed from the inside, FIG. 25 is an enlarged sectional view taken along line XXV—XXV of FIG. 24, and FIG. 26 is an enlarged perspective view of the toner detecting contact.

The developing holders 40, 41 are attached to both sides of the assembly with the state shown in FIG. 29 to complete the developing unit D. In this case, first for the developing roller unit G, one pin 40*d* out of two pins 40*d* disposed on the developing holder 40 is passed through the upper hole 12*p* outside the bearing engaging portion of the developing frame body 12 shown in FIG. 27, engaged in the upper hole 9*j*1 of the developing roller bearing 9*j* (see FIG. 56), and engaged in the upper hole 12*p* inside the developing frame body 12. Moreover, the other pin 40*d* is engaged in the lower hole 9*j*1 of the developing-roller bearing 9*j* and the lower hole 12*p* of the developing-frame body 12. Additionally, the developing holders 40, 41 are screwed to the developing-frame body 12 so that the developing-roller bearings 9*j* are held with the bearing engaging portions of the developing-frame body 12. In this case, screw members are passed through holes 401 of the developing holders 40, 41 (the developing holder 41 is not shown, but is similar to the developing holder 40). Furthermore, one end 9*g*1 of the magnet 9*g* incorporated in the developing roller 9*c* (see FIGS. 23, 29) is engaged in a D-cut hole 40*e* formed in the developing holder 40, and the other end 9*g*2 is engaged in a hole (not shown) formed in the developing holder 41, thereby determining the position of the longitudinal direction. Moreover, as described above, the inclination of magnetic pole of magnet 9*g* is determined when the D-cut end 9*g*1 is engaged in the D-cut hole 40*e* of the developing holder 40.

The arm portion 12*b*1 integrally molded to protrude from the developing-frame body 12 is placed in the recess portion 21 (FIG. 9B) of the cleaning-frame body 13 and connected by the frame-body connecting member 168 (FIGS. 64A and 64B) so that the developing unit D is rotatably supported with respect to the cleaning-frame body 13 supporting the photosensitive drum 7. Furthermore, the compression-coil spring 169 attached to the frame-body connecting member 168 to always keep constant the gap of the photosensitive drum 7 and the developing roller 9*c* (prevent detachment by vibration) is pressed against the arm portion 12*b*1 of the developing-frame body 12. Thereby, the spacer rollers 9*i* on both ends of the longitudinal direction of the developing roller 9*c* are pressed into contact with the photosensitive drum 7.

Furthermore, the longitudinal guide 12*a* is integrally molded on the outer surfaces of the developing holders 40, 41 as described above. Additionally, the toner-detecting contact 122 and the developing-bias contact 121 of metal sheets for detecting the toner residual amount are attached to the developing holder 40. Specifically, both contacts 121, 122 are attached by pressing/engaging notches to joggles disposed on the inner side face of the developing holder 40.

(Attaching of Toner Detecting Contact)

First, the attaching of the toner-detecting contact 122 will be described with reference to the drawings.

FIG. 25 is an enlarged sectional view taken along line XXV—XXV of FIG. 24, and FIG. 26 is an enlarged view showing the vicinity of the toner detecting contact of FIG. 24. The toner-detecting contact 122 is provided with an outer contact portion 122*a* positioned on the outer surface of the holder 40 so as to contact a toner-detecting contact member 126 disposed on the apparatus main body 14 shown in FIGS. 19A and 19B and an inner-contact portion 122*b* to press/contact the "U-shaped" portion 9*h*1 of the antenna rod 9*h* while the process cartridge B is attached to the apparatus main body 14. Additionally, as shown in FIG. 25, the outer contact 122*a* is positioned substantially at the same height as that of an outer surface 40*a*1 of a side plate 40*a* of the developing holder 40. Moreover, the inner contact 122*b* is positioned opposite to the antenna rod 9*h* inside the developing holder 40.

As shown in FIG. 26, for the toner-detecting contact 122, a cut/raised portion 122*c*1 of a mounting base 122*c* is engaged with a joggle 40*h* protruded to the inside of the side plate 40*a* of the developing holder 40, and the mounting base 122*c* abuts on the side plate 40*a*. Moreover, a rising portion 122*d* is folded to obliquely rise from the mounting base 122*c*, and its tip end is provided with the inner-contact portion 122*b* positioned parallel to the side plate 40*a*. Furthermore, an inserting portion 122*e* folded by 90 degrees to the outside from the mounting base 122*c* extends to the outside along one side face of a first rectangular hole 40*c* formed in the side plate 40*a*. Then, the portion 122*e* is folded by 90 degrees in the direction opposite to the above-described direction to form the outer contact portion 122*a*. Here, the outer-contact portion 122*a* is recessed by the length substantially equal to the thickness of the outer-contact portion 122*a* to contact the bottom of a recess portion 40*i* formed in the side plate 40*a* (see FIG. 25). Therefore, the outer surface of the outer-contact portion 122*a* and the outer surface 40*a*1 of the side plate 40*a* have substantially the same height. Moreover, the end of the outer-contact portion 122*a* is passed through a second rectangular hole 40*j* formed in the side plate 40*a* to reach the inside of the side plate 40*a*. Subsequently, an end attaching portion 122*f* is engaged with a joggle 40*k* protruded to the inside of the second hole 40*j*. In this manner, the toner-detecting contact 122 is attached to the developing holder 40.

As shown in FIG. 25, width L2 of the first hole 40*c* of the side plate 40*a* is larger than either distance L1 between the inner face of the mounting base 122*c* of the toner-detecting contact 122 and the surface of the inner-contact portion 122*b* or height L3 of the end attaching portion 122*f*. Moreover, an interval between the top face of the joggle 40*k* in the second hole 40*j* and the face opposite to the joggle 40*k* of the hole 40*j* is sufficient for the end-attaching portion 122*f* of the toner-detecting contact 122 to pass through.

To attach the toner-detecting contact 122, the end-attaching portion 122*f* is first inserted to the first hole 40*c* from the inside of the developing holder 40, then rotated in the clockwise direction in FIG. 25 to align the end attaching portion 122*f* with the second hole 40*j*. Subsequently, a hole 122*c*2 of the mounting base 122*c* is engaged with the joggle 40*h*. On the other hand, the end-attaching portion 122*f* passes the joggle 40*k* with the elastic force until the root of the joggle 40*k* engages into the hole in the end-attaching portion 122*f*.

(Attaching of Developing Bias Contact)

The developing-bias contact 121 will next be described.

As shown in FIGS. 23, 24, the developing-bias contact 121 is attached to the inside of the developing holder 40, and is constituted of the leaf spring portion 121*a*, an inner-contact portion 121*b* bent and continued from the leaf-spring portion 121*a*, and an outer-contact portion 121*c* bent and continued from the inner-contact portion 121*b* and positioned on the outer surface of the side plate 40*a*. Here, when the developing holder 40 is attached to the developing-frame body 12, the leaf-spring portion 121*a* elastically abuts on the sheet-metal bent portion 9d1*a* of the developing blade 9*d* (see FIG. 27), and the potential of the leaf spring 9d1 is set to substantially the same potential as that of the developing roller 9*c*. Moreover, the inner-contact portion 121*b* is disposed on the periphery of a boss 40*f* having the hole 40*e*, and elastically abuts on the developing-coil spring contact 91 (see FIG. 27) engaged with the boss 40*f* (abutment pressure is in the range of about 100 g to 300 g). Moreover, a conductive grease may be applied to a sliding portion that slides on the developing-coil spring contact 91 of the inner-contact portion 121*b* as occasion demands. Furthermore, the outer-contact portion 121*c* is disposed in a recess of the side plate 40*a*, and positioned substantially at the same height as that of the outer surface 40*a*1 of the side plate 40*a*. When the process cartridge B is attached to the apparatus main body 14, the outer-contact portion 121*c* abuts on a developing-bias contact member 125 disposed on the apparatus main body 14 (see FIGS. 19A and 19B), and receives a developing bias applied to the developing roller 9*c* from the apparatus main body 14. The developing bias transmitted from the apparatus main body 14 is applied to the developing roller 9*c* from the developing-bias contact 121 and the developing-coil spring contact 91.

Here, when the developing holder 40 is attached to the developing-frame body 12, and the inner-contact portion 122*b* as the leaf spring abuts on the "U-shaped" portion 9*h*1 of the antenna rod 9*h* shown in FIG. 29, the toner-detecting contact 122 is electrically connected to the antenna rod 9*h*. The abutment pressure of the antenna rod 9*h* and the inner-contact portion 122*b* is about 100 g. Furthermore, while the process cartridge B is attached to the apparatus main body 14, the outer-contact portion 122*a* disposed on the outer surface 40*a*1 of the developing holder 40 is electrically connected to the toner-detecting contact member 126 disposed on the apparatus main body 14. Then, the electric signal is transmitted to the toner-detecting contact member 126 via the antenna rod 9*h* and the toner-detecting contact 122 in accordance with the electrostatic capacity which changes with the change of the toner amount present between the developing roller 9*c* and the antenna rod 9*h*. When a controller (not shown) detects that the electric signal transmitted to the toner-detecting contact member 126 reaches a predetermined value, the replacement of the process cartridge B is notified. Moreover, as described above, the tip ends of the joggles 12*e* to 12*g* as the gear shafts of the idler gears (9*q*, 9*r*, 9*t*) shown in FIG. 29 are engaged in three engagement holes 40*g* formed in the inside of the developing holder 40 shown in FIG. 24. Therefore, the developing holder 40 supports the joggles 12*e* to 12*g*. Furthermore, the end face of a boss 40*m* disposed inside the developing holder 40 slides on the agitating gear 9*n* to stop the agitating gear 9*n* from moving to the outside.

As described above, by providing the single component (developing holder) with various functions, the assembling properties are enhanced, and costs are further reduced.

Moreover, according to the embodiment, the developing holder 40 is provided with the longitudinal guide 12*a*, the attaching portion (hole 40*e*) of magnet 9*g*, the attaching portion (boss 40*f*, and the like) of developing-bias contact 121, the attaching section (joggle 40*h*, the first hole 40*c*, the second hole 40*j*, the recess portion 40*i*, and the like) of toner-detecting contact 122, the boss 40*m*, the pins 40*d*, the holes 40*g*, 40*l*, and the like, and is integrally molded. Furthermore, the developing holder 41 has the longitudinal guide 12*a*, and the like, and is integrally molded. Additionally, according to the embodiment, the developing holder 40 or 41 is formed of the same resin as that of the toner-frame body 11 or the developing-frame body 12, and is integrally molded.

Additionally, the developing holder 40 or 41 is positioned by inserting the pins 40*d* of the developing holder 40 or 41 into the holes 12*p* of the developing-frame body 12. Subsequently, a small screw (not shown) is passed through the screw hole 401 (developing holder 40, 41) and screwed to the female thread 12*r* (developing frame body 12) so that the developing holders 40, 41 are screwed/fixed to the developing-frame body 12.

(Constitution of Lower Face of Cleaning-Frame Body)

Figure 35:
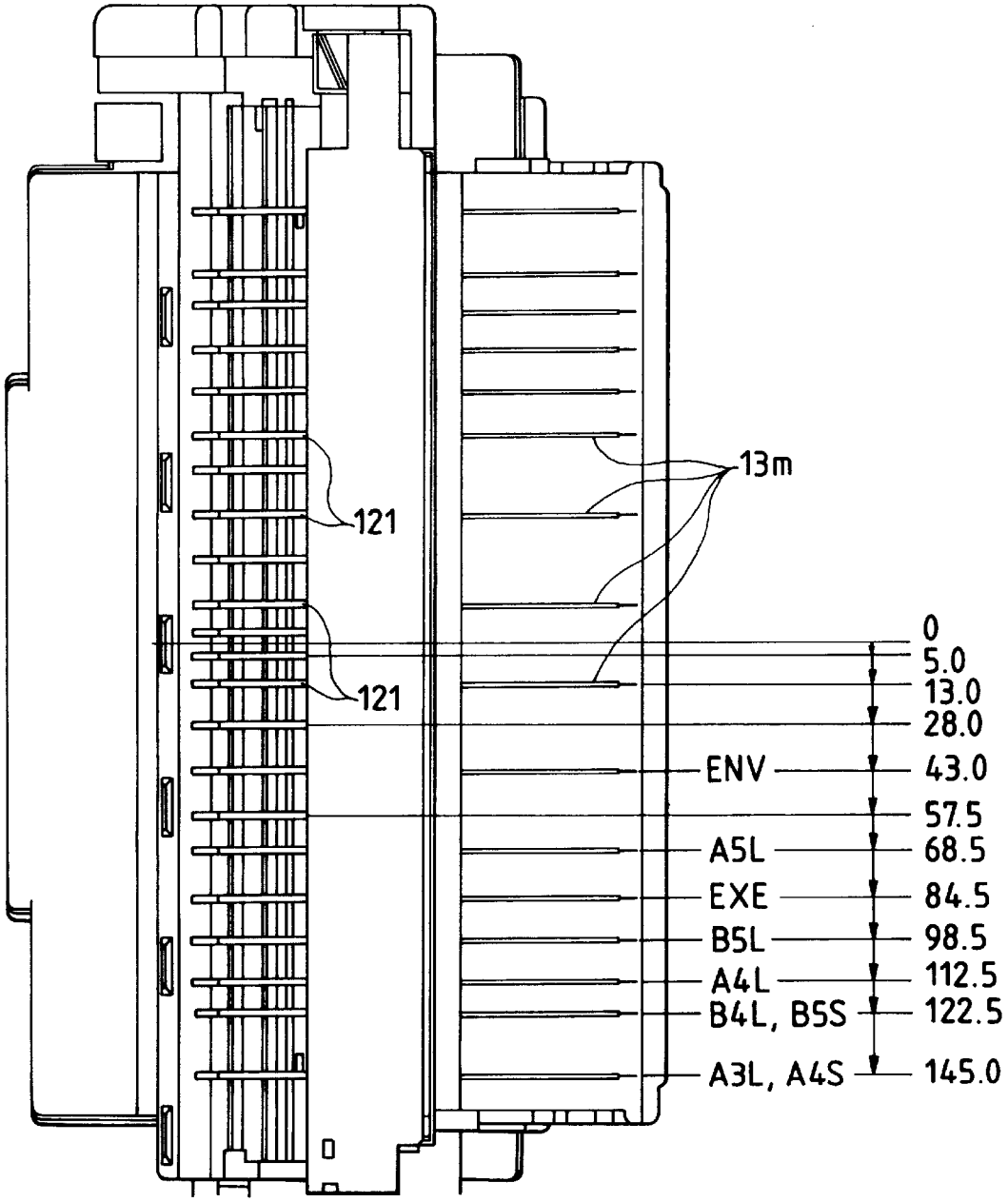
FIG. 35 is a bottom plan view of the process cartridge.

As shown in FIGS. 8 and 35, as protrusions along the movement direction of the recording material 2, the lower face of the developing-frame body 12 is provided with the guide ribs 12*l* and the lower face of the cleaning-frame body 13 is provided with guide ribs 13*m*. The guide ribs 12*l* and 13*m* of the lower faces are positioned slightly inside the opposite ends of the recording material 2 in the longitudinal direction. In the embodiment, the ribs are positioned about 5 mm inside. Moreover, the guide ribs for assisting the conveyance are added to the other positions. The electrophotographic image forming apparatus A of the embodiment can form images on the recording materials 2 having a plurality of sizes, and any size of recording material 2 is conveyed to pass through the center (center CL, coinciding with the center of the recording material 2). Therefore, in the embodiment, some pairs of ribs are arranged symmetrically on both sides from the center C1 on the lower faces of the developing-frame body 12 and cleaning-frame body 13. The protruded heights of the ribs are constant in the developing-frame body 12 or the cleaning-frame body 13, which is advantageous for conveyance. This enhances the conveying property and prevents the image from being disturbed by the contact of non-fixed image onto the lower face of the cleaning-frame body 13.

As an example of the embodiment, FIG. 35 shows dimensions from the center CL by numerals in units of mm (for only one side). The standard paper codes of the recording materials 2 corresponding to the numerals (Japanese Industrial Standards) are shown. For example, the longitudinal direction of the recording material of A3L:A3 is a conveying direction, or the short direction of the recording material of A4S:A4 is a conveying direction. Moreover, ENV indicates the recording material 2 having an envelope size, and EXE indicates the recording material 2 of an executive size. Additionally, the guide ribs 12*l* and/or 13*m* in the positions of 5.0, 13.0 and 28.0 mm from the center CL are aligned with the center of the recording material 2.

Additionally, different from the above-described embodiment, in the embodiment, the protruded heights of the guide ribs 13*m* are increased toward the outside rib, and the pair of ribs 13*m* for the recording material 2 of each size have the same height. Thereby, since the inner ribs are securely prevented from contacting the image face of the recording material 2, the image disturbance can securely be avoided. Even in this case, the arrangement of the ribs is the same as when the ribs have equal heights.

(Constitution of Electric Contact)

The connection and arrangement of the contacts for electrically connecting the process cartridge B and the laser beam printer main body A when the process cartridge B is attached to the laser beam printer main body A will next be described with reference to FIGS. 5, 8, 19A and 19B.

As shown in the drawings, the process cartridge B is provided with a plurality of electric contacts. Specifically, there are provided (1) a conductive earth contact 119 electrically connected to the photosensitive drum 7 for grounding the photosensitive drum 7 with the apparatus main body 14, (2) a conductive charging-bias contact 120 electrically connected to the charging roller shaft 8*a* for applying a charging bias to the charging roller 8 from the apparatus main body 14, (3) the developing-bias contact 121 electrically connected to the developing roller 9*c* for applying the developing bias to the developing roller 9*c* from the apparatus main body 14, and (4) the conductive-toner-residual-amount detecting contact 122 electrically connected to the antenna rod 9*h* for detecting the toner residual amount. These four contacts are exposed from the side face (right side face) of the cartridge frame body side face. The four contacts 119 to 122 are disposed with distances on one side face of the cartridge frame body so that no electric leak occurs among the contacts. Additionally, as described above, the earth contact 119 and the charging-bias contact 120 are disposed on the cleaning-frame body 13, and the developing-bias contact 121 and the toner-residual-amount detecting contact 122 are disposed on the developing frame body 12 (developing holder 40). Furthermore, the toner-residual-amount developing contact 122 also serves as a contact indicating the presence/absence of the process cartridge to allow the apparatus main body 14 to detect that the process cartridge B is attached to the apparatus main body 14.

For the earth contact 119, the drum shaft 7*a* of the photosensitive drum 7 is formed of a conductive material, or the electric contact is formed by insert molding of the conductive material to the resin. In the embodiment, the drum shaft 7*a* is formed of metals such as iron. Moreover, for the other contacts 120 to 122, the conductive metal material with a thickness of about 0.1 mm to 0.3 mm (e.g., stainless steel, phosphor bronze) is extended from the inside of the process cartridge B. Additionally, the charging-bias contact 120 is exposed from the drive-side face (one end Cl) of the cleaning unit C, and the developing-bias contact 121 and the toner-detecting contact 122 are exposed from the drive side face (one end Dl) of the developing unit D.

Further details will be described.

As described above, in the embodiment, as shown in FIG. 20, the helical drum gear 7*b* is disposed on one side end of the axial direction of the photosensitive drum 7. This drum gear 7*b* meshes with the drive helical gear 28 disposed on the apparatus main body 14 to rotate the photosensitive drum 7. When the drum gear 7*b* rotates, a thrust force (direction of arrow d shown in FIG. 20) is generated, so that the photosensitive drum 7 disposed on the cleaning-frame body 13 is pushed toward the side on which the drum gear 7*b* is disposed with a play in the longitudinal direction. Then, a side end 7*b*1 of the drum gear 7*b* collides against an inner face 13*k*1 of one side face 13*k* of the cleaning-frame body 13. This defines the position of the photosensitive drum 7 in the axial direction inside the process cartridge B. Additionally, the earth contact 119 and the charging-bias contact 120 are exposed on one side face 13*k* of the cleaning frame body 13. Then, the earth contact 119 is protruded slightly to the outside from the tip end of the drum shaft 7*a* and the tip end of the cylindrical guide 13*a* (protruded by about 0.8 mm). The drum shaft 7*a* is passed through a drum cylinder 7*d* (formed of aluminum in the embodiment) covered with the photographic layer 7*e*, and both ends are supported by the cylindrical guide 13*a* on both side ends C1, C2 of the cleaning frame body 13. The drum cylinder 7*d* and the drum shaft 7*a* are electrically interconnected by an earth plate 7*f*, which contacts an inner face 7*d*1 of the drum cylinder 7*d* and an outer peripheral face 7*a*1 of the drum shaft 7*a*.

Moreover, as shown in FIG. 5, the charging bias contact 120 is substantially right above the longitudinal guide 12*a* in the vertical direction, and disposed in the vicinity of the part of the cleaning frame body 13 supporting the charging roller 8 (see FIG. 9A). Additionally, the charging-bias contact 120 is electrically connected to the charging roller 8 via the electrode 166 on the tip end of a conductive member 120*a* (see FIG. 63).

Subsequently, the developing-bias contact 121 and the toner-detecting contact 122 will be described. As shown in FIG. 5, these contacts 121, 122 are disposed on one side end D1 of the developing unit D, which is disposed on the same side as the right end 13*c* of the cleaning-frame body 13. Additionally, the outer-contact portion 121*c* as the portion of the developing-bias contact 121 exposed to the outside is right below the longitudinal guide 12*a*, and is disposed in the vicinity of the right end portion of the frame body supporting the magnet 9*g* incorporated in the developing roller 9*c*. The developing-bias contact 121 is electrically connected to the developing roller 9*c* via the developing-coil spring contact 91 connected to the side end of the developing roller 9*c* (see FIG. 9B). Moreover, the toner-detecting contact 122 shown in FIG. 5 is disposed on the upstream side of the longitudinal guide 12*a* with respect to the cartridge-attaching direction (arrow X direction of FIG. 5). Additionally, as shown in FIG. 5, the toner-detecting contact 122 is disposed on the side of the toner container 11A of the developing roller 9*c*, and contacts the antenna rod 9*h* disposed along the longitudinal direction of the developing roller 9*c* (see FIG. 9B). As described above, the antenna rod 9*h* is disposed over the longitudinal direction of the developing roller 9*c* and in a position with a constant distance from the developing roller 9*c*. Additionally, the electrostatic capacity between the antenna rod 9*h* and the developing roller 9*c* changes in accordance with the toner amount present between them. This change of electrostatic capacity is detected as the potential difference change by the controller (not shown) of the apparatus main body 14 to detect the toner residual amount.

Here, the toner residual amount indicates the toner amount present between the developing roller 9*c* and the antenna rod 9*h* that produces a predetermined electrostatic capacity. Thereby, it can be detected that the toner residual amount inside the toner container 11A reaches the predetermined amount. In this case, the controller disposed on the apparatus main body 14 detects via the toner-detecting contact 122 that the electrostatic capacity reaches a first predetermined value, thereby judging that the toner residual amount of the toner container 11A reaches the predetermined amount. When the apparatus main body 14 detects that the electrostatic capacity reaches the first predetermined value, it notifies the replacement of the process cartridge B (e.g., flashing of lamp, generation of sound by buzzer). Moreover, by detecting that the electrostatic capacity has a second predetermined value which is smaller than the first predetermined value, the controller detects that the process cartridge B is attached to the apparatus main body 14. Moreover, unless the attachment of the process cartridge B is detected, the controller does not start the image forming operation of the apparatus main body 14. Specifically, the apparatus main body 14 is not allowed to start the image forming operation.

Additionally, it may be notified that the process cartridge B is not yet attached (e.g., lamp flashing, and the like).

The connection of the contact disposed on the process cartridge B and the contact member disposed on the apparatus main body 14 will next be described.

As shown in FIGS. 19A and 19B, on the inner side face of the cartridge attachment space S on one side of the image forming apparatus A, there are provided four contact members that can be connected to the contacts 119 to 122 when attached to the process cartridge B (an earth contact member 123 electrically connected to the earth contact 119, a charging-contact member 124 electrically connected to the charging-bias contact 120, the developing-bias contact member 125 electrically connected to the developing-bias contact 121, and the toner-detecting contact member 126 electrically connected to the toner-detecting contact 122).

As shown in FIGS. 19A and 19B, the earth contact member 123 is disposed for the positioning groove 16*a*5. Moreover, the developing-bias contact member 125 and the toner-detecting contact member 126 are disposed below the first guide portion 16*a*. Furthermore, the charging-contact member 124 is disposed above the second guide portion 16*b*.

Here, the positional relation between the contacts and the guides will be described.

First, in FIG. 5, in the vertical direction in the process cartridge B, the developing-bias contact 121 is disposed in the lowermost position; the toner-detecting contact 122, the longitudinal guide 12*a* and the cylindrical guide 13*a* (earth contact 119) are disposed substantially at the same height above the contact 121; and the short guide 13*b* and the charging-bias contact 120 are disposed further above. Moreover, in the cartridge-attaching direction (arrow X direction), there are arranged the toner-detecting contact 122 on the upstream side, the longitudinal guide 12*a* on the downstream side, and the charging-bias contact 120 and the developing-bias contact 121 on the downstream side of the longitudinal guide 12*a* and in the position overlapping the longitudinal guide 12*a*. Further on the downstream side, the short guide 13*b* and the cylindrical guide 13*a* (earth contact 119) are arranged. In this arrangement, the charging-bias contact 120 can be close to the charging roller 8, the developing bias contact 121 can be close to the developing roller 9*c*, the toner-detecting contact 122 can be close to the antenna rod 9*h*, and the earth contact 119 can be close to the photosensitive drum 7. This can eliminate the placing around of electrodes and reduce the distance between the contacts.

Here, the size of the contact portion of each contact with the contact member is as follows: First, the charging-bias contact 120 is about 10.0 mm both in length and width (allowable range of 8.0 mm to 12 mm), the developing-bias contact 121 has a length of about 9.0 mm (allowable range of 6.0 mm to 12.0 mm) and a width of about 8.0 mm (allowable range 5.0 mm to 11.0 mm), the toner-detecting contact 122 has a length of about 8.0 mm (allowable range of 6.0 mm to 10.0 mm) and a width of about 9.0 mm (allowable range of 7.0 mm to 11.0 mm), and the earth contact 119 has a circular shape and an outer diameter of about 7.0 mm. Additionally, the charging-bias contact 120, the developing-bias contact 121, and the toner-detecting contact 122 are rectangular.

Figure 20:
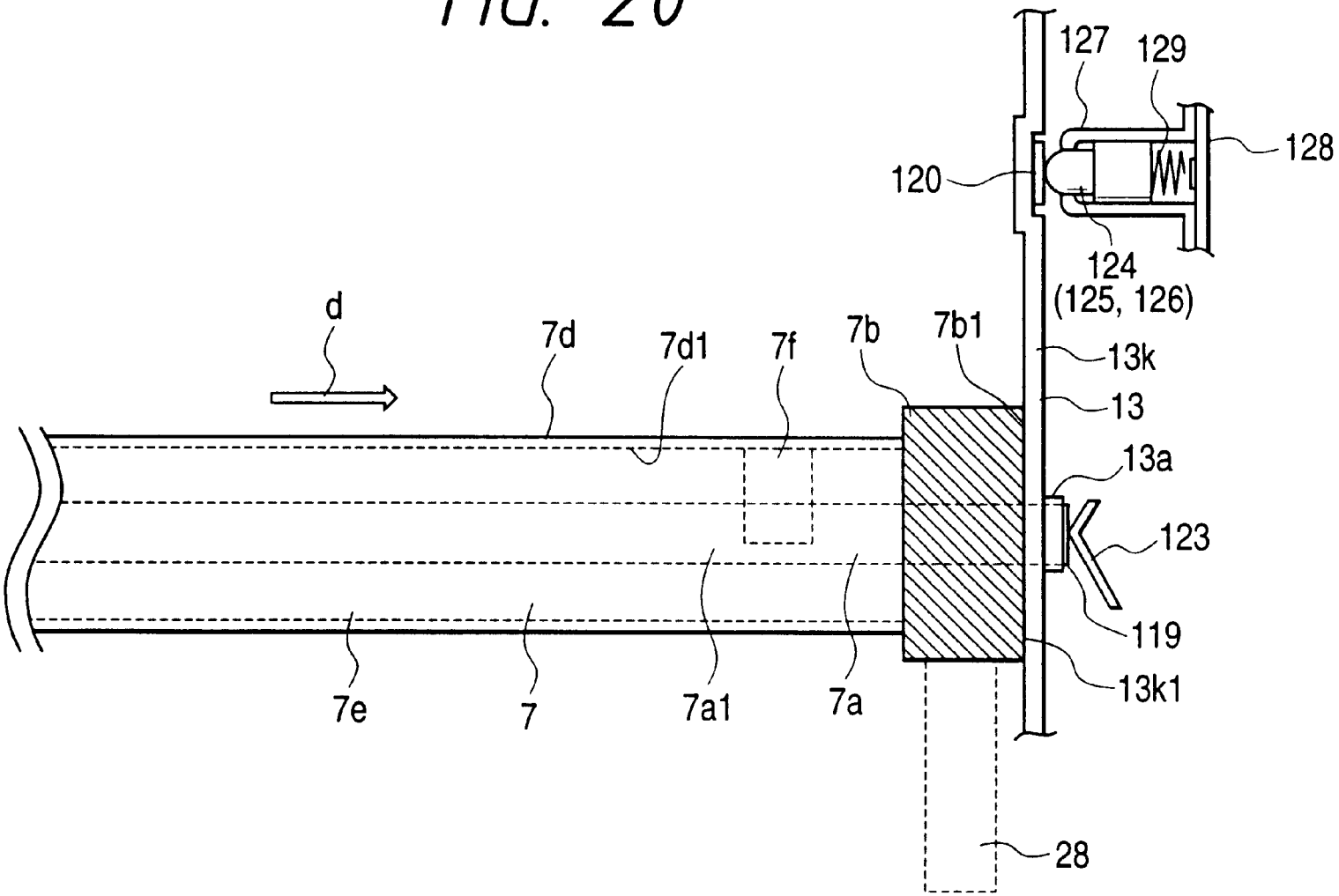
FIG. 20 is a plan view showing that contacts are connected to contact members.

As shown in FIG. 20, the earth contact member 123 is a conductive leaf spring member, attached in the positioning groove 16*a*5 in which the cylindrical guide 13*a* of the photosensitive drum 7 provided with the earth contact 119 on the side of the process cartridge B is engaged (the drum shaft 7*a* is positioned) (see FIGS. 19A and 19B), and grounded via the chassis of the apparatus main body 14. The other contact members 124, 125, 126 are attached by a compression-coil spring 129 so as to be protruded from a holder 127. This will be described using the charging-contact member 124 as an example. As shown in FIG. 20, the charging-contact member 124 is attached in the holder 127 so that the member cannot drop and can be protruded, the holder 127 is fixed to an electric substrate 128 attached to the side face of the apparatus main body 14, and the contact members and wiring patterns are electrically connected by the conductive compression-coil spring 129.

Figures 21A, 21B, 21C:
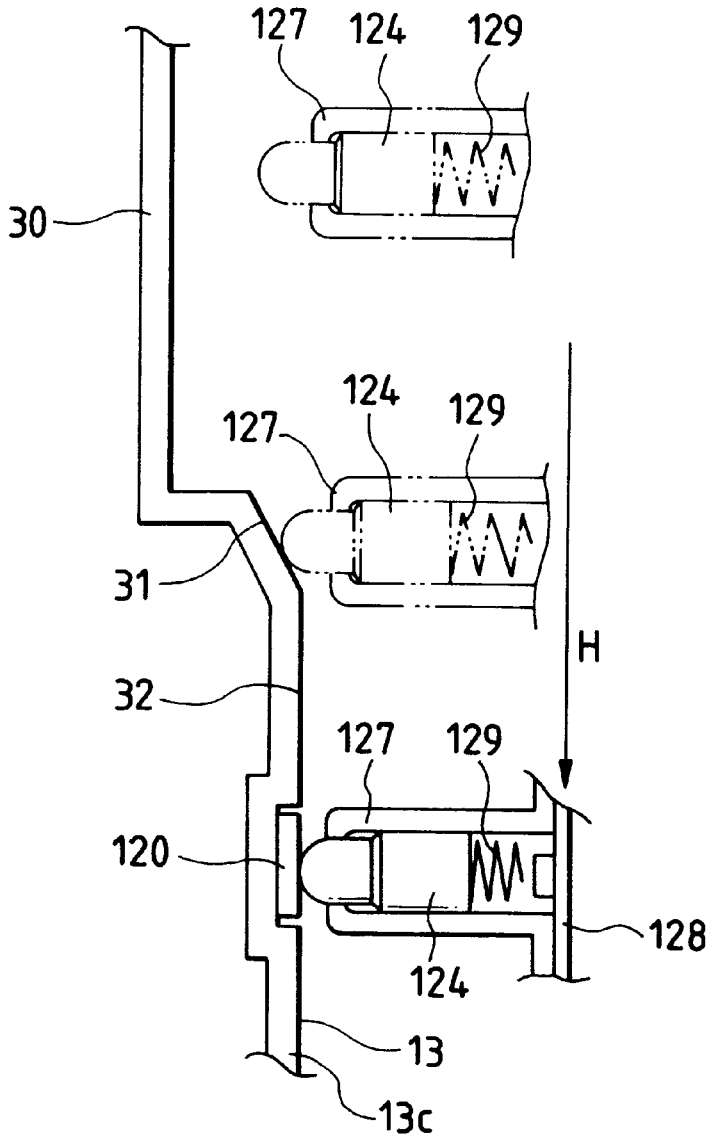
FIGS. 21A, 21B and 21C are sectional views taken along line XXI—XXI of FIG. 5 showing that the contacts are connected to the contact members.

A state will next be described with reference to FIGS. 21A to 21C using the charging-bias contact 120 as an example, in which each contact on the side of the process cartridge contacts each contact member on the side of the image forming apparatus when the process cartridge B is attached to the image forming apparatus A. Additionally, FIGS. 21A to 21C are explanatory views showing the state of the process cartridge B attached to the image forming apparatus A. An arrow H indicates a relative path of the charging-contact member 124 on the side of the apparatus main body with respect to the process cartridge B when the process cartridge B is attached to the image forming apparatus A. Additionally, FIGS. 21A to 21C show a XXI—XXI section of FIG. 5.

When the process cartridge B is inserted to the image forming apparatus A, and guided and attached by the guide portions 16*a*, 16*b*, the charging-contact member 124 is in a state shown in FIG. 21A, before reaching a predetermined attaching position. In this case, the charging-contact member 124 does not contact a flat face 30 of the cleaning frame body 13 yet. When the process cartridge B is further inserted, the charging-contact member 124 reaches a position of FIG. 21B. Here, the member contacts a slope 31 formed on the right end 13*c* of the cleaning frame body 13. When the charging-contact member 124 is pressed along the slope 31, the compression-coil spring 129 is gradually deflected, and the charging-contact member 124 smoothly reaches a flat face 32 on which the charging-bias contact 120 is exposed. Subsequently, when the process cartridge B is inserted to the attaching position, the charging-contact member 124 reaches a position of FIG. 21C to contact the charging-bias contact 120. The other two contact members 125, 126 contact the contact members 121, 122 in the same manner.

As described above, in the embodiment, when the process cartridge B is guided by the guide member 16 and attached to the predetermined attaching position, the contacts securely contact the contact members.

Moreover, when the process cartridge B is attached to the predetermined position, the earth contact member 123 as the leaf-spring contacts the earth contact 119 protruded from the cylindrical guide 13*a* (see FIG. 20). Here, when the process cartridge B is attached to the apparatus main body 14, the earth contact 119 and the earth-contact member 123 are electrically connected, and the photosensitive drum 7 is grounded. Moreover, the charging-bias contact 120 and the charging contact member 124 are electrically connected, and a high voltage (superimposition of AC voltage and DC voltage) is applied to the charging roller 8. Furthermore, the developing-bias contact 121 and the developing-bias contact member 125 are electrically connected, and a high voltage is applied to the developing roller 9*c*. Additionally, the toner-detecting contact 122 and the toner-detecting contact member 126 are electrically connected, and the information is transmitted to the apparatus main body 14 in accordance with the electrostatic capacity between the developing roller 9*c* and the antenna rod 9*h*.

A case will next be described in which the image forming apparatus A is driven to rotate the photosensitive drum 7. When the process cartridge B is attached to the image forming apparatus A, to facilitate the insertion, a thrust backlash of about 2 mm to 3 mm is given with respect to the axial direction of the photosensitive drum 7. Therefore, the protruded amount of the charging contact member 124 needs to be set to be larger than the backlash. In the embodiment, as shown in FIG. 18, there is provided a leaf spring 45 to push the process cartridge B toward one side of the apparatus main body 14 (the side on which the contact members 123 to 126 are disposed) when the process cartridge B is attached. The leaf spring (flat spring) 45 is disposed above the first guide portion 16*a* on the side opposite to the side on which the contact members are disposed.

Moreover, according to the embodiment, since the contacts 119 to 122 of the process cartridge B are disposed on the side provided with the helical drum gear 7*b* (drive side face), the connection of the drive to the side of the apparatus main body 14 by the helical drum gear 7*b*, and the electric connection to the side of the apparatus main body 14 by the contacts 119 to 122 can be performed on the same side of the process cartridge B. Therefore, when the same side is used as the reference of the process cartridge B, the accumulated error of the dimension is minimized, and the precision of attaching positions of the contacts 119 to 122 and the helical drum gear 7*b* can be enhanced. Furthermore, in the embodiment, since the torsional direction of the helical drum gear 7*b* is determined so that the thrust force is generated toward the side provided with the helical drum gear 7*b*, the photosensitive drum 7 can be positioned in the axial direction on the side provided with the contacts. In this case, in addition to the above-described effects, the positional precision of the photosensitive drum 7 and the contacts can be enhanced. Furthermore, in the embodiment, the lever 23 (see FIG. 6) for opening/closing the drum-shutter member 18 is disposed on the side opposite to the side provided with the contacts 119 to 122. Therefore, when the process cartridge B is made insert to the image forming apparatus A, the sliding resistance of the contacts 119 to 122, and the resistance applied to the lever 23 for opening/closing the drum shutter member 18 are dispersed to both sides in the longitudinal direction of the process cartridge B. Therefore, the insertion resistance is made uniformed in the longitudinal direction, and the process cartridge B can smoothly be inserted.

Furthermore, in the embodiment, since all the contacts of the process cartridge B are disposed on one side face of the cartridge-frame body, and the process cartridge B is elastically pushed by the leaf spring 45, the electric contacts can electrically be connected to the contact members on the side of the apparatus main body 14 in a stable state.

Figure 22:
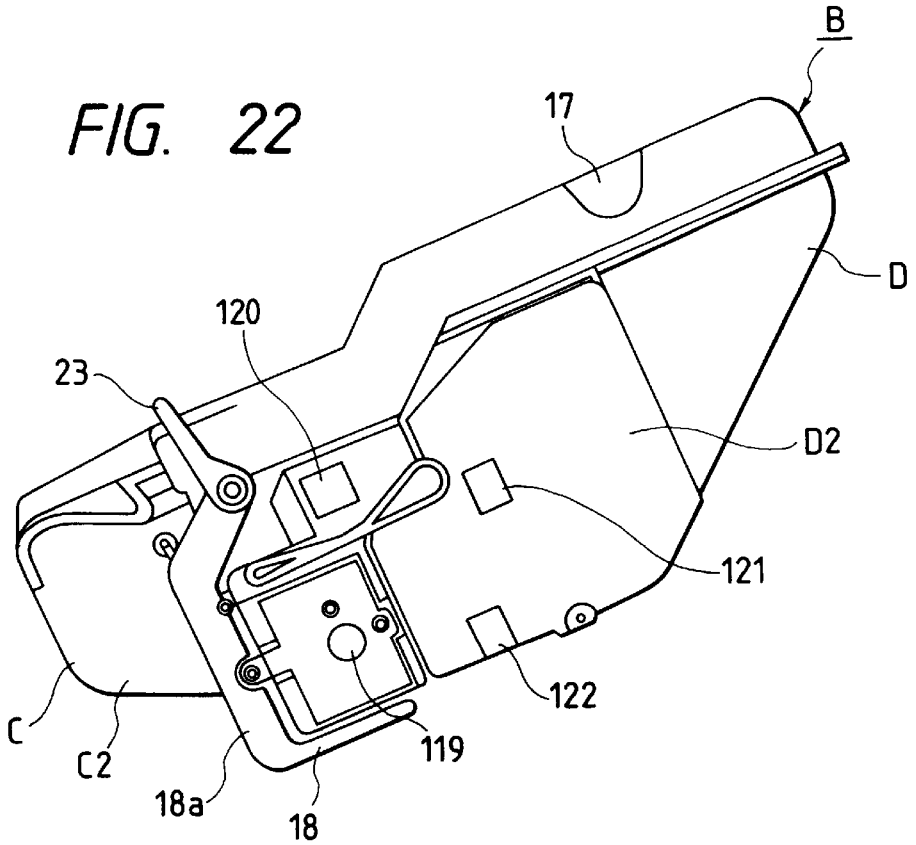
FIG. 22 is a side view of the process cartridge to which one embodiment of the present invention is applied.

Additionally, FIG. 22 shows an example where the contacts 119 to 122 are disposed on the side provided with the shutter lever 23. Even in this constitution, a sufficient effect can be obtained.

Moreover, the process cartridge B described above in the embodiment shows the example where monochromatic images are formed, but the process cartridge of the present invention can preferably be applied also to a cartridge provided with a plurality of developing means to form a plurality of colors of images (e.g., two-color image, three-color image, full-color image, and the like).

Furthermore, the electrophotographic body is mot limited to the photosensitive drum 7, and includes the following. First, a photoconductive body is used in the photosensitive drum, and examples of the photoconductive body include amorphous silicon, amorphous selenium, zinc oxide, titanium oxide and organic photoconductive body (OPC). Moreover, for example, a drum shape or a belt shape is used as the mounting shape of the photographic body. For example, in the photosensitive drum, a photoconductive material is deposited or applied onto a cylinder of aluminum alloy or the like.

Moreover, as the developing method, a known two-component, magnetic-brush developing method, a cascade developing method, a touch-down developing method, a cloud developing method and other various developing methods can be used.

For the constitution of the charging means, in the above-described embodiment, a so-called contact charging method has been used, but another constitution may naturally be used, which comprises applying a metal shield, such as aluminum, around three ways of a heretofore used tungsten wire, applying a high voltage to the tungsten wire, moving a generated positive or negative ion to the surface of the photosensitive drum, and uniformly charging the surface of the drum.

Additionally, as the charging means, in addition to the roller type, a blade (charging blade), a pad (bud) type, a block type, a rod type, a wire type, and the like may be used.

Moreover, in the cleaning method of the toner remaining on the photosensitive drum, cleaning means may be constituted using a blade, a fur brush, a magnetic brush, and the like.

As described above, since a plurality of electric contacts for the process cartridge are all disposed on one side face of the cartridge-frame body, and the process cartridge is pushed toward the side face provided with the electric contacts by the elastic means and positioned, the electric connection with the image forming apparatus can steadily be performed.

Moreover, since the drive force is transmitted to the electrophotographic body by the helical gear, and the helical gear and the electric contacts are disposed so that they are pushed toward the photographic body by the rotation of the gear, the electric connection to the image forming apparatus and the connection of the drive can be performed more securely.

Furthermore, since the contacts are arranged as described in the embodiment, the placing around of the electrode of each contact in the process cartridge can be reduced.

Additionally, since the electric substrate on the side of the apparatus main body connected to the electric contact can vertically be disposed on the device side face, the device can be reduced in size.

What is claimed is:

1. A developing apparatus, comprising:

a developer bearing body provided rotatably for bearing and carrying a developer to a developing position;

a drive transmission gear disposed on said developer bearing body and given a drive force for rotating said developer bearing body;

a support member for rotatably supporting said developer bearing body; and a developing frame body to which said support member is attached, said support member including an engaging portion for engaging said developing frame body in a position opposite to a position where the drive force is transmitted to said drive transmission gear with respect to a rotating center of said developer bearing body.

2. The developing apparatus according to claim 1, further comprising a magnetic seal member disposed opposite to an end portion in a longitudinal direction of said developer bearing body with a predetermined gap.

3. The developing apparatus according to claim 2, wherein said magnetic seal member includes a magnet or a magnetic member.

4. The developing apparatus according to claim 2, wherein a part of said magnetic seal member is disposed in a direction in which the drive force is transmitted to said drive transmission gear with respect to the rotating center of said developer bearing body.

5. The developing apparatus according to claim 1, wherein said engaging portion is disposed in the vicinity of a line connecting the position where the drive force is transmitted to said drive transmission gear and the rotating center of said developer bearing body.

6. The developing apparatus according to claim 1, wherein said engaging portion is provided with a protruding portion protruded in the same direction as a direction of a line connecting the position where the drive force is transmitted to said drive transmission gear and the rotating center of said developer bearing body.

7. The developing apparatus according to claim 1, wherein said support member is supported on said developing frame body via pins disposed above and below a line connecting the position where the drive force is transmitted to said drive transmission gear and the rotating center of said developer bearing body.

8. The developing apparatus according to claim 1, wherein the direction of the drive force transmitted to said drive transmission gear is substantially orthogonal to a face on which said engaging portion contacts said developing frame body.

9. A process cartridge detachably attachable to an image forming apparatus, comprising:

an image bearing body;

a drive gear disposed on said image bearing body; and a developing apparatus for developing an electrostatic image formed on said image bearing body with a developer, said developing apparatus including:

a developer bearing body provided rotatably for bearing and carrying the developer to a developing position;

a drive transmission gear disposed on said developer bearing body and given a drive force for rotating said developer bearing body;

a support member for rotatably supporting said developer bearing body; and a developing frame body to which said support member is attached, said support member having an engaging portion for engaging said developing frame body in a position opposite to a position where the drive force is transmitted to said drive transmission gear with respect to a rotating center of said developer bearing body.

10. The process cartridge according to claim 9, said developing apparatus further including a magnetic seal member disposed opposite to an end portion in a longitudinal direction of said developer bearing body with a predetermined gap.

11. The process cartridge according to claim 10, wherein said magnetic seal member has a magnet or a magnetic member.

12. The process cartridge according to claim 10, wherein a part of said magnetic seal member is disposed in a direction in which the drive force is transmitted to said drive transmission gear with respect to the rotating center of said developer bearing body.

13. The process cartridge according to claim 9, wherein said engaging portion is disposed in the vicinity of a line connecting the position where the drive force is transmitted to said drive transmission gear and the rotating center of said developer bearing body.

14. The process cartridge according to claim 9, wherein said engaging portion is provided with a protruded portion protruding in the same direction as a direction of a line connecting the position where the drive force is transmitted to said drive transmission gear and the rotating center of said developer bearing body.

15. The process cartridge according to claim 9, wherein said support member is supported on said developing frame body via pins disposed above and below a line connecting the position where the drive force is transmitted to said drive transmission gear and the rotating center of said developer bearing body.

16. The process cartridge according to claim 9, wherein a direction of the drive force transmitted to said drive transmission gear is substantially orthogonal to a face on which said engaging portion contacts said developing frame body.

17. The process cartridge according to claim 9, wherein said image bearing body is an electrophotographic photosensitive body.

18. The process cartridge according to claim 9, wherein said image bearing body has a drum shape.

* * * * *

UNITED STATES PATENT AND TRADEMARK OFFICE

CERTIFICATE OF CORRECTION

PATENT NO. : 6,173,145 B1
DATED : January 9, 2001
INVENTOR(S) : Kazuo Chadani et al.

It is certified that error appears in the above-identified patent and that said Letters Patent is hereby corrected as shown below:

Column 1,
Line 18, "body as" should read -- body, as --.

Column 4,
Line 25, "toner seal" should read -- toner-seal --.

Column 6,
Line 37, "to the" should read -- the --.

Column 11,
Lines 10 and 14, "developing frame" should read -- developing-frame --.

Column 22,
Line 5, "lid," should read -- 11d, --.
Line 30, "1i," should read -- 11i, --.

Column 25,
Line 39, "the (finger" should read -- (the finger --.
Line 41, "round" should read -- the round --.
Line 42, "joggles 11o" should read -- the joggles 11o, the --.

Column 28,
Line 8, "In the" should read -- In this --.
Line 36, "developing bias" should read -- developing bias --.
Line 66, "if" should read -- is --.

Column 31,
Line 21, "Ushaped" should read -- U-shaped --.
Line 65, "lie" should read -- 11e --.

Column 32,
Line 23, "Ushaped" should read -- U-shaped --.
Line 40, "12/1" should read -- 121 --.

Column 34,
Line 50, "end attaching" should read -- end-attaching --.

UNITED STATES PATENT AND TRADEMARK OFFICE

CERTIFICATE OF CORRECTION

PATENT NO. : 6,173,145 B1
DATED : January 9, 2001
INVENTOR(S) : Kazuo Chadani et al.

It is certified that error appears in the above-identified patent and that said Letters Patent is hereby corrected as shown below:

Column 35,
Lines 59 and 61, "of" should read -- of the --.

Column 39,
Line 57, "earth contact" should read -- earth-contact --.

Column 40,
Line 30, "cleaning frame" should read -- cleaning-frame --.

Column 41,
Line 38, "drum shutter" should read -- drum-shutter --.
Line 40, "uniformed" should read -- uniform --.
Line 60, "mot" should read -- not --.

Column 43,
Line 12, "protruding" should read -- protruded --.
Line 13, "protruded" should read -- protruding --.

Column 44,
Line 26, "protruded" should read -- protruding --.

Signed and Sealed this

Seventh Day of May, 2002

*Attest:*

*Attesting Officer*

JAMES E. ROGAN
*Director of the United States Patent and Trademark Office*